US010214406B2

(12) United States Patent
DiCarlo et al.

(10) Patent No.: US 10,214,406 B2
(45) Date of Patent: Feb. 26, 2019

(54) MULTI-CONTAINER FILLING MACHINE, VALVES, AND RELATED TECHNOLOGIES

(71) Applicant: World Packaging Company, Inc., Ipswich, MA (US)

(72) Inventors: Joseph A. DiCarlo, Chester, NH (US); Kenneth E. Damon, Jr., Summerfield, FL (US); Scott G. Little, Wenham, MA (US); Scott Frash, Georgetown, MA (US); Raymond E. McHugh, Manchester, NH (US); Joseph Ryan DiCarlo, Chester, NH (US)

(73) Assignee: ABC FILLERS, INC., Ipswich, MA (US)

( * ) Notice: Subject to any disclaimer, the term of this patent is extended or adjusted under 35 U.S.C. 154(b) by 19 days.

(21) Appl. No.: 15/262,886

(22) Filed: Sep. 12, 2016

(65) Prior Publication Data

US 2017/0001848 A1 Jan. 5, 2017

Related U.S. Application Data

(63) Continuation-in-part of application No. 15/190,818, filed on Jun. 23, 2016.

(60) Provisional application No. 62/183,455, filed on Jun. 23, 2015, provisional application No. 62/286,089, filed on Jan. 22, 2016.

(51) Int. Cl.

| | |
|---|---|
| ***B67C 3/20*** | (2006.01) |
| ***B67C 3/22*** | (2006.01) |
| ***B67C 3/16*** | (2006.01) |
| ***B67C 3/26*** | (2006.01) |
| ***B67C 3/28*** | (2006.01) |
| ***B67C 3/24*** | (2006.01) |

(52) U.S. Cl.

CPC ..... *B67C 3/225* (2013.01); *B67C 3/16* (2013.01); *B67C 3/24* (2013.01); *B67C 3/26* (2013.01); *B67C 3/286* (2013.01); *B67C 3/2634* (2013.01); *B67C 2003/2657* (2013.01); *B67C 2003/2668* (2013.01)

(58) Field of Classification Search

CPC B67C 3/004; B67C 3/225; B67C 3/02; B67C 3/16; B67C 3/24; B67C 3/26; B67C 3/2634; B67C 3/286; B67C 2003/228; B67C 2003/2657; B67C 2003/2668; B67C 2003/2694

USPC ..... 141/89–93, 129

See application file for complete search history.

(56) References Cited

U.S. PATENT DOCUMENTS

D191,589 S 10/1961 Schlumbohm ..... 137/312
3,455,350 A * 7/1969 Aloys ..... B67C 3/26 141/367

(Continued)

OTHER PUBLICATIONS

Notice of Allowance issued in U.S. Appl. No. 29/591,421 dated Feb. 20, 2018 (9 pgs).

*Primary Examiner* — Timothy L Maust
(74) *Attorney, Agent, or Firm* — Hayes Soloway P.C.

(57) ABSTRACT

An apparatus for filling differently sized containers with fluid includes a filling head having a fluid holding area. At least one multi-container filling nozzle connected to the filling head, wherein at least two containers with differently-sized openings are fillable with a quantity of fluid from the fluid holding area without changing the multi-container filling nozzle. Related methods and devices for filing containers with differently-sized openings with fluid without changing a fluid nozzle are also disclosed.

20 Claims, 70 Drawing Sheets

(56) References Cited

U.S. PATENT DOCUMENTS

| | | | | |
|---|---|---|---|---|
| 4,170,252 | A * | 10/1979 | Peterson | B67C 11/02 141/331 |
| 4,674,547 | A * | 6/1987 | Simonazzi | B67C 3/2614 141/181 |
| 5,343,886 | A * | 9/1994 | Beswick | B08B 9/205 134/131 |
| D417,847 | S | 12/1999 | Rush | D7/629 |
| 6,038,833 | A * | 3/2000 | Beringer | B67C 3/26 141/368 |
| D480,969 | S | 10/2003 | Owens | 220/4.27 |
| 1,525,127 | A1 | 7/2006 | Cogley | 9/456 |
| 7,299,832 | B2 * | 11/2007 | Hartness | B65G 17/323 141/144 |
| D643,912 | S | 8/2011 | Bowman | D23/269 |
| D648,427 | S | 11/2011 | Bowman | D23/269 |
| D662,767 | S | 7/2012 | Hotell | D7/396.2 |
| D681,176 | S | 4/2013 | Chacko | D23/269 |
| D682,611 | S | 5/2013 | Carder | D7/392.1 |
| D696,751 | S | 12/2013 | Beagan, Jr. | 323/269 |
| D697,180 | S | 1/2014 | Van De Klippe | D23/269 |
| D716,653 | S | 11/2014 | Balembois | D9/435 |
| D718,136 | S | 11/2014 | Harrity | D9/499 |
| D731,035 | S | 6/2015 | Lo Cicero | D23/269 |
| D744,068 | S | 11/2015 | Turner | D23/269 |
| D752,975 | S | 4/2016 | Gatto | D9/434 |
| D761,398 | S | 7/2016 | Murphy | D23/269 |
| D761,649 | S | 7/2016 | Buck | D9/447 |
| D802,326 | S | 11/2017 | Beaver | D6/515 |
| 2001/0045242 | A1 * | 11/2001 | Clusserath | B67C 3/12 141/144 |
| 2005/0178466 | A1 * | 8/2005 | Tanikawa | B67C 3/2614 141/57 |

* cited by examiner

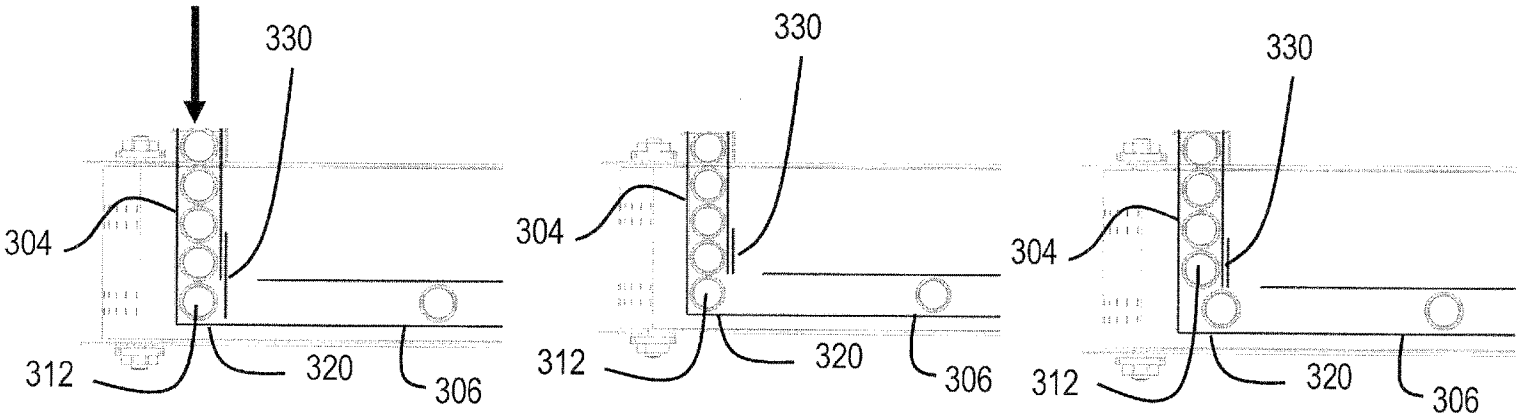
FIG. 36A
FIG. 36B
FIG. 36C
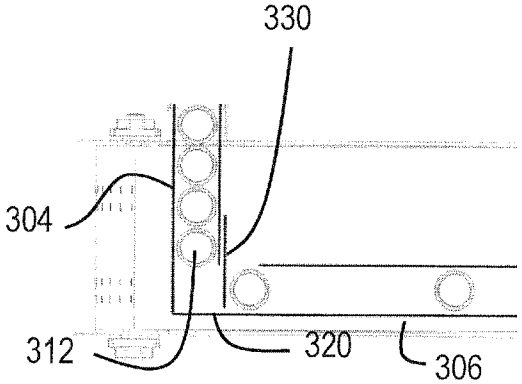
FIG. 36D
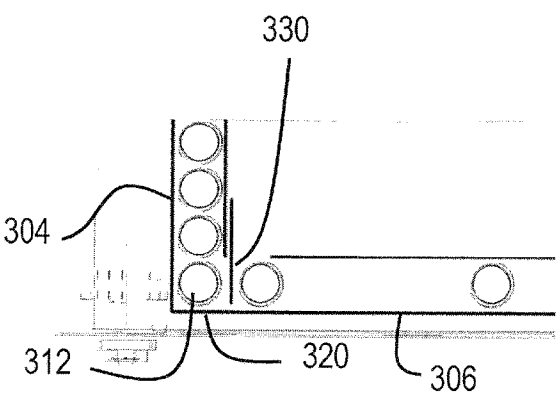
FIG. 36E

MULTI-CONTAINER FILLING MACHINE, VALVES, AND RELATED TECHNOLOGIES

CROSS REFERENCE TO RELATED APPLICATION

This application claims the benefit of U.S. Provisional Application Ser. No. 62/286,089 filed Jan. 22, 2016 and is a continuation-in-part application of U.S. patent application Ser. No. 15/190,818 entitled, "Adjustable Multi-Container Filler and Closer Machine" filed Jun. 23, 2016, which itself, claims benefit of U.S. Provisional Application Ser. No. 62/183,455 filed Jun. 23, 2015 and, the entire disclosures of which are incorporated herein by reference.

FIELD OF THE DISCLOSURE

The present disclosure is generally related to container filling machines and more particularly is related to a multi-container filling machine, valves, and related technologies.

BACKGROUND OF THE DISCLOSURE

A variety of types of filling machines are used throughout the food and beverage industries to fill containers with beverages and liquid food products. Many large productions utilize filling machines that are designed to fill a specific container type, which has a specific container dimension and fluid volume. These machines are commonly expensive and only used by large-scale productions. Small productions, such as micro-breweries, are often unable to afford these large-scale machines due to their high cost and the large-scale production of goods that makes them economically viable. As a result, small productions must resort to having their products packaged off-site by third party companies, or utilize packages or containers which are different from what the production company desires.

Moreover, even if large-scale filling machines were affordable, they are generally unable to be easily adapted to be used successful with the diversity of containers that are used by small-scale productions. This diversity of containers may range from 1 liter glass wine bottles, to 12 ounce beer bottles, to 12 ounce aluminum beer cans, to large growlers, and all containers in between. For example, in order to fill both 12 ounce beer bottles and 64 ounce growlers, a micro-brewery would need to either purchase two different filling machines or spend significant time changing parts out of the filling machine to properly adapt it for use with the different containers.

In addition to these above-noted shortcomings in the industry, there are a number of other drawbacks that come with using conventional filling machines to which the subject disclosure provides substantial improvements over.

Thus, a heretofore unaddressed need exists in the industry to address the aforementioned deficiencies and inadequacies.

SUMMARY OF THE DISCLOSURE

Embodiments of the present disclosure provide an apparatus for filling containers with fluid. Briefly described, in architecture, one embodiment of the apparatus, among others, can be implemented as follows. The apparatus for filling containers with fluid has a filling head having a fluid holding area. At least one multi-container filling nozzle is connected to the filling head, wherein at least two containers with differently-sized openings are fillable with a quantity of fluid from the fluid holding area without changing the multi-container filling nozzle.

The present disclosure can also be viewed as providing a multi-container beverage filling apparatus. Briefly described, in architecture, one embodiment of the apparatus, among others, can be implemented as follows. A filling head has a fluid holding area. A valve is positioned at least partially within the fluid holding area. At least one multi-container filling nozzle is connected to a dispensing end of the valve, wherein at least two types of beverage containers with differently-sized openings are fillable with a quantity of fluid from the fluid holding area without altering the multi-container filling nozzle.

The present disclosure can also be viewed as providing a method of filling containers with fluid. In this regard, one embodiment of such a method, among others, can be broadly summarized by the following steps: providing at least a first fluid container and a second fluid container, wherein a size of an opening of the first fluid container is different from the size of the opening of the second fluid container; and supplying a fluid to both of the at least two containers using a single multi-container filling nozzle.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 36A-36E are top view schematic diagrams of the guillotine gate of the container-filling machine, in accordance with the first exemplary embodiment of the present disclosure.

DETAILED DESCRIPTION

The subject disclosure is related to a multi-container filling device capable of filling containers having differently-sized openings and volumes with liquids and other viscous substances, namely food and beverage products. Commonly, the multi-container filling device may be used in the beverage industry, such as to package beverages into aluminum cans, glass bottles, or similar containers. Accordingly, the multi-container filling device may be used by smaller-scale beverage producers, such as micro-breweries or small wineries which have the need to package their products in cans and bottles but do not have the need to operate conventional, large-scale filling machines.

Figure 1A:
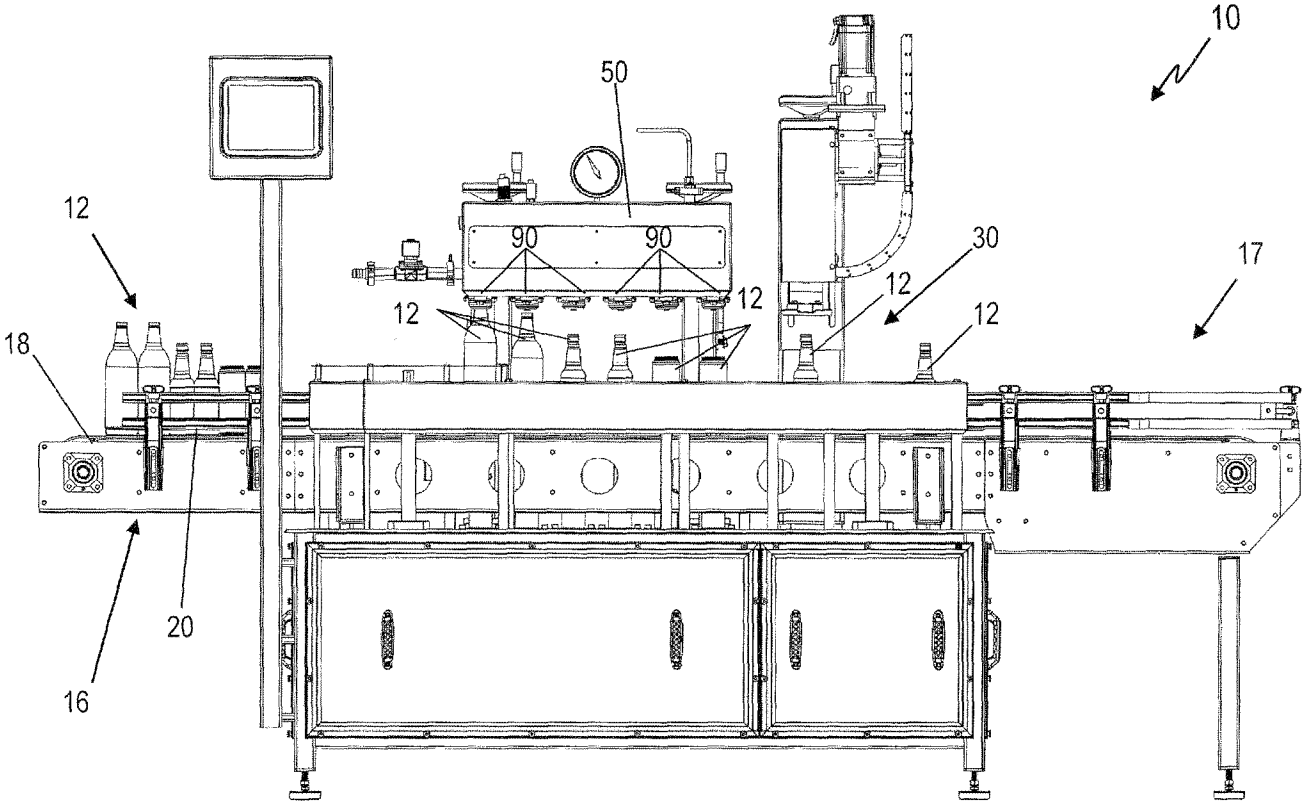
FIGS. 1A-1F are front view, left side view, right side view, back view, top view, and bottom view illustrations, respectively, of a container-filling machine, in accordance with a first exemplary embodiment of the present disclosure.
Figure 1B:
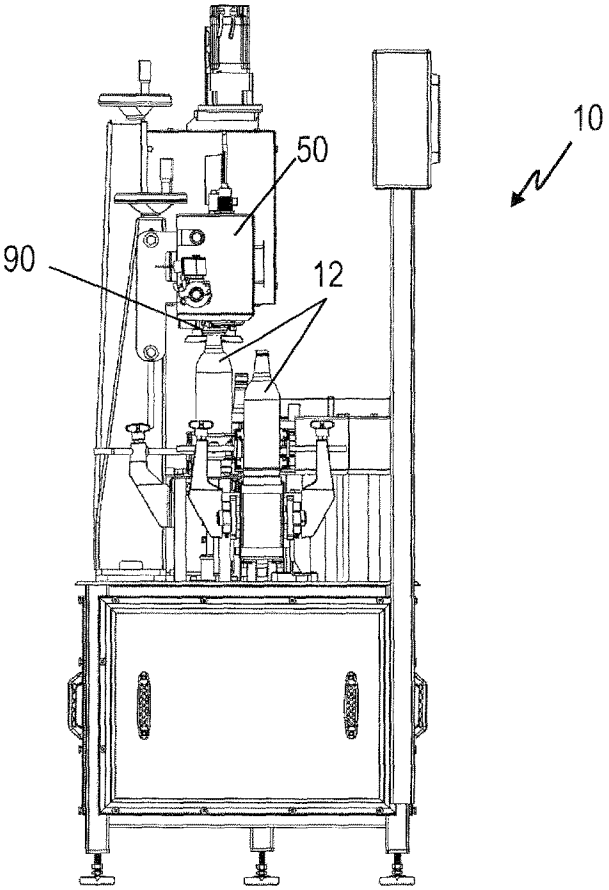
Figure 1C:
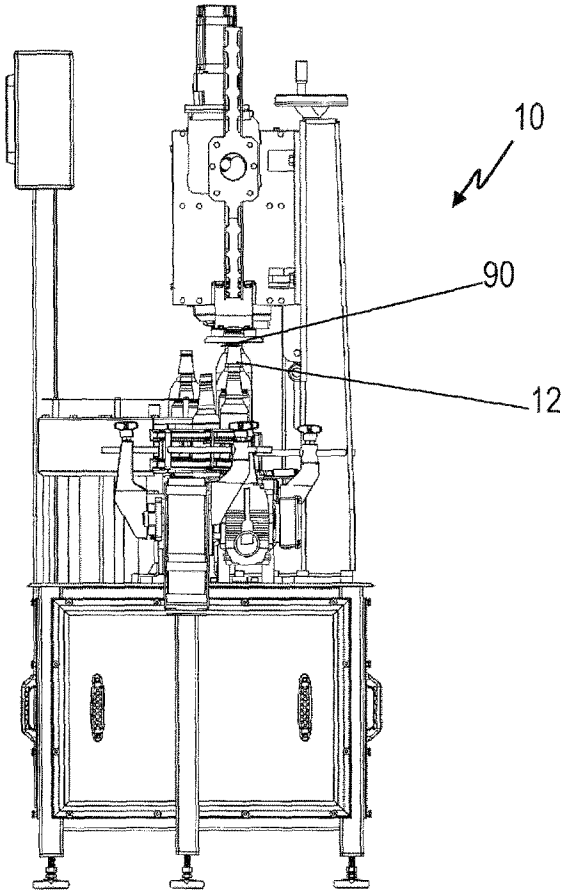
Figure 1D:
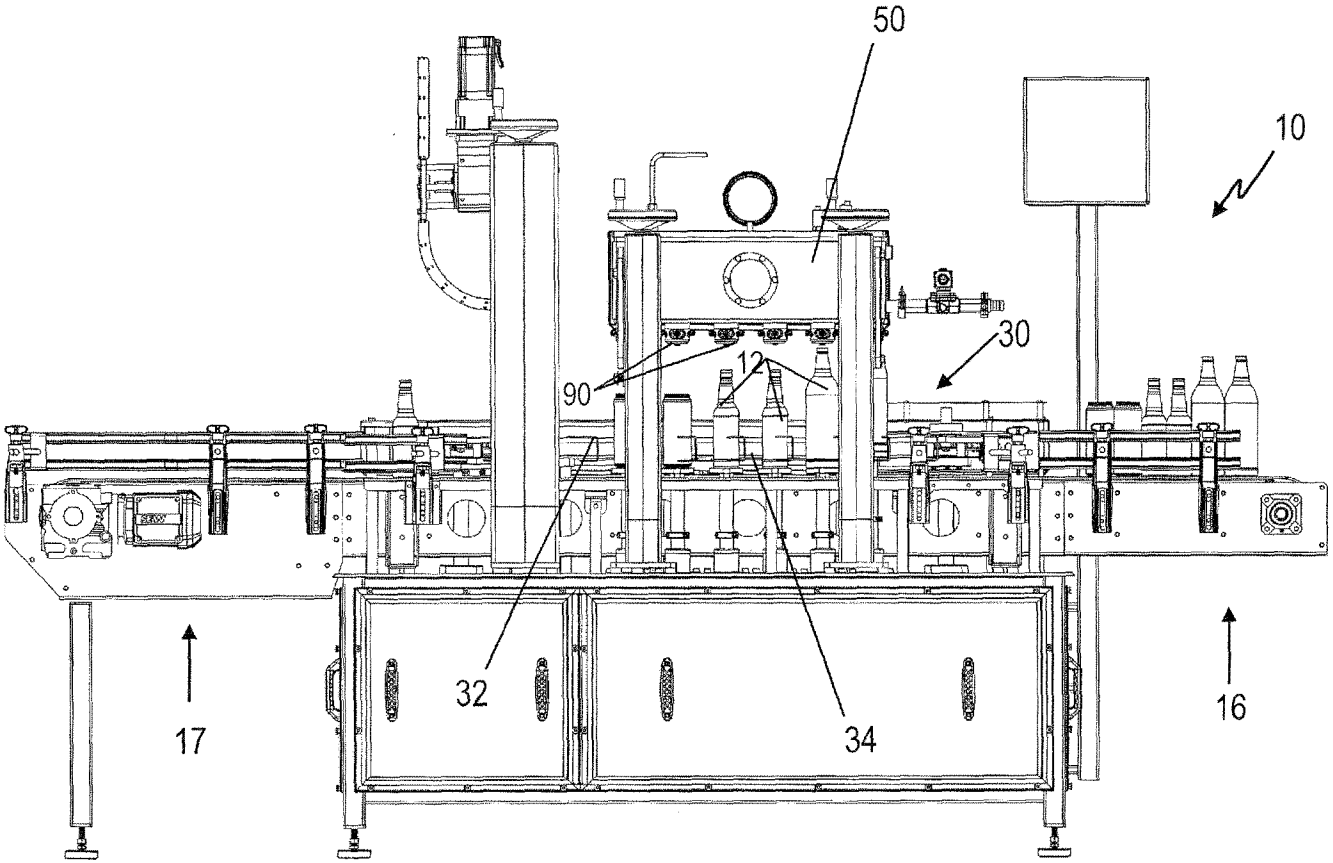
Figure 1E:
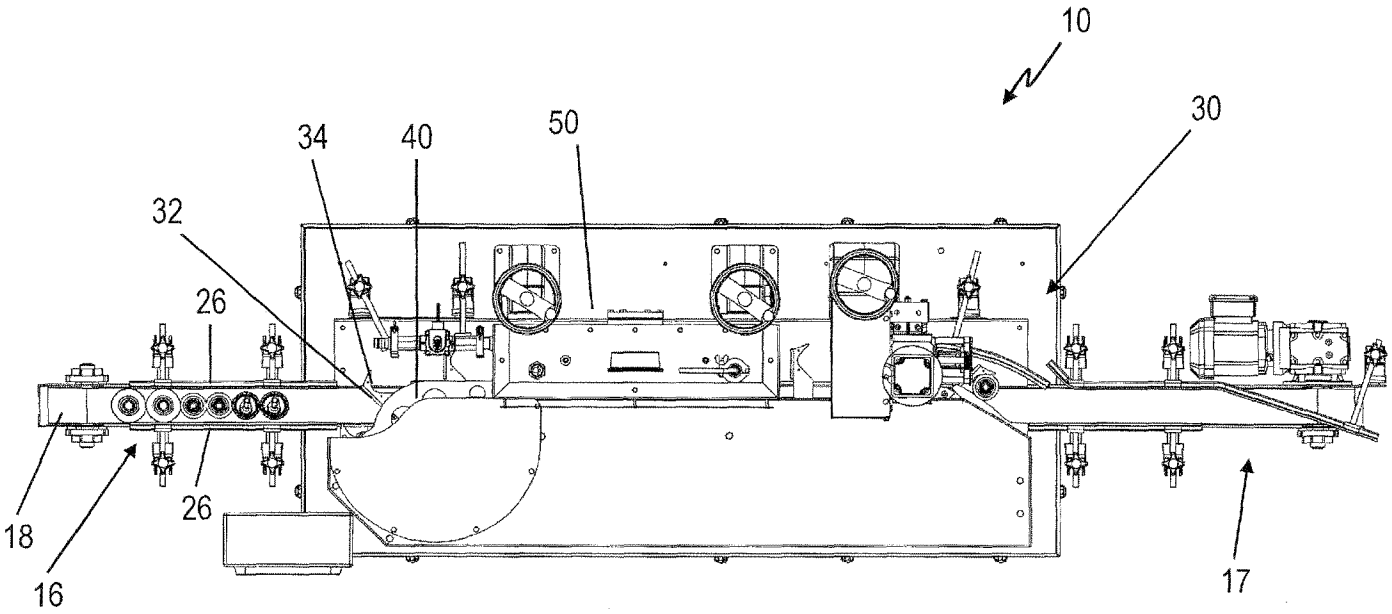
Figure 1F:
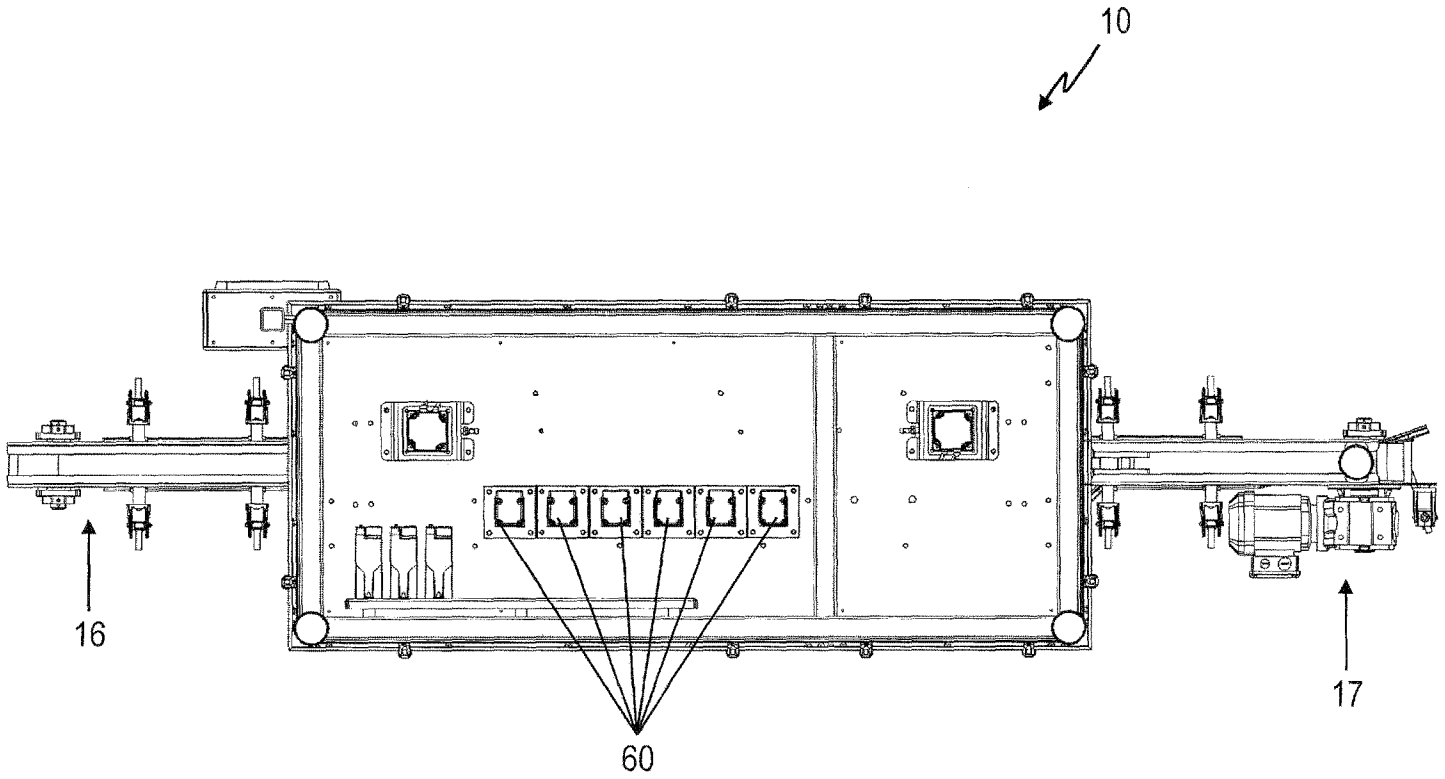

FIGS. 1A-1F are front view, left side view, right side view, back view, top view, and bottom view illustrations, respectively, of a container-filling machine 10, in accordance with a first exemplary embodiment of the present disclosure. Relative to FIGS. 1A-1F, the container-filling machine 10, which may be referred to herein simply as 'apparatus 10' generally includes a conveyer apparatus 30 which is moveable past a filling head 50 having a plurality of filling nozzles 90. The conveyer apparatus 30 includes a variety of components which are used to transport containers from an entry side of the apparatus 10 to an exit side of the apparatus 10 where the containers 12 exit at a container exit 17. As is best shown in FIG. 1A, the containers 12—where cans, bottles, or similar containers 12—enter the apparatus 10 at a container entry 16. In one example, the container entry 16 is a first movable belt 18 on which the containers 12 ride in between two or more container guides 20. The containers 12 enter the conveyer apparatus 30 through the use of a gate 40 which selectively controls container entry into a lug chain 32 with a plurality of container-carrying positions 34 formed therein. Once the containers 12 are positioned within the container-carrying positions 34 of the lug chain 32, the lug chain 32 moves the containers 12 past a plurality of smart lift devices 60 which are positioned in-line with at least a portion of the lug chain 32. Each of the plurality of smart lift devices 60 controls a raising and lowering of a container 12 relative to one of the nozzles 90.

Figure 2A:
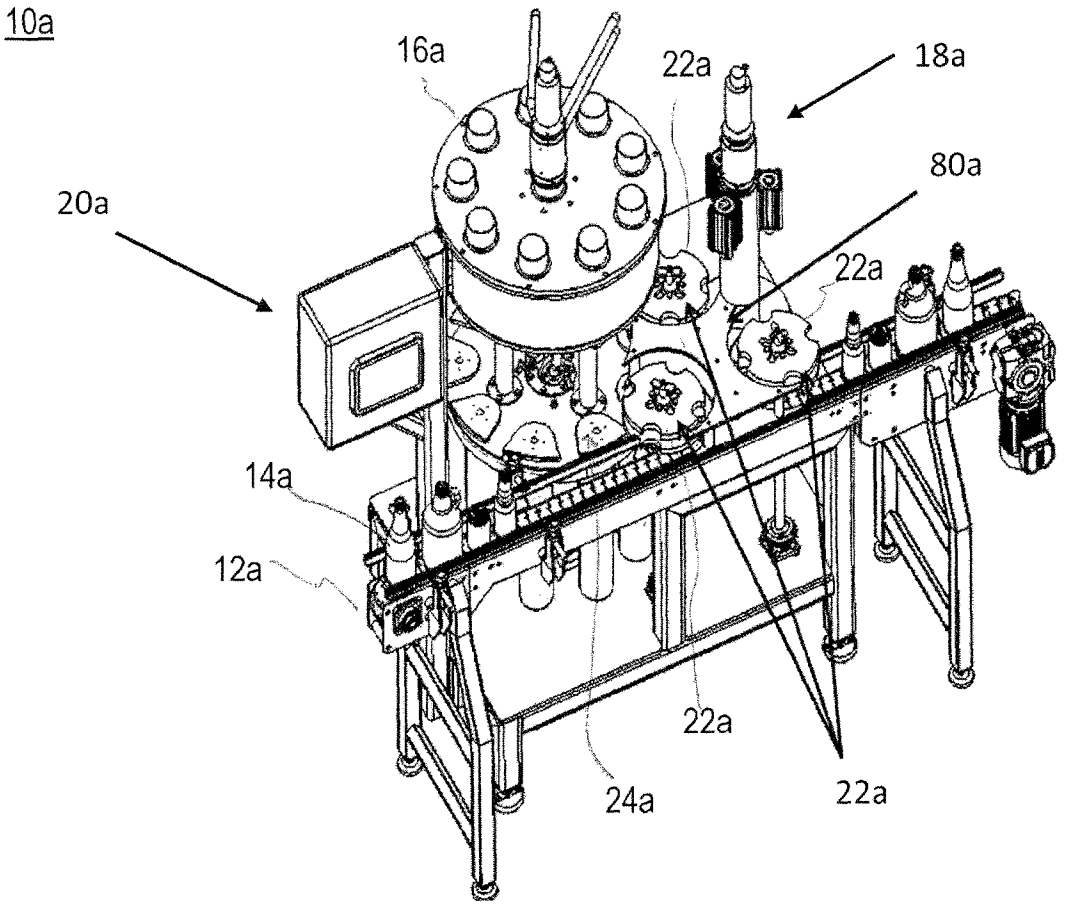
FIG. 2A is front perspective view of a rotary-based container-filling machine, in accordance with a second exemplary embodiment of the subject disclosure.
Figure 2B:
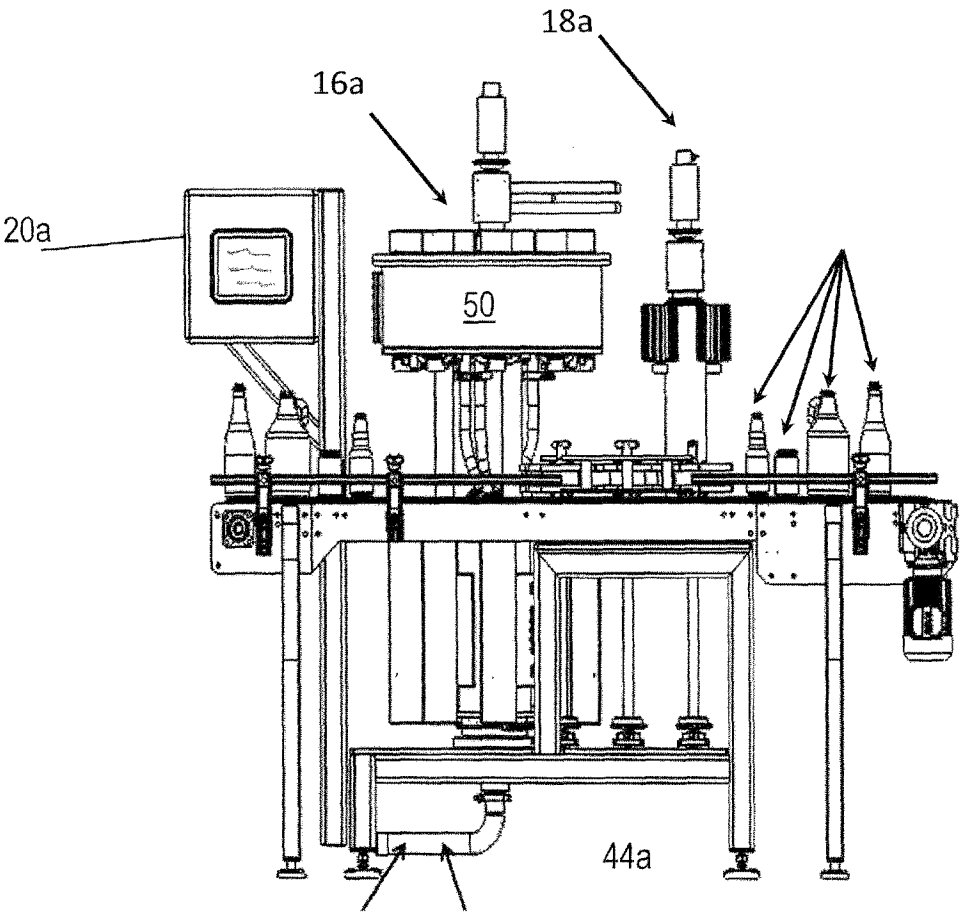
FIG. 2B is a front view of the rotary-based container-filling machine of FIG. 2A, in accordance with the second exemplary embodiment of the subject disclosure.
Figure 2C:
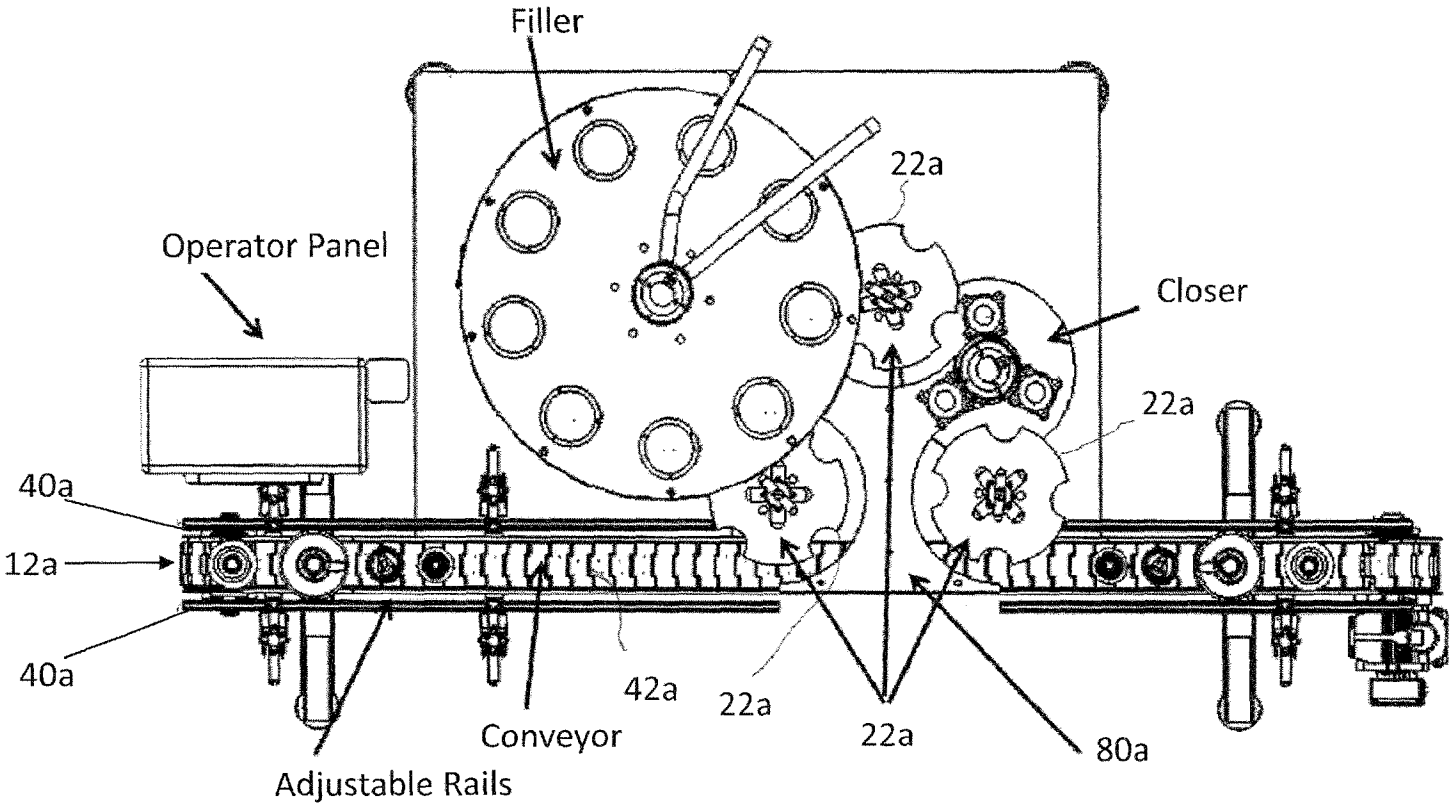
FIG. 2C is a top view of the rotary-based container-filling machine of FIG. 2A, in accordance with the second exemplary embodiment of the subject disclosure.
Figure 2D:
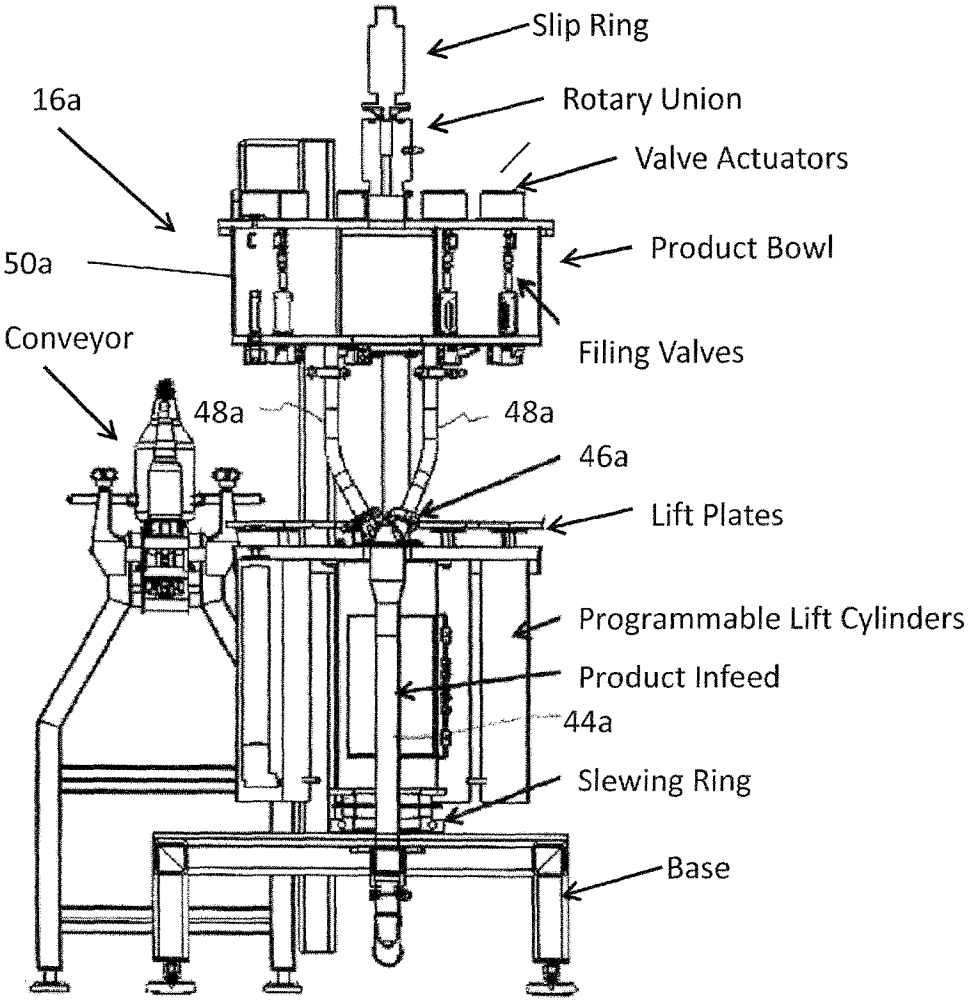
FIG. 2D is a right end view of the rotary-based container-filling machine of FIG. 2A, in accordance with the second exemplary embodiment of the subject disclosure.
Figure 2F:
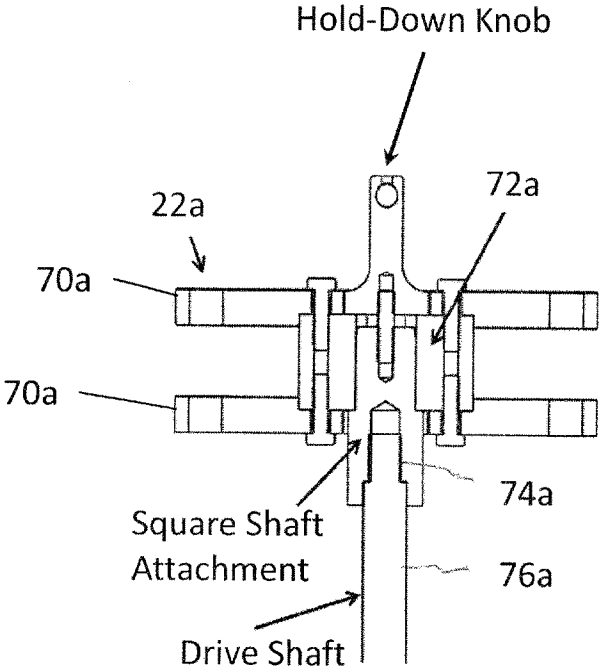
FIGS. 2E and 2F are perspective and cross-sectional views of the star wheel assembly utilized in the rotary-based container-filling machine of FIG. 2A, in accordance with the second exemplary embodiment of the subject disclosure.
Figure 2E:
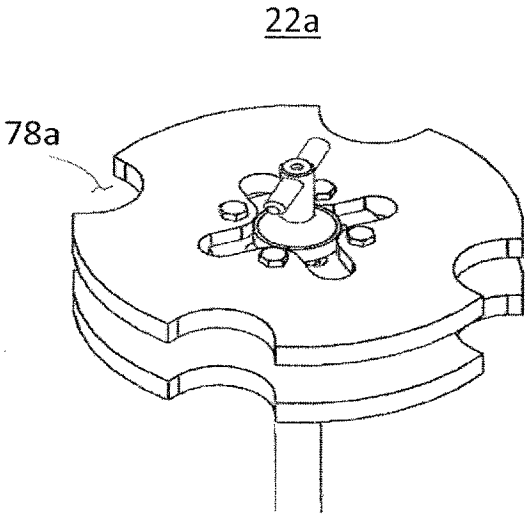
Figure 2H:
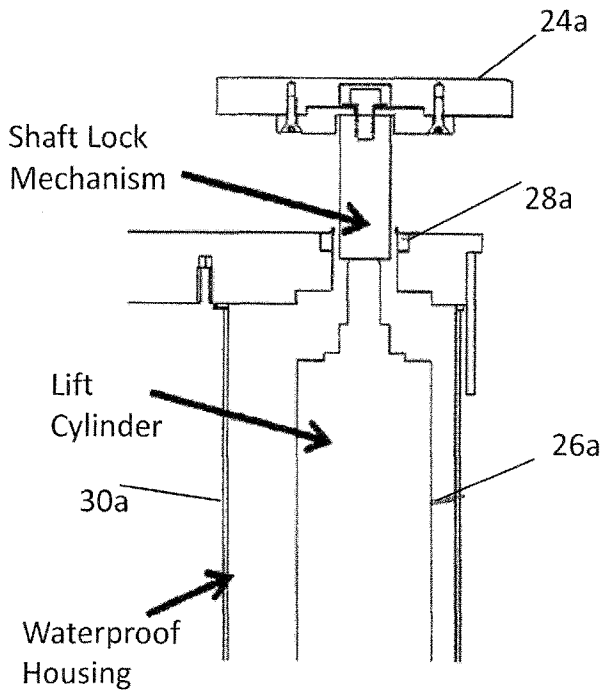
FIG. 2H is a detailed cross-sectional view of the lift cylinder and lift plate which forms part of the rotary-based container-filling machine of FIG. 2A, in accordance with the second exemplary embodiment of the subject disclosure
Figure 2G:
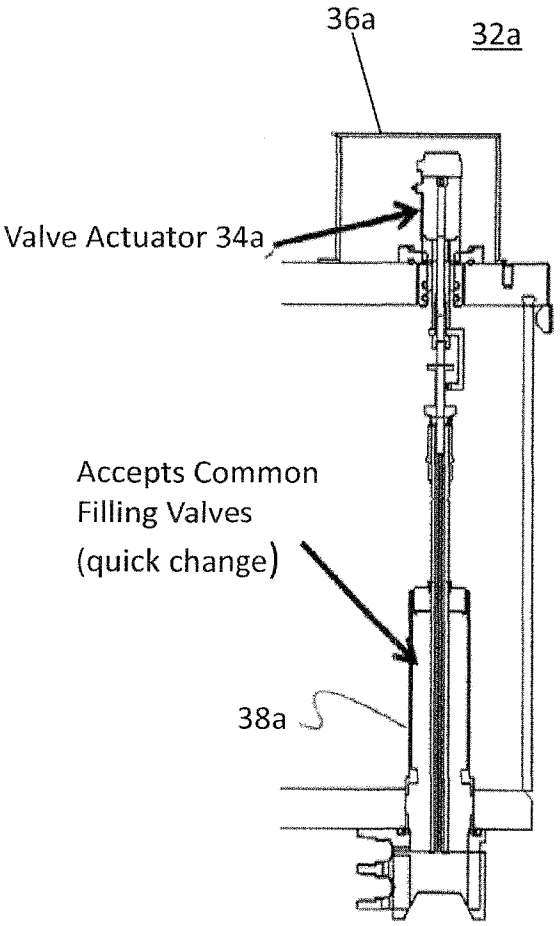
FIG. 2G is a detailed cross-sectional view of the filling mechanism which forms part of the rotary-based container-filling machine of FIG. 2A, in accordance with the second exemplary embodiment of the subject disclosure.
Figure 2I:
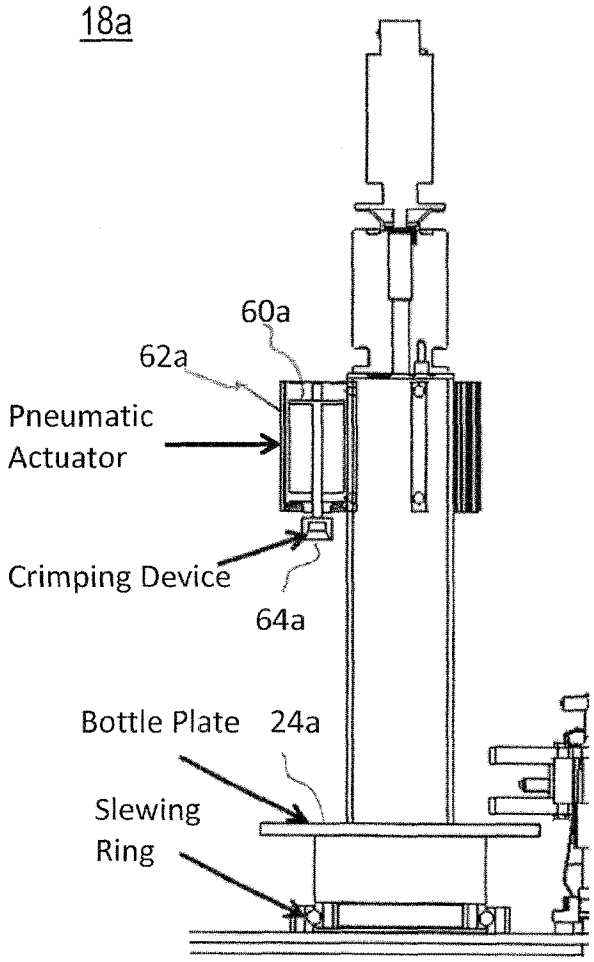
FIG. 2I is a detailed, schematic view of the closer in accordance with one feature which forms part of the rotary-based container-filling machine of FIG. 2A, in accordance with the second exemplary embodiment of the subject disclosure.

FIGS. 2A-2I are various illustrations of a rotary-based container-filling machine 10*a*, in accordance with a first exemplary embodiment of the present disclosure. Specifically, FIG. 2A is front perspective view of the rotary-based container-filling machine 10*a*; FIG. 2B is a front view of the rotary-based container-filling machine 10*a* of FIG. 2A; FIG. 2C is a top view of the rotary-based container-filling machine 10*a* of FIG. 2A; FIG. 2D is a right end view of the rotary-based container-filling machine 10*a* of FIG. 2A; FIGS. 2E and 2F are perspective and cross-sectional views of the star wheel assembly utilized in the rotary-based container-filling machine 10*a* of FIG. 2A, respectively; FIG. 2G is a detailed cross-sectional view of the filling mechanism which forms part of the rotary-based container-filling machine 10*a* of FIG. 2A; FIG. 2H is a detailed cross-sectional view of the lift cylinder and lift plate which forms part of the rotary-based container-filling machine 10*a* of FIG. 2A; and FIG. 2I is a detailed, schematic view of the closer in accordance with one feature which forms part of the rotary-based container-filling machine 10*a* of FIG. 2A. The rotary-based container-filling machine 10*a* of FIGS. 2A-2I may be similar to that of the apparatus 10 of FIG. 1A-1F but may include a rotary filler design instead of an in-line filler design. However, many of the components of the rotary filler design of FIGS. 2A-2I may be used or incorporated into the apparatus 10 of FIGS. 1A-1F without limitation.

As is shown in FIGS. 2A-2I, the rotary-based container-filling machine 10*a* includes an in-feed and out-feed conveyer 12*a*, which serves to carry containers 14*a* to be filled to the container filling portion 16*a*. The in-feed and out-feed conveyor 12*a* may be a fixed width of between approximately 6 to 18 inches, or it may be an adjustable width depending on the design of the rotary-based container-filling machine 10*a*. The side rails 40*a* of the conveyor 12*a* may be adjustable to allow the containers 14*a* to be filled to remain generally centered over the actual conveyor belt 42*a*.

The star wheels 22*a* serve to move the containers 14*a* to and from the various positions within the multi-container filler and closer machine 10*a*. For example, a first star wheel 22*a* moves the container 14*a* from the in-feed conveyor 12*a* and then places each container 14*a* on a lift plate 24*a*. Once the container 14*a* is in position on the lift plate 24*a*, a servo motor operated lift cylinder 26*a*, as shown in FIG. 2H, raises the lift plate 24*a* to the appropriate height as directed by the software operating and displayed on the operator panel 20*a*. The lift cylinders 26*a* are designed so as to include a current measuring feedback system. The current measuring feedback system operates by detecting the real-time current being applied to the lift cylinder and once the current begins to increase, this current signal will be provided to the system controller and the software which will interpret this increase in current as an indication that whatever size container has been placed on the lift plate 24*a* is now securely pushed up against the filling mechanism and further operation and activation of the lift cylinder 26*a* ceases.

A shaft lock mechanism 28*a* may then engage with the shaft of the lift cylinder 26*a* to maintain the lift plate 24*a* and container 14*a* at the appropriate height during the filling and closer operations. The shaft lock mechanism 28*a* engages with the shaft of the lift cylinder following which the fill mechanism may exert downward pressure on the container supported by the lift plate 24*a* but since the lift plate 24*a* is locked in place, it will not move allowing the container, of any size, to be filled. In this manner, there is no specialized hardware required to fill one size container versus another, but rather the software and current measuring device is utilized to achieve this goal. Once the container 14*a* is filled, the container is transferred to the closer mechanism 18*a* which serves to place an appropriate cap or sealing device on the container, following which the container is transferred to the out-feed conveyor 12*a* for packaging. An operator panel 20*a* running appropriate software and control operation of the filler and closer machine 10*a*.

It is noted that the shaft lock mechanism 28*a* may be replaced by or further include a break applied to the intelligent lifting cylinder motor/actuator motor shaft, to prevent and/or eliminate any downward linear movement of the lift cylinder and the lift plate 24*a* during the container filling operation which might be caused by any downward pressure from the filling mechanism or filling fluid contained in the tanks and/or mechanism above the containers being filled.

One feature of the present disclosure is that lower cost lift cylinders 26*a* are utilized since they are enclosed within a waterproof housing 30*a*. The waterproof housing keeps the lift cylinders 26*a* waterproof while allowing much lower cost lift cylinders to be utilized.

FIG. 2G illustrates a detailed view of the filler mechanism 16*a* which includes a valve actuator 34*a* contained within a waterproof housing 30*a*. The use of a waterproof housing 36*a* allows more readily available, less expensive actuator valves 34*a* to be utilized. A number of quick change filling valves 38*a* (one for each filling station) are provided. These filling valves 38*a* are commonly used filling valves, well known to those skilled in the art.

The present invention is designed to fill a variety of containers, be they cans, bottles, growlers, champagne bottles or the like, with any type of liquid or fluid that is viscous or flowable enough to be dispensed and filled with the container filler and closer machine of the present invention.

Once the filler mechanism 16*a* fills the container 14*a* lifted up against the filling valve 32*a*, a second star wheel 22*a* then transfers the filled container 14*a* to the closer mechanism 18*a*. Once the filled container 14*a* is closed (capped or otherwise), a third star wheel 22*a* transfers the now closed and filled container 14*a* to the conveyor 12*a* for packaging. The coordination and synchronization between the conveyor 12*a*, the star wheels 22*a*, the filling mechanism 16*a* and the closer mechanism 18*a* is controlled by a single unitary drive chain (not shown but well known in the art) operated by a single motor.

Product to be filled into the containers 14*a* may be provided through a product in-feed tube 44*a*, as shown in FIGS. 2B and 2D. The product is then provided to a turbulence free manifold 46*a*, as shown in FIG. 2D. From the turbulence free manifold 46*a*, a number (three for example) of fill tubes 48*a* fill the product bowl 50*a*.

The closer mechanism 18*a* is shown in greater detail in FIG. 2I (without a container in place for greater clarity). A pneumatic actuator 60*a* enclosed within a waterproof housing 62*a* actuates a crimping device 64*a* or other type of appropriate device to apply the proper closure on the container. Contemplated closure types include a crowner, a lidder, a capper, and a tamperproof aluminum closure often referred to in the industry as a ROPP closure.

The container to be closed 14*a* is placed on the lift plate 24*a* and raised to the appropriate level to interconnect or interface with the crimping device 64*a*, following which the third star wheel 22*a* removes the filled and closed container 14*a* and provides it to the conveyor system 12*a* for packaging and/or further processing.

The filling operation of a container 14*a* begins by the first star wheel 22*a* transferring the first container 14*a* to one of the lift plates 24*a* (subsequent containers are handled in sequence the same way). The lift plate 24*a* is raised by the lift cylinder 26*a* whereby the lift plate 24*a* is locked in place with a sprag clutch/mechanism 28*a*. The container 14*a* is then pressurized with $CO_2$ to approximately the same pressurization at that of the filler bowl 50*a*. This helps control the filling of the containers 14*a* and helps ensure less turbulence in the container 14*a* during the filling process. Once the container 14*a* is full of product, the cylinder 26*a* is raised slightly to relieve the load on the sprag mechanism 28*a*. The sprag mechanism 28*a* is then released by raising the cylinder slightly and the cylinder 26*a* is lowered all of the way following which the filled container 14*a* is moved by the second star wheel 22*a* to the closer mechanism 18*a*.

The star wheel assembly 22*a* is shown in greater detail in FIGS. 2E-2F. Each star wheel assembly 22*a* is comprised of a first plate 70*a* and a second generally identical plate 70*b*. The plates 70*a* are held together by means of a quick change hub 72*a* which is designed to fit over the square shaft attachment region 74*a* of the drive shaft 76*a*. Each star wheel assembly can be quickly changed by lifting the assembly 22*a* off the square shaft attachment region 74*a* and replacing the star wheel assembly with one of a different size. Each plate 70*a* includes one or more cut out regions 78*a* which are sized to fit with or otherwise accommodate the particular container 14*a* currently being filled. As shown in FIGS. 2A and 2C, between each star wheel 22*a* is a quick change guide rail system 80*a*.

Software operating and displayed on the operator panel 20*a* allows full control of the adjustable, multi-container filler and closer machine according to one aspect of the present invention. The software allows the operator to select the type/size of the container 14*a* to be utilized. This can be done visually by presenting the operator with a picture/drawing of various container types and sizes, and allowing the operator to touch the operator screen 20*a* to select the desired container size. The software, in connection with the various components (such as the lift cylinder providing current feedback on lift resistance to allow the software to adjust for various heights of containers to be filled) will then know how to control all the programmable features of the machine of the invention including lift plate 24*a* height; amount of actuation of all actuators for filling and capping the containers; drive of the drive chain to move the containers by means of the conveyor 12*a* and the star wheels 22*a* and the like. The only physical "changes" required to be made by the operator are to adjust the conveyor rails 40*a*; and change out the star wheels 22*a* and the guide rail system 80*a*. All other variables will be controlled by the software.

Figure 3A:
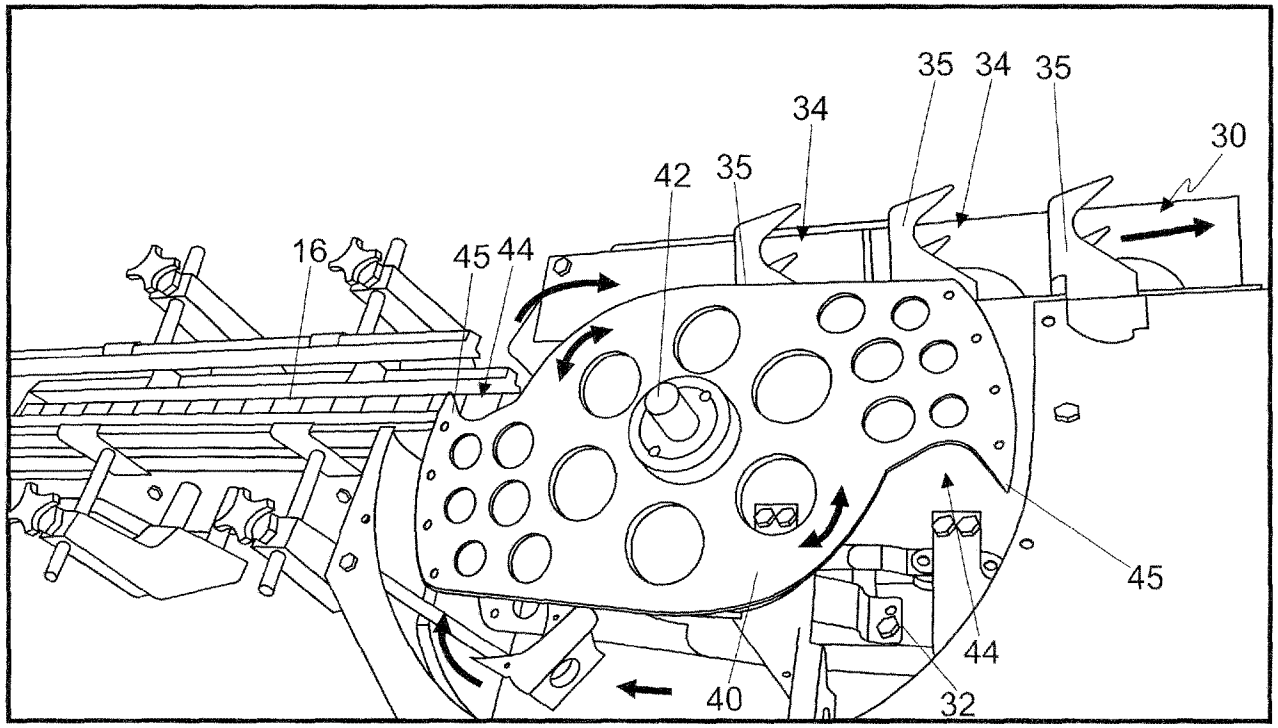
FIGS. 3A-3E are images of the gate, conveyer apparatus having the lug chain, in accordance with the first exemplary embodiment of the present disclosure.
Figure 3B:
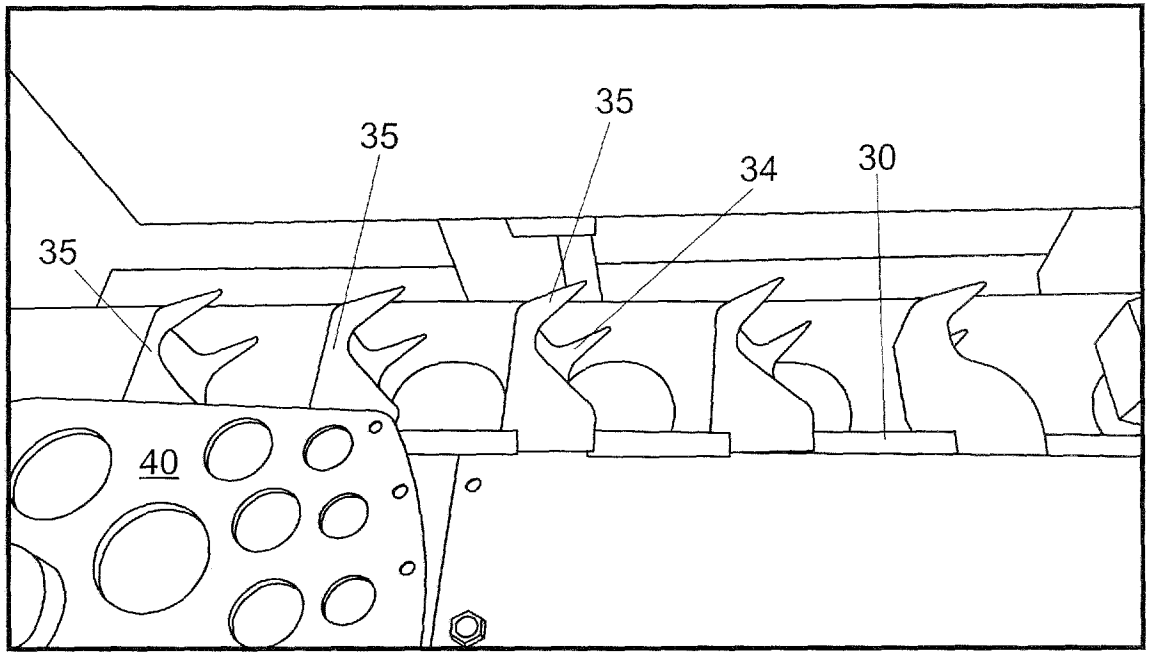

With reference back to the container-filling machine 10 of FIGS. 1A-1F, FIGS. 3A-3E are various pictures of the gate 40, conveyer apparatus 30 having the lug chain 32, in accordance with the first exemplary embodiment of the present disclosure. As shown in FIG. 3A, the gate 40 may be formed from a rotatable structure positioned on an axle 42. At least one but commonly a plurality of container entry ports 44 are formed within the gate 40, such that as the gate 40 rotates past the container entry 16, a container (not shown) can be contacted by the point of the container entry port 44 and transferred from the container entry 16 into the lug chain 32. In FIG. 3A, the gate 40 is shown with two main container entry ports 44, but any number of container entry ports 44 may be included in a single gate 40. One of the main benefits of the gate 40 is that it can be used for different sized containers by simply rotating the gate 40 to align the properly sized container entry port 44 with the container being used. This rotation may be computer controlled with the axle 42, such that manual mechanical refitting or adjustment of the apparatus 10 is not necessary.

The lug chain 32 may be an elongated, looped structure which is positioned to move along the length of the apparatus 10. As shown in FIGS. 3A-3D, the lug chain 32 may be rotatable about the axle 42 that the gate 40 is rotatable on and a second axle positioned at the exit side of the apparatus 10. The lug chain 32 has container-carrying positions 34 formed by lugs 35 which are, in one example, rigid, stainless steel guides which can guide a container through the apparatus 10. The container-carrying positions 34 in the lugs 35 may have a specifically-selected shape, such as a 90° angle which has been found through experimentation to successfully work with containers having a multitude of different diameters.

Figure 3C:
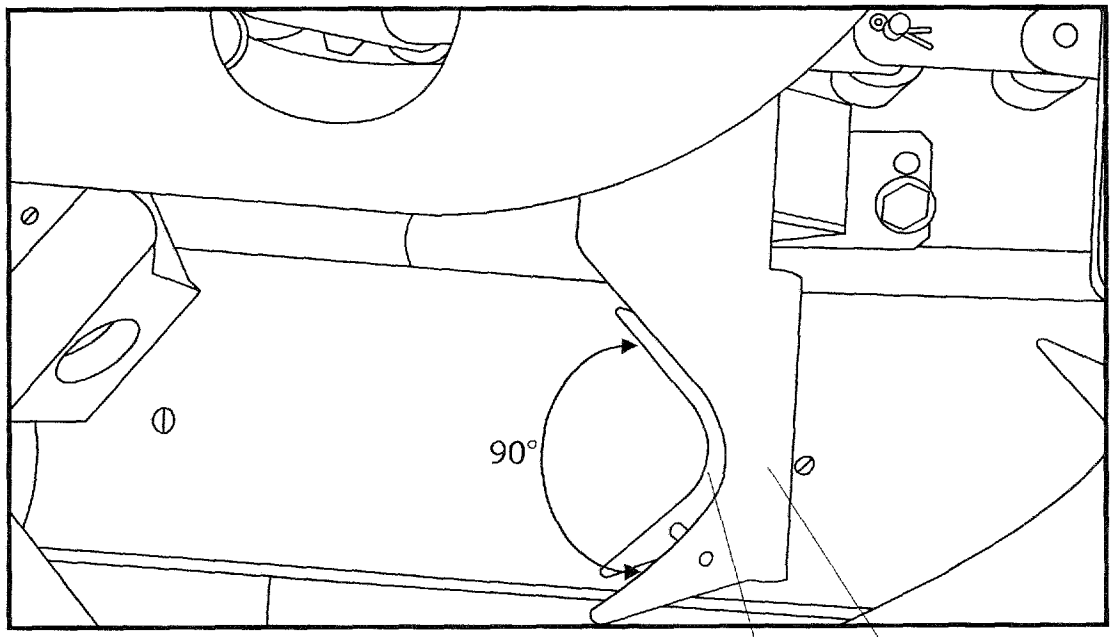
Figure 3D:
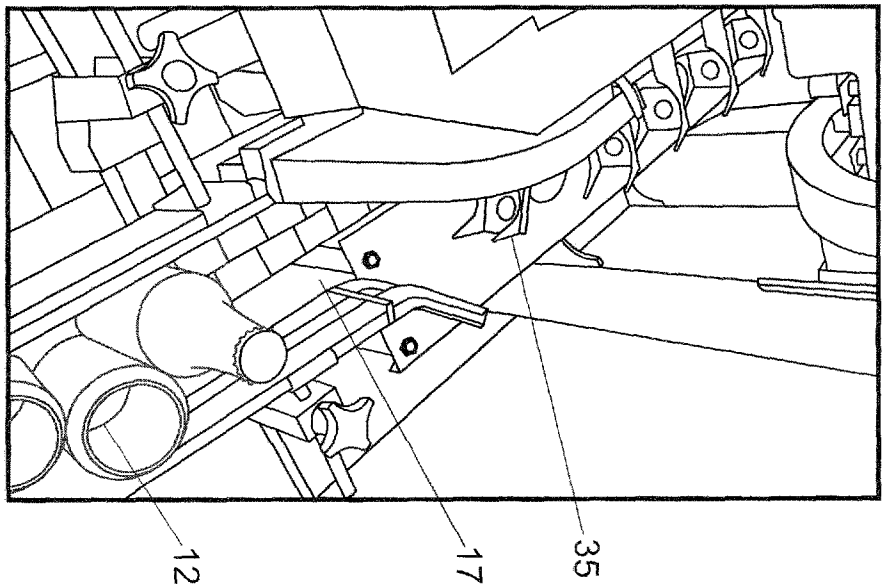

The movement of the lug chain 32 and the gate 40 may be synchronized to allow the gate 40 to move a container from the container entry 16 to one of the container-carrying positions 34 on the lug chain 32. This movement may include the gate 40 rotating about the axle 42 at a small radial degree in both clockwise and counter-clockwise directions, such that the tip 45 of the container entry port 44 moves between a position blocking the container from moving through the container entry 16 to a position where the tip 45 retrieves from the container entry 16 to allow the container to move into the container entry port 44. The lug chain 32 may be movable in constant or intermittent schemes, depending on the operation of the apparatus 10. For example, the lug chain 32 may move constantly during a loading process where the containers are moved from the entry 16 to the lug chain 32 and then switch to an intermittent process to allow the containers to stop under the nozzles. The movement of the gate 40 and lug chain 32 is illustrated in arrows in FIG. 3A. FIG. 3C illustrates in detail the lug 35 having the container-carrying position 34 with a 90° angle.

Figure 3E:
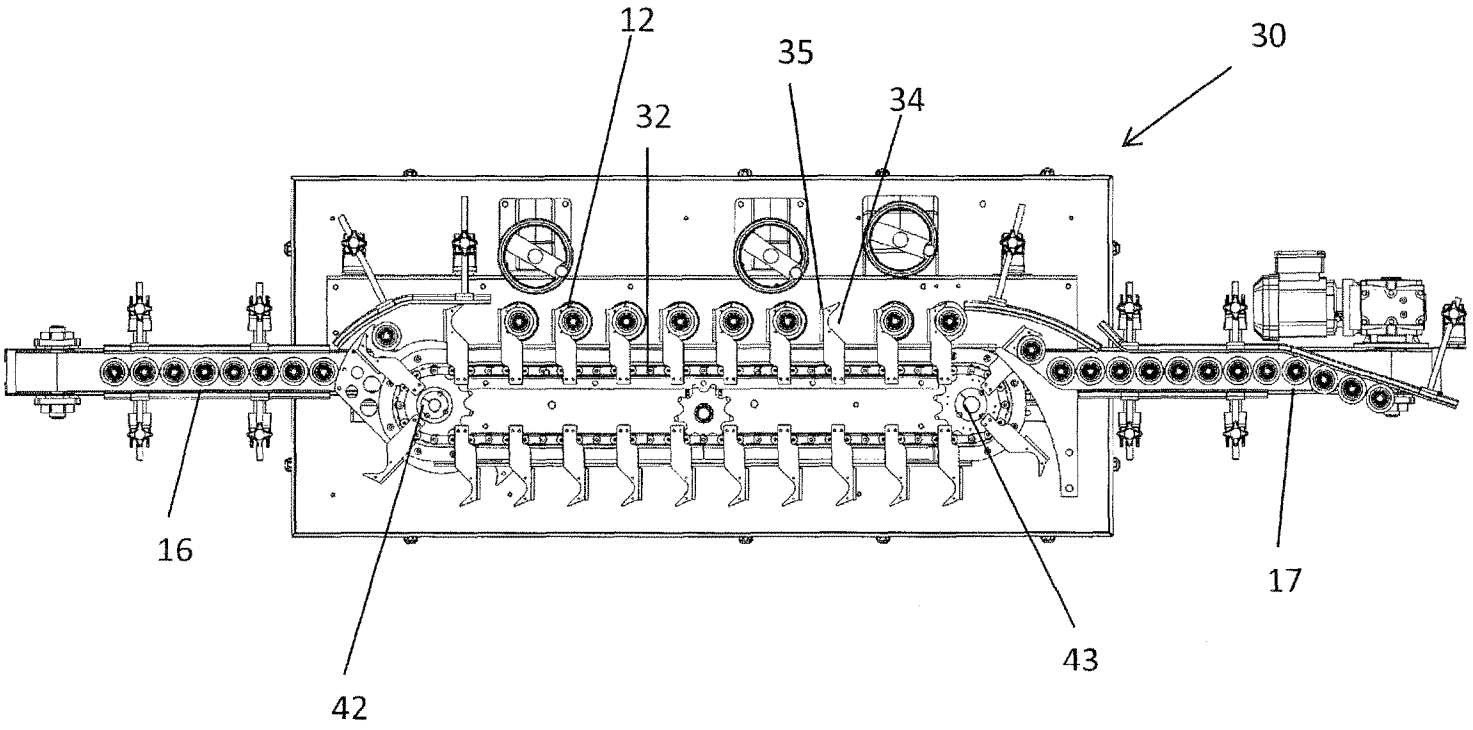

FIG. 3E is top-view illustration of the conveyer apparatus 30 having the lug chain 32, in accordance with the first exemplary embodiment of the present disclosure. As can be seen, the lug chain 32 is movable about the first axle 42 and a second axle 43 such that one side of the lug chain 32 is capable of moving a container 12 from the entry port 16 to the exit port 17 of the apparatus 10.

Figure 4A:
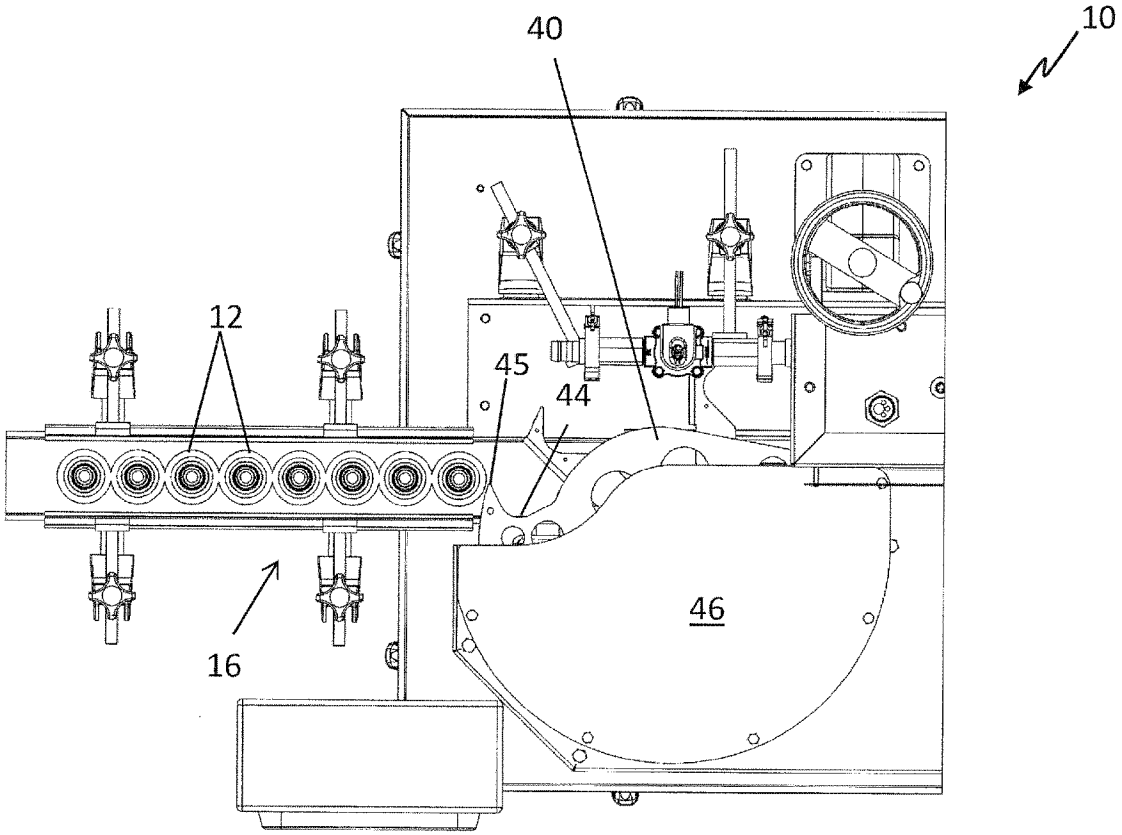
FIGS. 4A-4F are top-view illustrations of the gate, conveyer apparatus having the lug chain, and containers, in accordance with the first exemplary embodiment of the present disclosure.
Figure 4B:
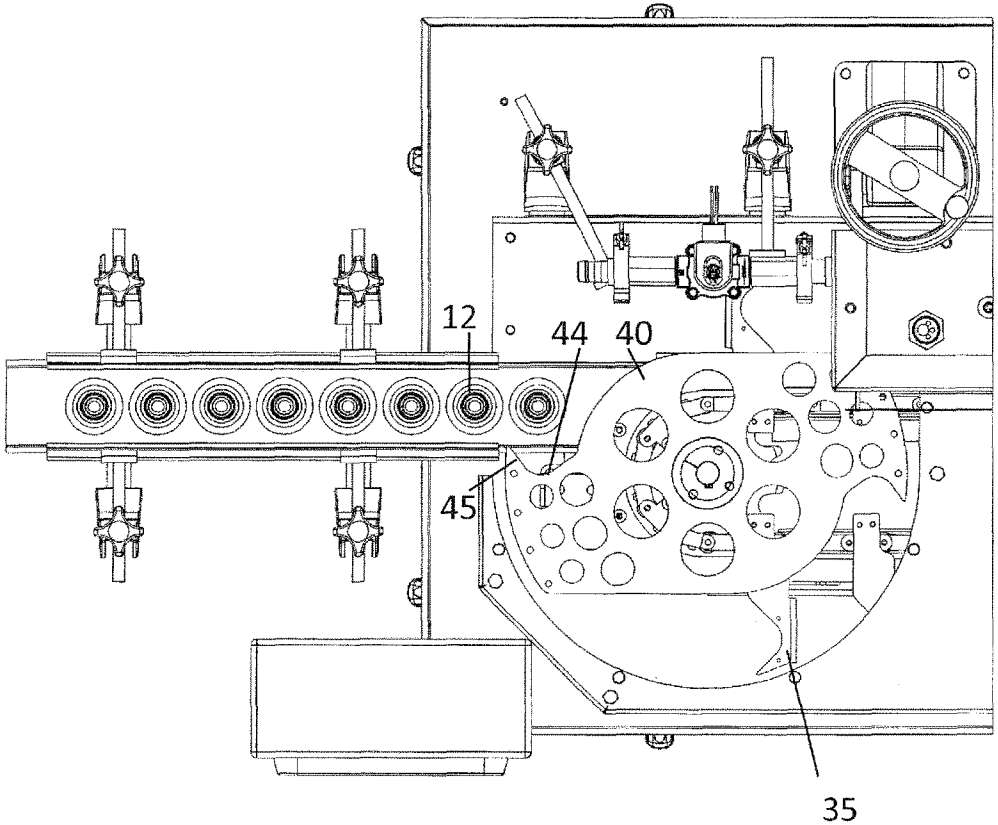
Figure 4C:
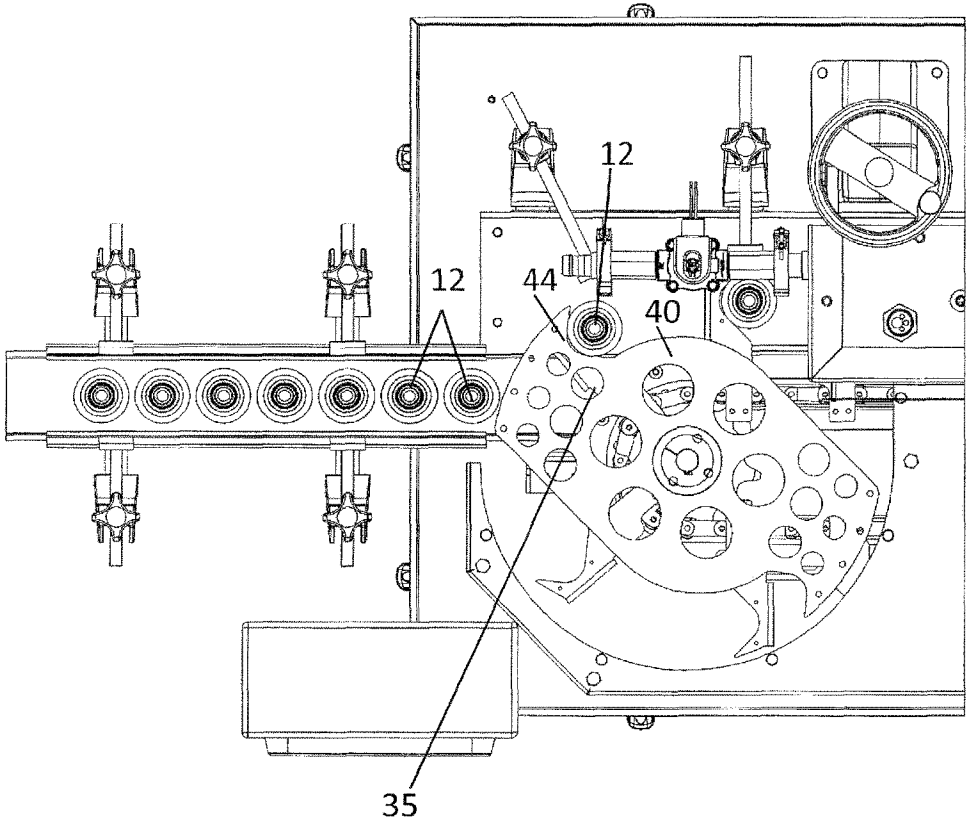
Figure 4D:
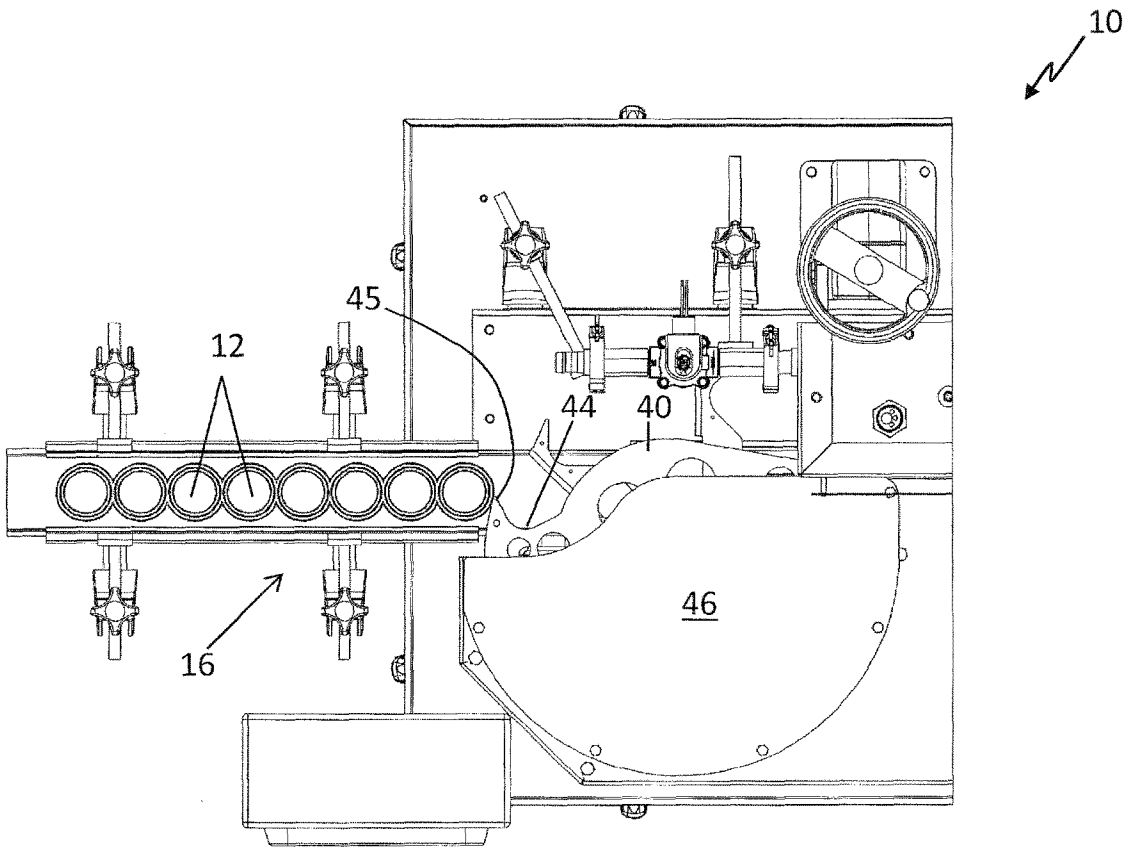
Figure 4E:
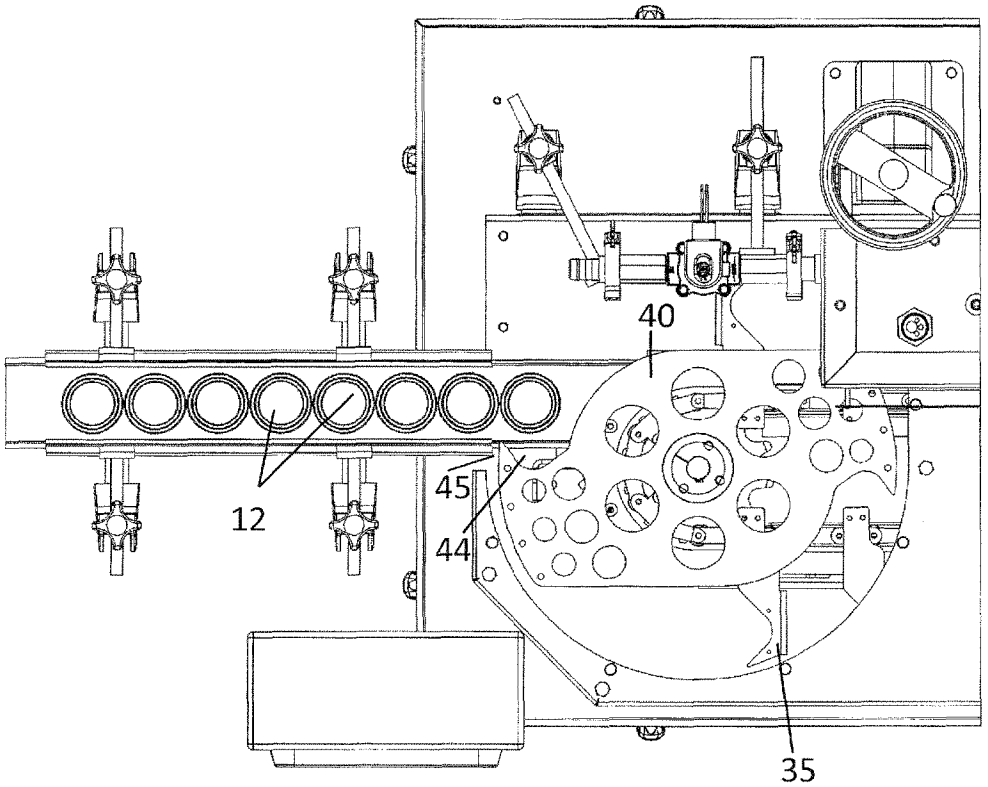
Figure 4F:
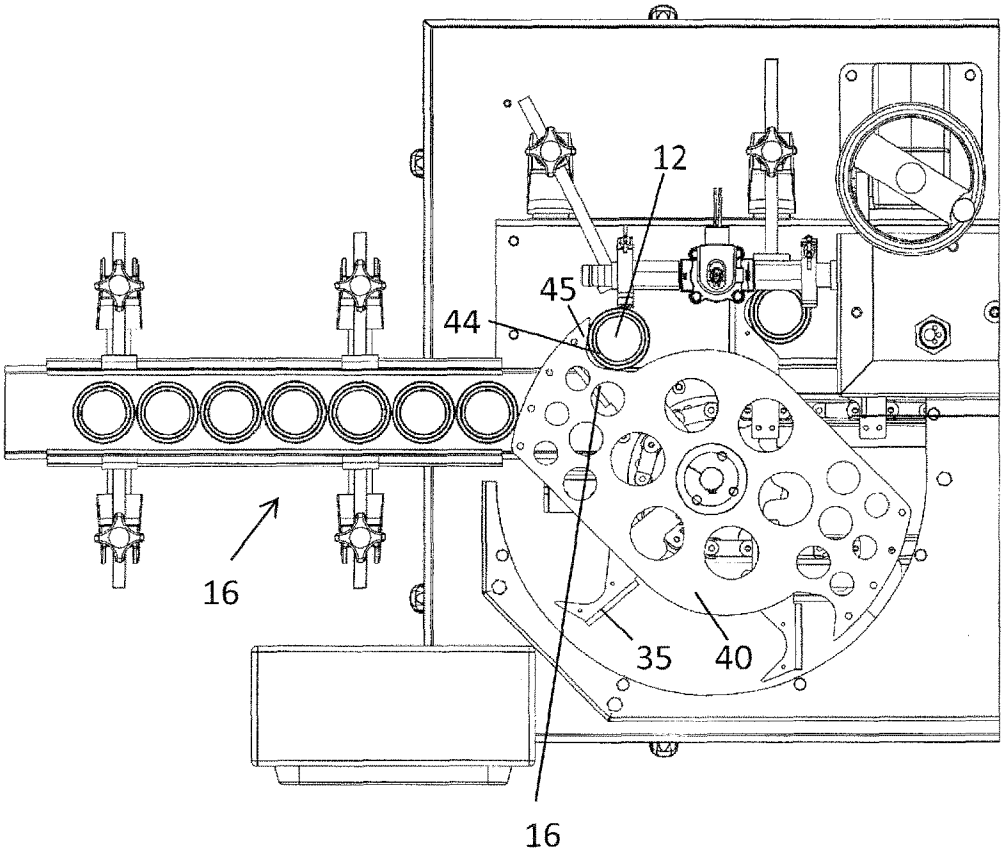

FIGS. 4A-4F are top-view illustrations of the gate 40, conveyer apparatus having the lug chain, and containers 12, in accordance with the first exemplary embodiment of the present disclosure. Specifically, FIGS. 4A-4C illustrate the container loading motion of the gate 40 and lug chain 32 with bottle containers 12 and FIGS. 4D-4F illustrate the container loading motion of the gate 40 and lug chain 32 with can containers 12. With either cans or bottle containers 12, the loading operation is the same. First, as shown in FIGS. 4A and 4D, the containers 12 are positioned on the belt at the container entry 16 of the apparatus. The tip 45 of the container entry port 44 of the gate 40 blocks the forward-most container 12 from moving into the motion path of the gate 40 or lug chain 32. FIGS. 4A and 4D illustrate the gate 40 with a cover 46, whereas FIGS. 4B-4C and 4E-4F illustrate the gate 40 without the cover 46.

Next, when a container 12 is to be loaded into the path of the lug chain 32, the gate 40 reverts counter-clockwise a slight radial degree until the tip 45 of the container loading port 44 is moved back far enough to allow a container 12 to proceed forward. At this step, a lug 35 of the lug chain 32 may be positioned substantially aligned with the container loading port 44 of the gate 40 (not visible). This process is shown in FIGS. 4B and 4E.

Then, as shown in FIGS. 4C and 4F, after a container 12 has moved forward into the path of the gate 40, the gate 40 moves a radial degree in the clockwise direction whereby the container 12 is carried within the container entry port 44. While this movement occurs, the edge of the gate 40 blocks the path of other containers 12. The container 12 that is positioned within the container entry port 44 is moved at a speed that may substantially match the speed of the lug chain 32 movement, such that the container 12 can effectively be captured by the lug 35 of the lug chain 32 and moved along the path of the lug chain 32.

The process described relative to FIGS. 4A-4F may repeat a number of times until a desired number of containers 12 are positioned within lugs 35 of the lug chain 32. Commonly, the number of containers 12 will match the number of filling heads. For example, six containers may be loaded with this process to be filled with six filling heads, and then the lug chain 32 and gate 40 may be programmed to skip a lug 35, thereby leaving an open lug 35 in the lug chain 32. This skipped lug 35 may provide a time delay, which allows the containers 12 to be processed after filling while at the same time allowing new containers to be loaded.

In one of many alternatives, it is noted that the use of the gate 40 that is rotatable about the axle 42 can be replaced with a gate that moves vertically to removably intersect the path of the containers. For example, this type of gate may be a simple guillotine latching device which raises or moves to allow a container to pass to an open lug 35 of the lug chain 32 and then shuts to prevent other containers from passing through. This type of device or similar devices may be used as a substitute for the gate 40 described relative to FIGS. 4A-4F.

Figure 5A:
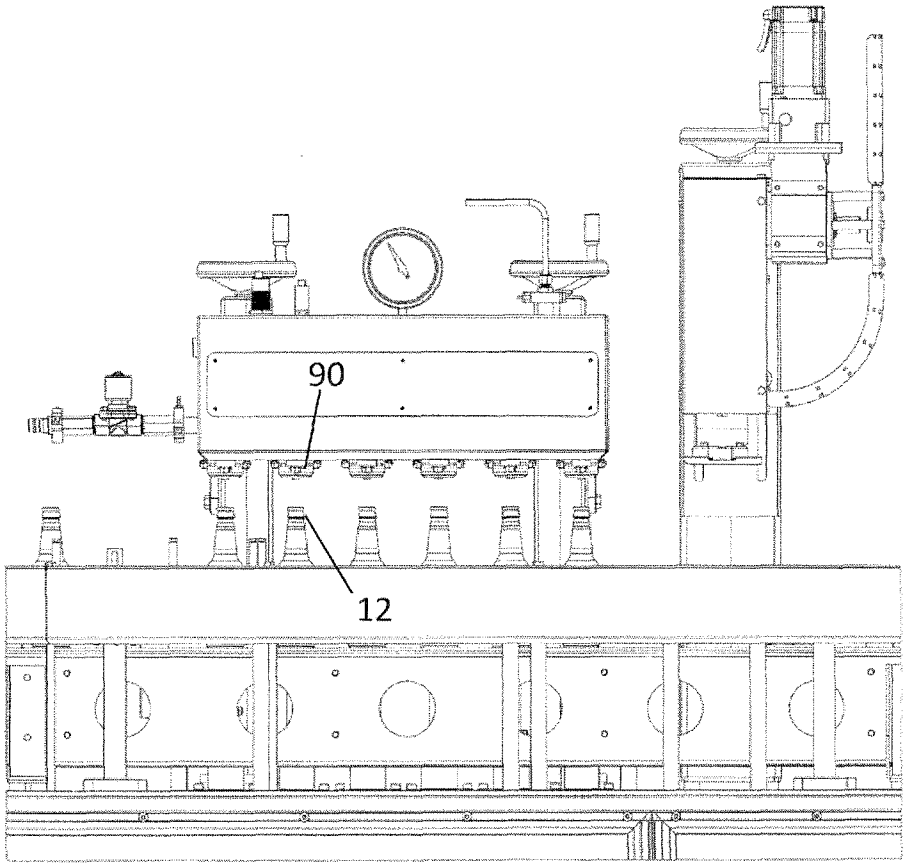
FIGS. 5A-5D are front view illustrations of the container filling process, in accordance with the first exemplary embodiment of the present disclosure.
Figure 5B:
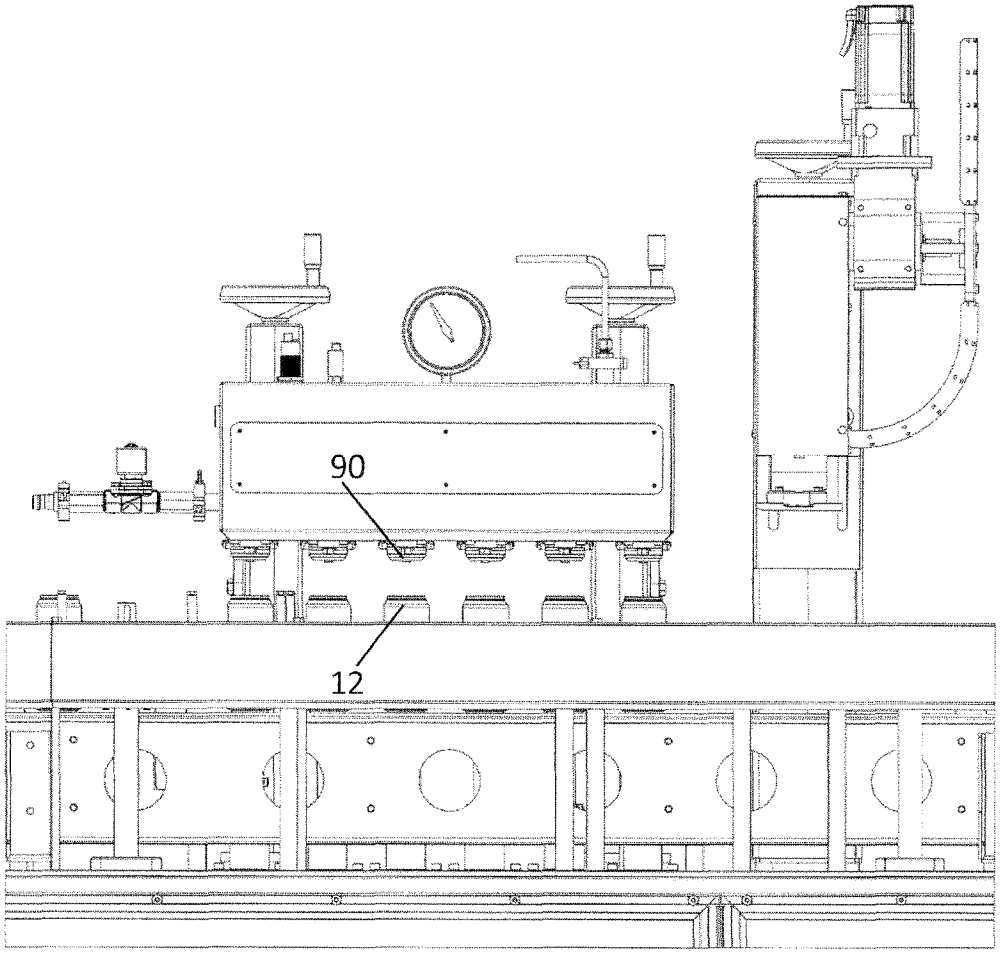
Figure 5C:
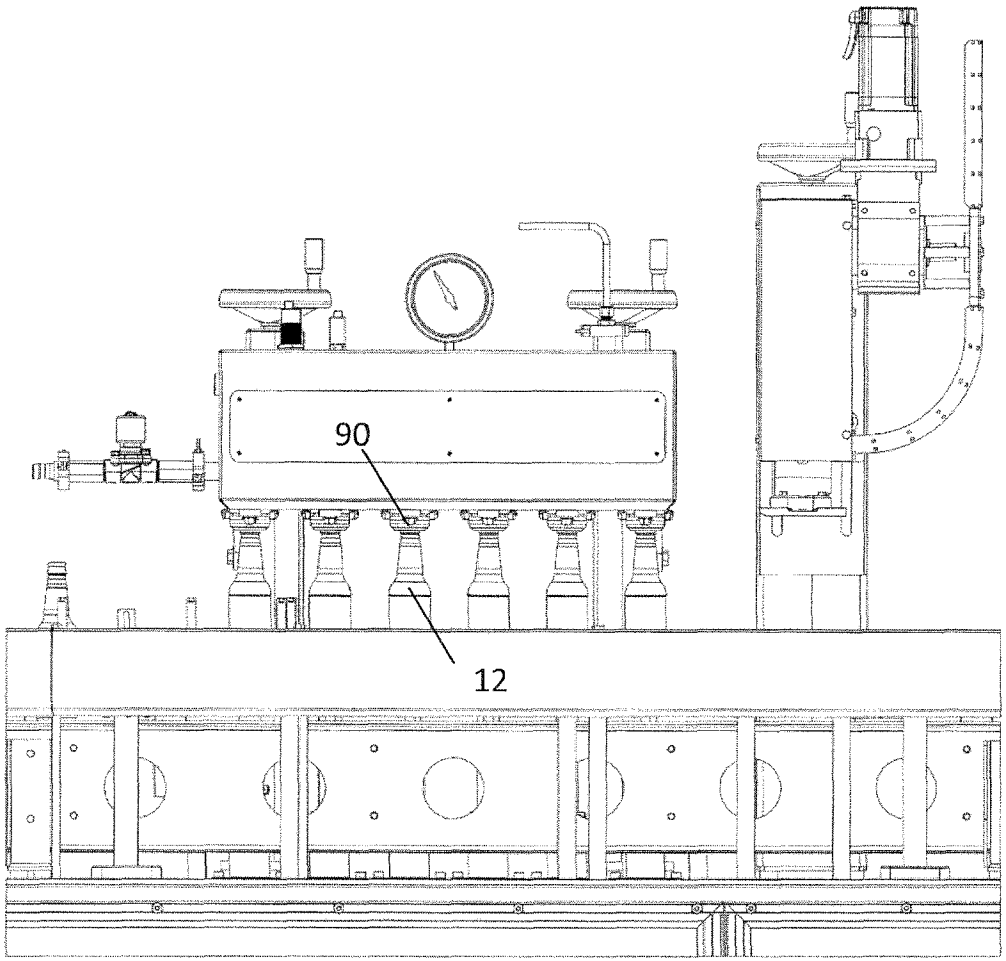
Figure 5D:
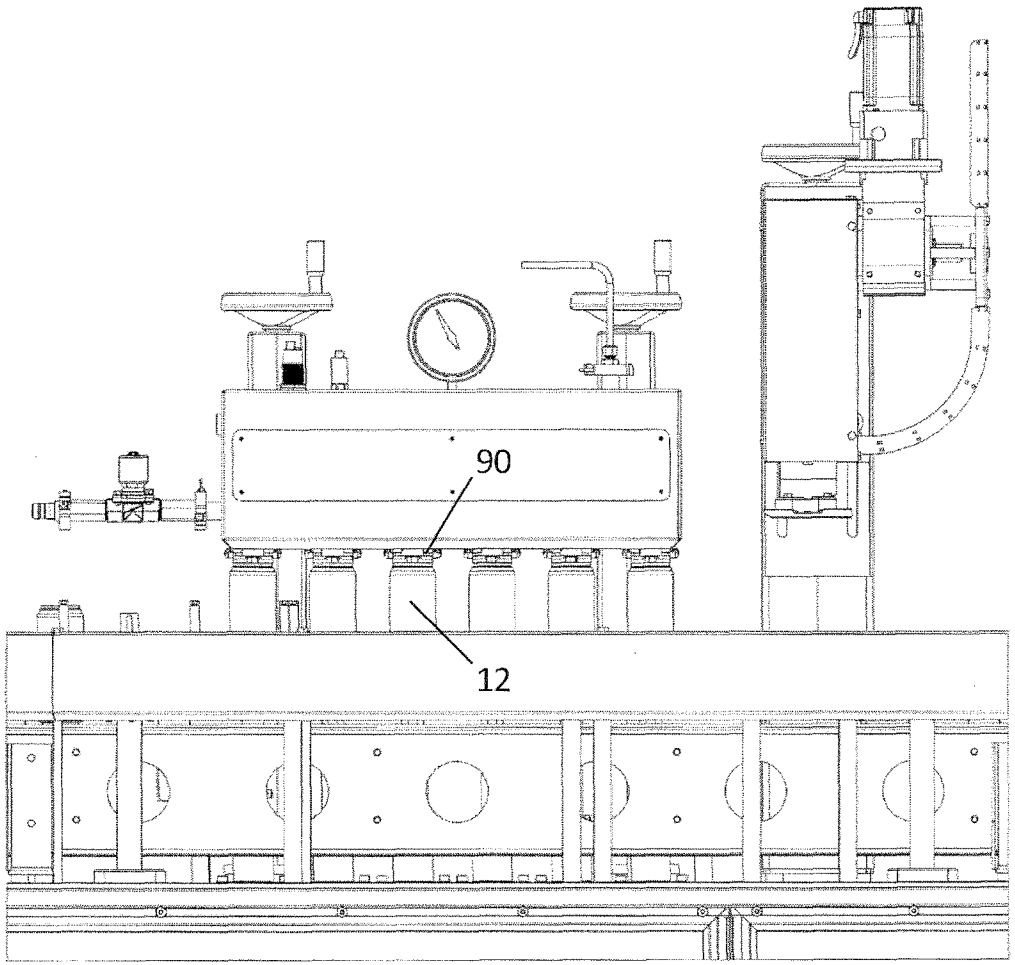

FIGS. 5A-5D are front illustrations of the container filling process, in accordance with the first exemplary embodiment of the present disclosure. FIGS. 5A and 5C illustrate the container filling process with bottle containers 12, whereas FIGS. 5B and 5D illustrate the container filling process with can containers 12. As shown, when the containers 12 are moved to the appropriate location underneath the filling nozzles 90 (FIGS. 5A and 5B), this position may be that of a pre-fill and post-fill position. In FIGS. 5C and 5D, the containers 12 have been raised with the smart lift system to make contact between the top of the container 12 and the filling nozzle 90, at which point gas and liquid may be dispensed into the container 12. After the containers 12 are filled, they may be lowered with the smart lift system to the post-fill position (FIGS. 5A, 5B), and then moved laterally with the conveyer system 30 to capping and/or sealing.

Figure 6C:
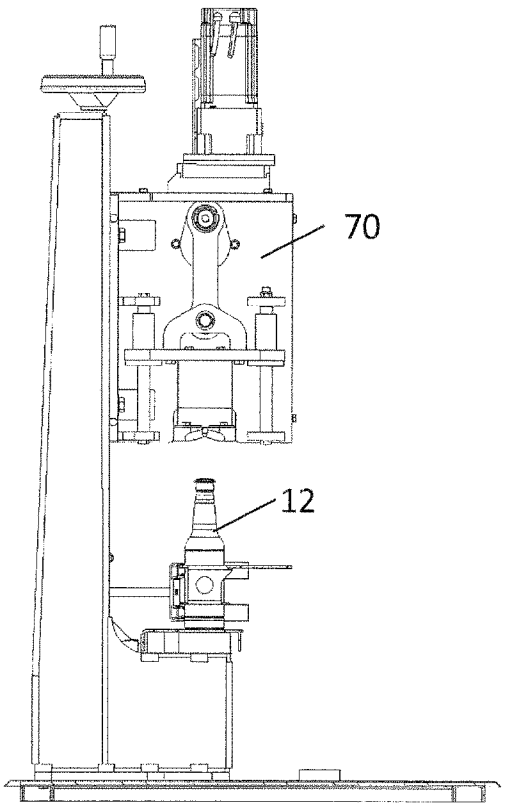
FIGS. 6A-6C are side-view illustrations of the container covering process, in accordance with the first exemplary embodiment of the present disclosure.
Figure 6B:
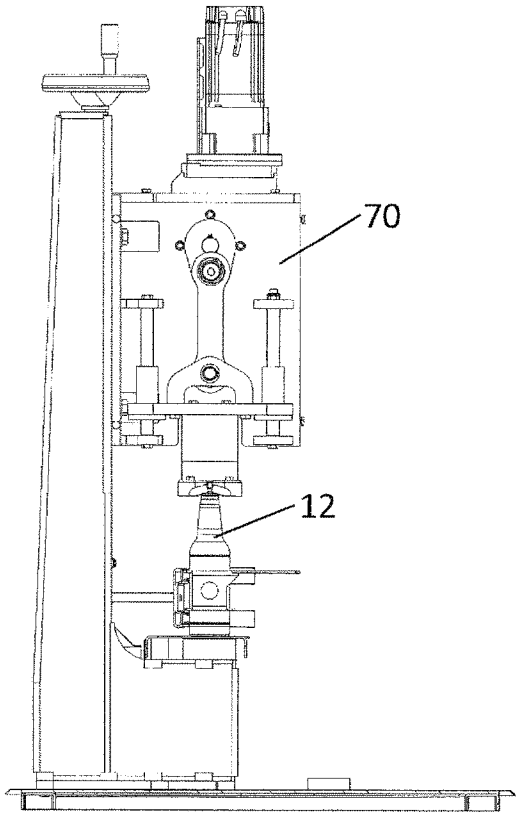
Figure 6A:
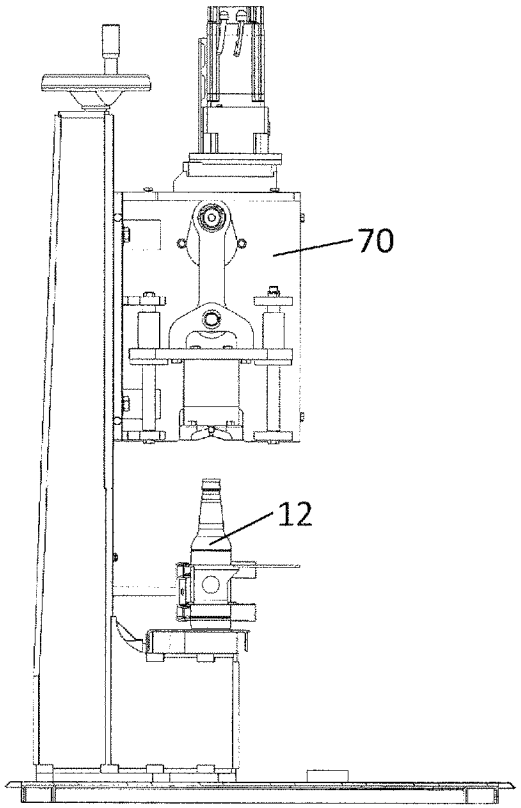

FIGS. 6A-6C are side-view illustrations of the container covering process, in accordance with the first exemplary embodiment of the present disclosure. As shown, the container 12 may be positioned underneath a covering apparatus 70 which places a cover on the container 12 after filling, such that the container 12 is in a pre-strike position, as shown in FIG. 6A. The covering apparatus 70 may vary depending on the type of container—for instance, bottles may use crowners whereas aluminum cans may use a sealer. When a crowner is used, the crowner may use a plurality of mechanical linkages to lower a striking head carrying a blank cap. When the crowning head contacts the top of the container 12, as shown in FIG. 6B, the cap may be positioned thereon and immediately compressed from two or more lateral directions, thereby manipulating the edges of the cap around the lip on the top of the container 12. Then, as shown in FIG. 6C, the crowning head may retreat to allow the container 12 to move along the apparatus 10.

Figure 7C:
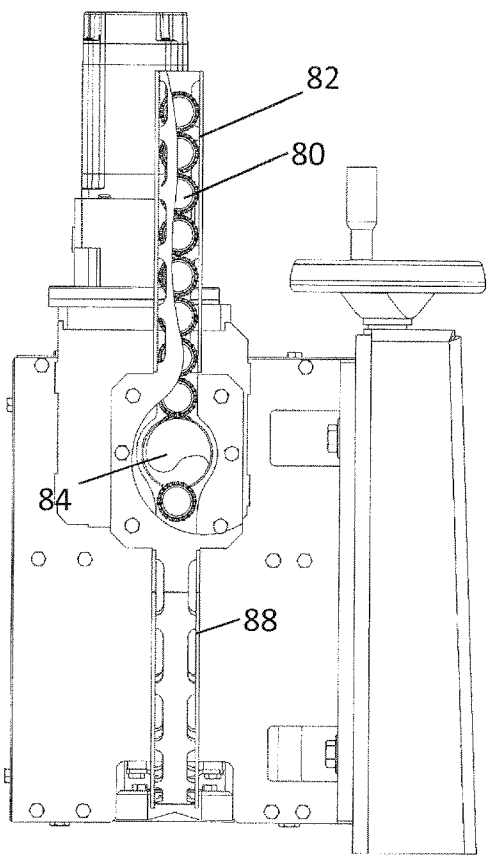
FIGS. 7A-7C are side-view illustrations of the cap-dispensing process, in accordance with the first exemplary embodiment of the present disclosure.
Figure 7B:
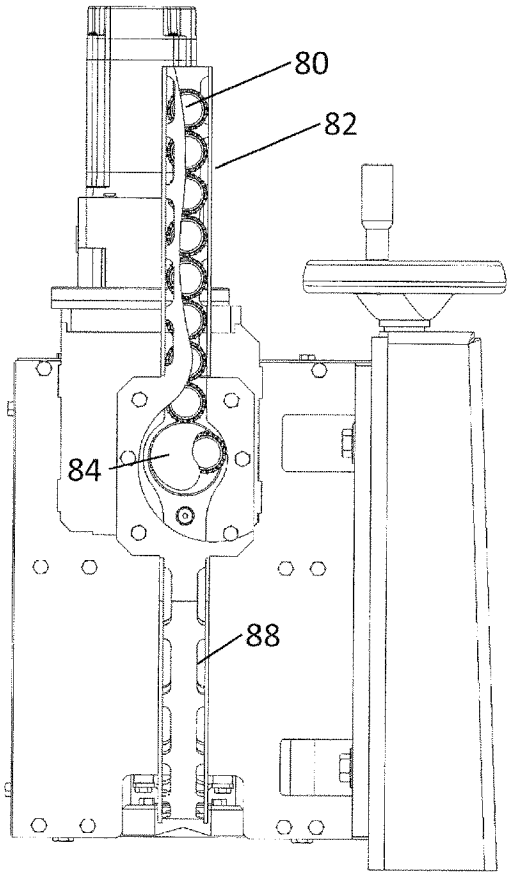
Figure 7A:
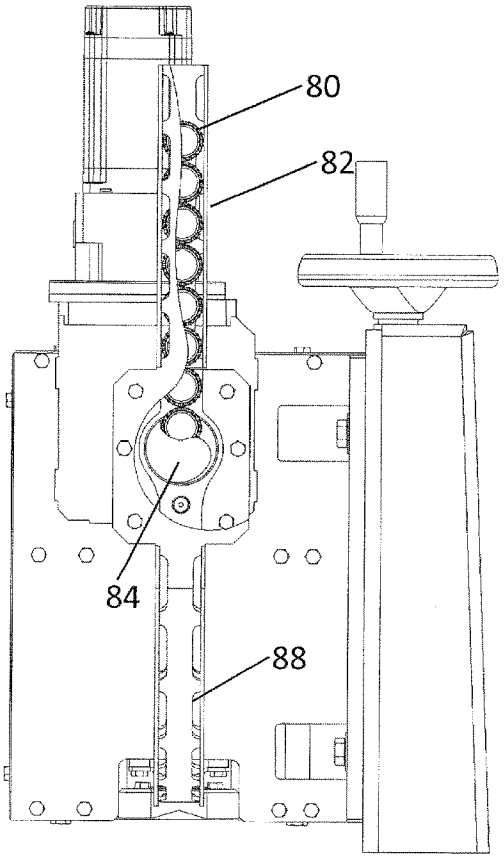
Figure 7D:
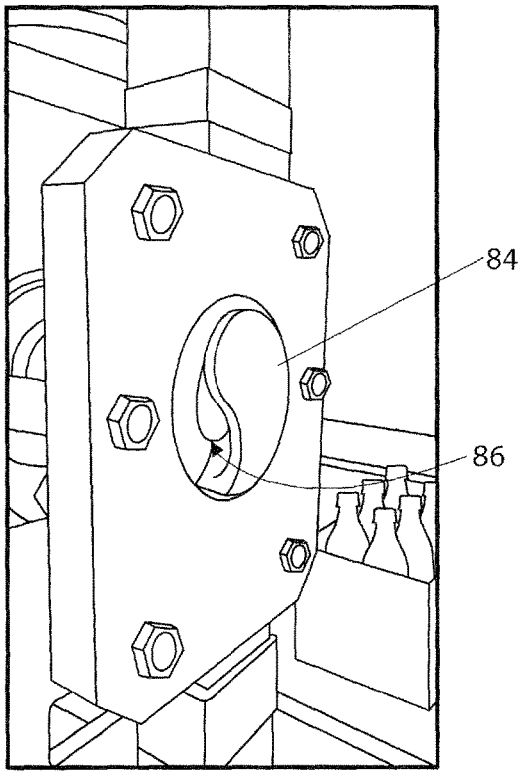
FIG. 7D is a photo of a cap dispensing mechanism, in accordance with the first exemplary embodiment of the present disclosure.

FIGS. 7A-7C are side-view illustrations of the cap-dispensing process, in accordance with the first exemplary embodiment of the present disclosure. FIG. 7D is a photo of a cap dispensing mechanism, in accordance with the first exemplary embodiment of the present disclosure. Relative to FIGS. 7A-7D, the caps 80 may be lowered within a guide 82 to a cap dispensing cam 84 which has an opening 86 to select on cap 80, as shown in FIGS. 7A and 7D. After the cap 80 is in the opening 86, the dispensing cam 84 rotates to transfer that one cap 80 to a dropping guide 88 which leads to the crowning device, as shown in FIGS. 7B-7C. The dispensing cam 84 has a "yin-yang" like shape with a small inner pocket that allows for the selection of a single cap 80 and not a plurality of caps upon a single rotation.

Figure 8A:
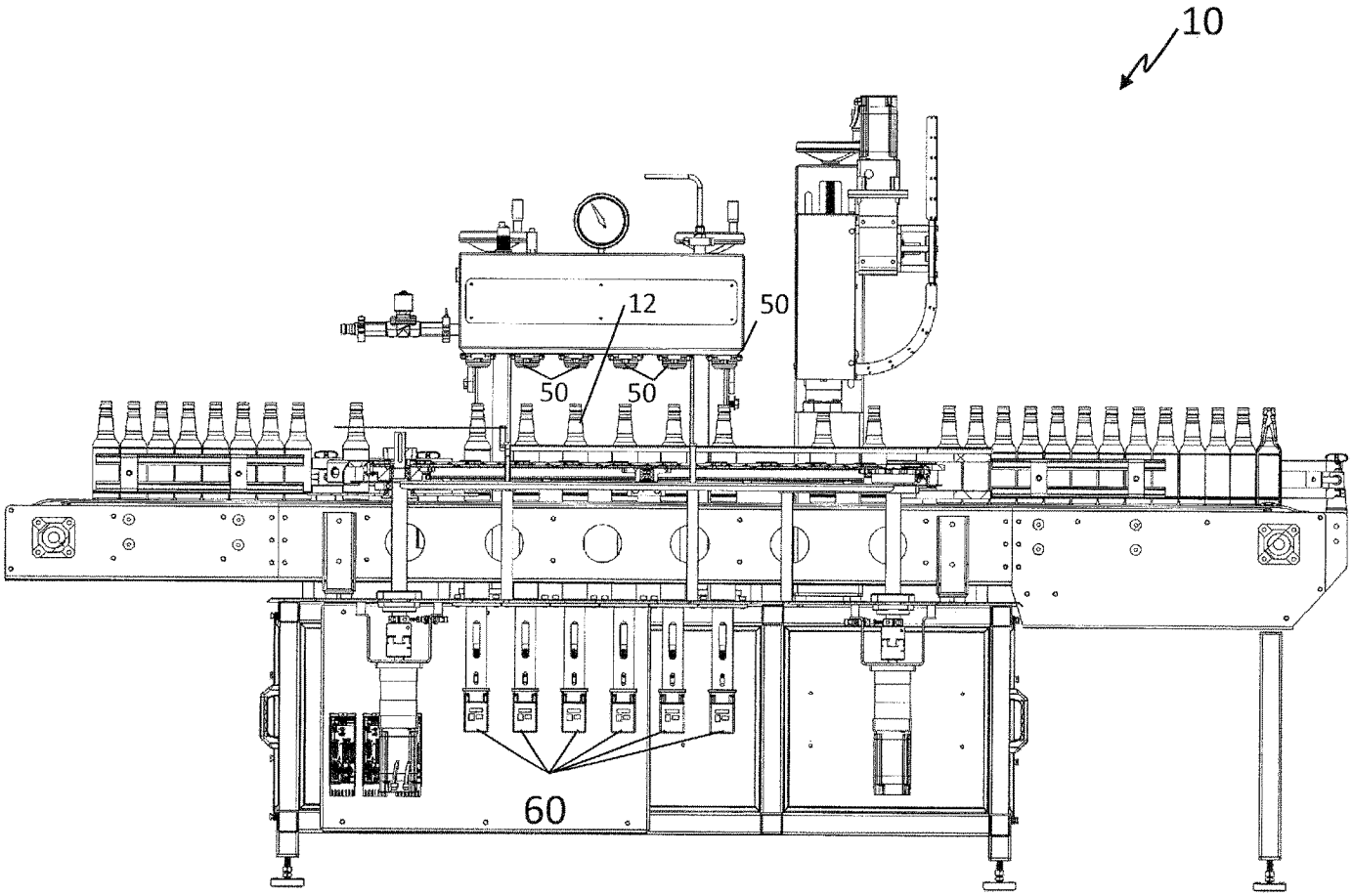
FIG. 8A is a side-view illustration of the apparatus showing the smart lift devices, in accordance with the first exemplary embodiment of the present disclosure.
Figure 8D:
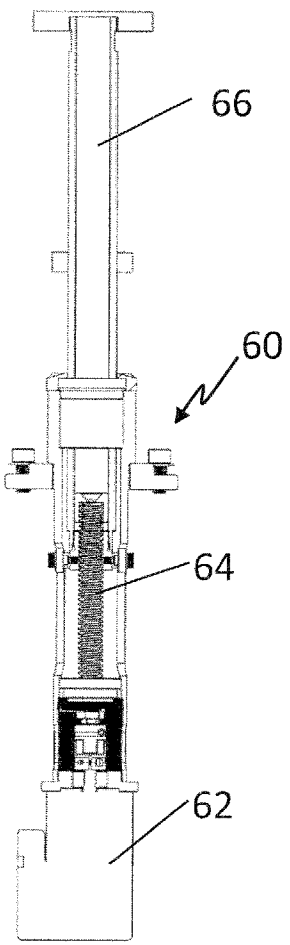
FIGS. 8B-8D are illustrations showing the smart lift devices, in accordance with the first exemplary embodiment of the present disclosure.
Figure 8C:
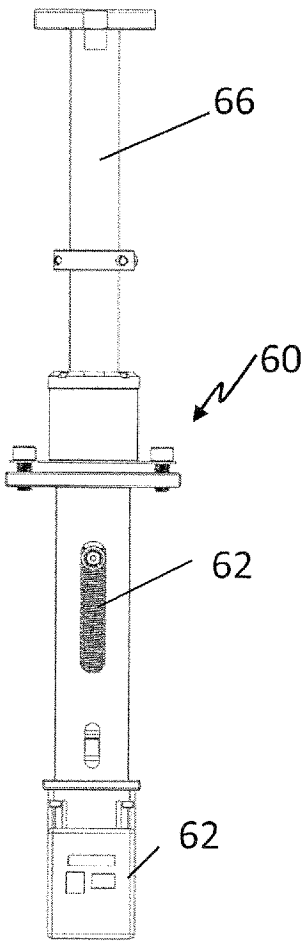
Figure 8B:
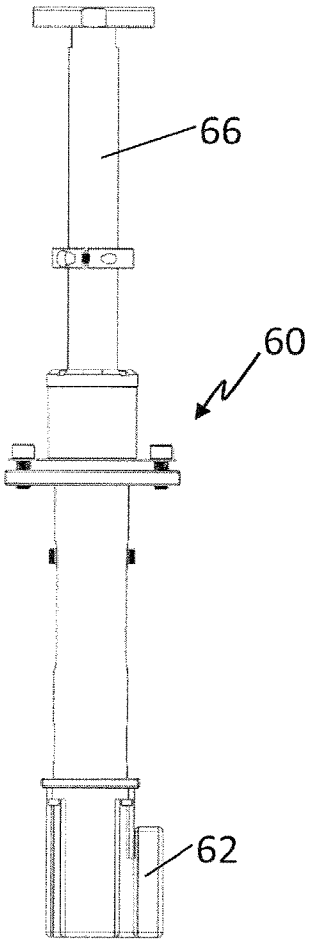

FIG. 8A is a side-view illustration of the apparatus 10 showing the smart lift devices 60, in accordance with the first exemplary embodiment of the present disclosure. FIGS. 8B-8D are illustrations showing the smart lift devices 60, in accordance with the first exemplary embodiment of the present disclosure. As can be seen, each of the smart lift devices 60 may be positioned in the apparatus 10 substantially underneath a position of the fill head 50. The smart lift devices 60 may be generally comprised of a motor 62 which actuates a rotatable shaft 64 to raise and lower a lift cylinder 66 which contacts the container 12. The motors 62, which may be servo motors or the like, may be computer controlled and have a variety of sensing functions, such that they can sense when a container is positioned over a lift cylinder 66, when the container contacts the filling nozzle 90, if a container breaks or becomes damages, as well as other aspects of the filling process. To this end, in addition to the description of the smart lift devices 60 in the previously-identified co-pending provisional application, the smart lift devices 60 may be programmed to prevent inadvertent filling accidents with the apparatus 10 based on a detected load. For example, when there is no container 12 in place above the lift cylinder 66, the lift cylinder 66 will retract because there was no load detected. In this situation, the lift cylinder 66 would be in communication with the filling head corresponding to that particular lift cylinder 66 to instruct it not to start the filling cycle for that lift cylinder 66. Similarly, if there was a container in place about the lift cylinder 66 and it broke during the filling cycle, the lift cylinder 66 may sense the break and communicate with the filling head to stop the flow of the liquid. In this situation, the lift cylinder 66 may sense the break in the container due to the fact that the lift cylinder 66 would start to move after breaking of the container. When this occurs, the current draw on the motor of the smart lift device 60 would decrease. By sensing this decrease on the current draw, the valve and filling nozzle 90 can be controlled to stop the flow of liquid. It is noted that the use of the sensed current draw on the motor of the smart lift device 60 may be used as a sensor for filling the containers in other aspects not explicitly discussed herein, all of which are considered within the scope of the present disclosure.

Figure 9B:
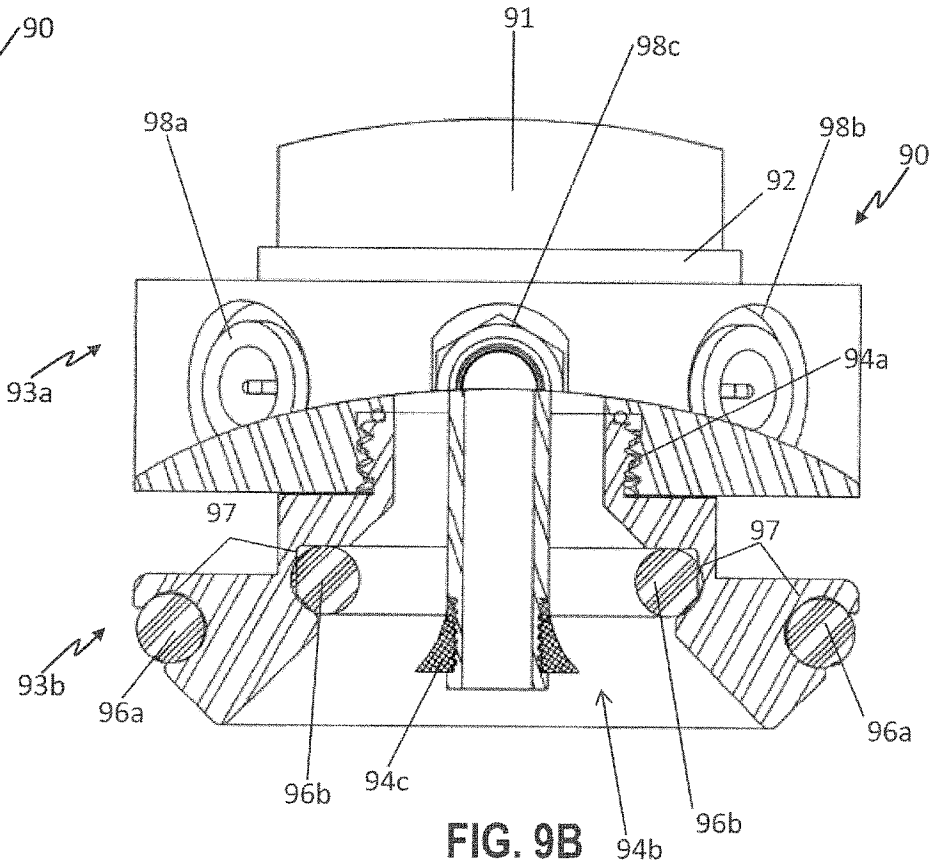
FIG. 9B is a cross-sectional side view illustration of a multi-container filling nozzle, in accordance with the first exemplary embodiment of the present disclosure.
Figure 9A:
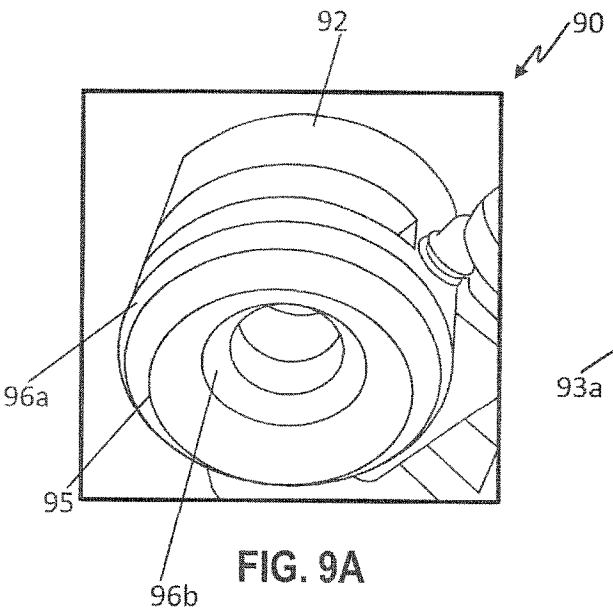
FIG. 9A is an image of a multi-container filling nozzle, in accordance with the first exemplary embodiment of the present disclosure.
Figure 9D:
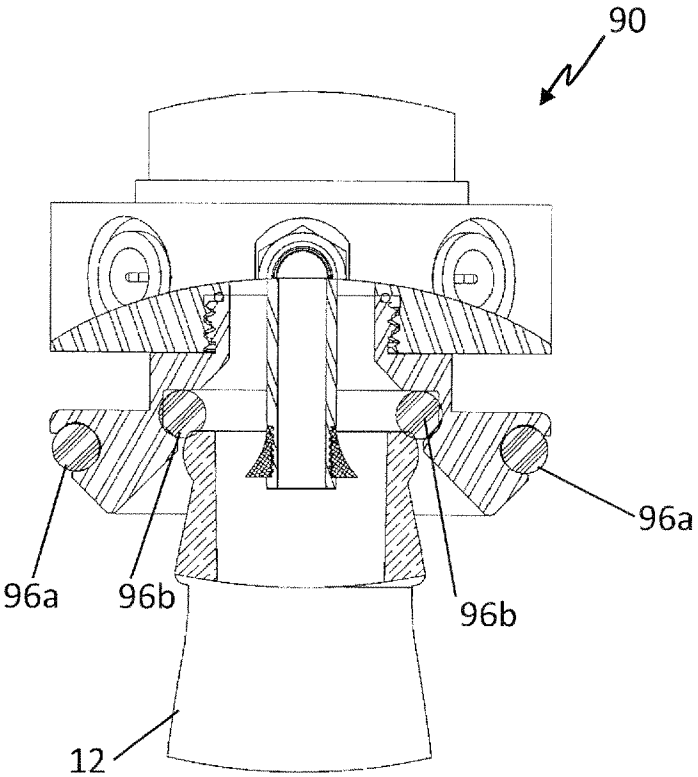
FIGS. 9C and 9D are partial cross-sectional side view illustrations of a multi-container filling nozzle in use with a container, in accordance with the first exemplary embodiment of the present disclosure.
Figure 9C:
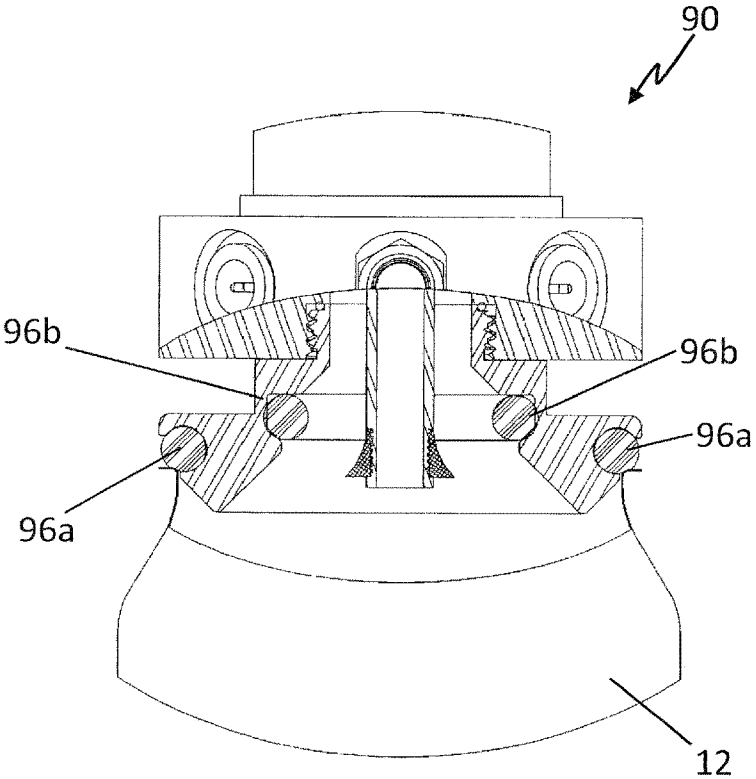

FIG. 9A is an image of a multi-container filling nozzle 90, in accordance with the first exemplary embodiment of the present disclosure. FIG. 9B is an enlarged, partial cross-sectional image of a multi-container filling nozzle 90, in accordance with the first exemplary embodiment of the present disclosure. FIGS. 9C and 9D are partial cross-sectional side view illustrations of a multi-container filling nozzle 90 in use with a container 12, in accordance with the first exemplary embodiment of the present disclosure. In conventional filling machines, the filling nozzle, i.e., the structure that contacts the container to be filled, must be changed to match each container type. For example, a different filling nozzle is needed with glass bottles than with aluminum cans. The need for matching the filling nozzle to the container is to ensure that there is a tight seal between the filling nozzle and the container, which ensures appropriate positive and/or negative pressures are achievable such that the fluid can be dispensed into the container as efficiently as possible. However, changing out the filling nozzle for each individual type of container is a time-consuming, inefficient, and costly process, since down-time in a conventional filling machine equates to lost production. To overcome this problem, the apparatus 10 may use a multi-container filling nozzle 90 which can be used successfully with containers that each have differently-sized openings.

Figure 10:
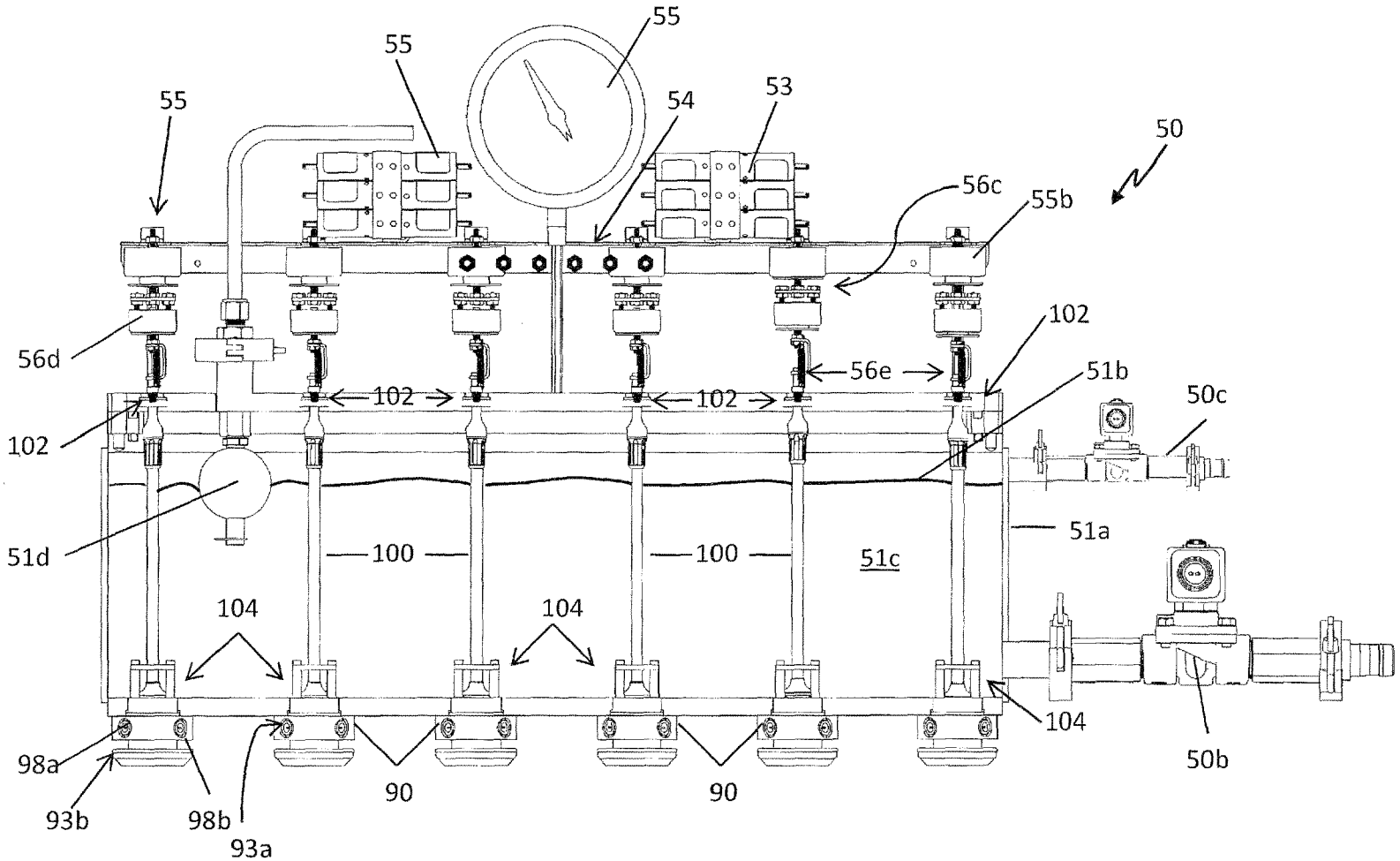
FIG. 10 is a cross-sectional illustration of a multi-container filling nozzle in use on a filling head, in accordance with the first exemplary embodiment of the present disclosure.

As shown in FIGS. 9A-9B, the multi-container filling nozzle 90 includes a cylindrical body with a connector 91 at one end which connects to the filling head 50 (as shown in FIG. 10.), or to a valve interconnected with the filling head 50. A seal 92 may be positioned proximate to the connector 91 to ensure that fluid held within the filling head 50 does not leak from around the connector 91. In some designs, the connector 91 may be threaded, or another connection design may be used.

The multi-container filling nozzle 90 may generally include an upper head 93*a* and a lower head 93*b*, where the connector 91 is connected to the upper head 93*a*. The upper and lower heads 93*a*, 93*b* may be engagable together with a threaded connection 94*a* positioned on an inner fluid path 94*b* through the nozzle 90. During a filling process, a container may be positioned in contact with the lower head 93*b*, as described in detail below, and the fluid to be dispensed into the container may flow through the inner fluid path 94*b* and into the container. A laminar flow nozzle 94*c* may be positioned within the inner fluid path 94*b* to direct the fluid in a streamlined, low-disruption path as it enters the container. The laminar flow nozzle 94*c* may typically be positioned concentric of the inner fluid path 94*b* and it may have a height position which is changeable relative to the upper and lower heads 93*a*, 93*b*.

The lower head 93*b* may have a lower point 95 which may server as a guide for making contact with an opening of a container. The lower point 95 may have angled sides which direct the nozzle 90 to the correct position on the container, as discussed further relative to FIGS. 9C-9D. The nozzle 90 has at least two gaskets 96*a*, 96*b* which may be used to make a sealing contact with an opening of the container. As shown in FIG. 9B, one of the gaskets 96*a* may be positioned exterior or outwards of the lower point 95 which another of the gaskets 96*b* may be positioned inwards of the lower point 95. Each of the gaskets 96*a*, 96*b* may be ring gaskets such as AS568 sealing O-rings, but other types of gaskets having different shapes and designs may also be used. For example, gaskets with a non-circular cross section may be used in some designs. The gaskets 96*a*, 96*b* may each be retained within a pocket 97 formed in the lower head 93*b*, such that each of the gaskets 96*a*, 96*b* can be retained in place during a filling operation yet the gaskets 96*a*, 96*b* can be removed as needed, such as if one were to become damaged.

The upper head 93*a* may include various features for effecting a proper fill of the fluid in the container. Specifically, the upper head 93*a* may include a vacuum valve connection 98*a*, a snift/vent valve connection 98*b*, and a gas and fluid valve activation solenoid connection 98*c*, the functions and uses of which are further described relative to FIGS. 27-28.

Relative to FIGS. 9C-9D, the inner gasket 96*b* may be used to seal to the opening of a narrowed-opening container, such as a glass beer bottle, wine bottle, or similar structure. As is shown in FIG. 9D, the rim of the narrowed-opening container 12 may be positioned interior of the lower point 95 of the nozzle 90 and in contact with the inner gasket 96*b*. The laminar flow nozzle 94*c* may be positioned partially below the upper lip of the rum of the narrow-opening container 12. The nozzle 90 in use with a wide-opening container 12 can be seen in FIG. 9C, where the container 12 may be a can, such as a soft drink or beer can. As shown, the rim of the top of the wide-opening container 12 may be positioned exterior or outwards of the lower point 95, with the rim contacting the gasket 96*a*. In this example, the lower point 95 of the nozzle 90 may extend partially into the container 12. It is noted that in either example, the container 12 may achieve a position where it can be sealed against one of the gaskets 96*a*, 96*b*, such that appropriate pressures in the container 12 can be achieved during a filling process.

In the multi-container filling nozzle 90, the outer gasket 96*a* may be substantially concentric with the inner gasket 96*b*. Each gasket 96*a*, 96*b* may be sized sufficiently to allow a slight compression of the gasket 96*a*, 96*b* as the container 12 is positioned in contact with it. Additionally, the gaskets 96*a*, 96*b* may be positioned at the same height along the multi-container filling nozzle 90 or at different heights. As shown in FIGS. 9C-9D, the inner gasket 96*b* may be positioned slightly higher than the outer gasket 96*a*.

It is further noted that the nozzle 90 may include additional gaskets than the two shown in FIGS. 9A-9D. For instance, the nozzle 90 may have three or more gaskets positioned at various locations on the lower head 93*b* where each gasket is design to connect to a container with a specific opening size.

FIG. 10 is a cross-sectional illustration of a multi-container filling nozzle 90 in use on a filling head 50, in accordance with the first exemplary embodiment of the present disclosure. As can be seen, the filling head 50 includes a fluid holding area 51*a* contained by the sidewalls and base of the filling head 50, wherein the fluid holding area 51*a* has a quantity of fluid 51*c* therein with a top surface 51*b*. Fluid 51*c* may be supplied to the fluid holding area 51*a* with a fluid intake valve 50*b*. Within the fluid holding area 51*a* but above the top surface 51*b* of the fluid 51*c* is a gas area which is supplied with a quantity of gas through a gas intake valve 50*c*. Above the top of the filling head 50 are various mechanical components used during a filling operation. They include a gas bank or manifold 52 and a vacuum bank or manifold 53 which control the pressures within the container during a filing operation, control connectors 54, and a pressure display gauge 55 showing the pressure within the fluid holding area 51*a*.

The filling head 50 is depicted with six nozzles 90 positioned below a bottom wall of the filling head 50. A valve 100 is connected to each of the nozzles 90 and extends through the fluid holding area 51*a* and through a top ceiling of the filling head 50. The filing head 50 includes a fluid opening adjustment 56*a*, a fluid solenoid/gas override 56*b*, a gas opening adjustment 56*c*, a gas solenoid 56*d*, and a gas and fluid closing spring 56*c* for each valve 100. It is noted that the fluid solenoid 56*b* and the gas solenoid 56*d* may be contained in a housing to prevent contamination, such as during a wash-down process. The housing may be a cylindrical container with a clevis on each end. Along the bottom of the filling head 50, the nozzles 90 are connected to the dispensing end of the valves 100, As shown, each nozzle 90 includes the upper head 93*a* and a lower head 93*b*, where the upper head 93*a* has the vacuum valve connection 98*a* a shift/vent valve connection 98*b*, and the lower head 93*b* has the gaskets for sealing against a container opening. The valves 100 may operate to supply the container with the fluid from the fluid holding area 51*a* through the fluid valve portion 104 of each valve 100 and supply the container with the necessary pressures and gases to ensure a successful fill through a gas valve portion 102 of the valve 100.

In one example, the operation of the filling head 50 with valves 100, and nozzles 90 may start with the fluid valve portion 104 and the gas valve portion 102 closed. The gas valve bank 52 is connected to a vacuum pump (not shown). After a container is raised to make contact with one of the nozzles 90 and makes contact with the seal on the nozzle 90, one of the gas valves within the gas valve bank 52 is opened (six are depicted in the figure to correspond to the six nozzles 90), which pulls the vacuum valve connection 98*a* port. This function evacuates all of the ambient air out of the container and usually occurs within a few milliseconds. Then, the opened gas valve within the bank 52 is closed. Then, gas solenoid 56*d* is energized, which opens the gas valve portion 102 in the gas layer on top of the fluid level 51*b* and allows gas to flow into the container through valve 100. The gas valve portion 102 may be opened for a few milliseconds and then closed. This cycle is then repeated, such that another vacuum is applied to the container and new gas is supplied to the container. It is noted that the vacuum can be applied with both bottle and can containers. Conventionally, can containers, such as aluminum cans, have not had a vacuum applied to them due to their likelihood of deforming or collapsing under the negative pressure. The subject disclosure, however, applies a vacuum of approximately −2 PSI to the can containers for approximately 0.1 seconds without experiencing can container deformation or collapse. Other times and pressures of applying a vacuum to the can container may also be achieved, all of which are considered within the scope of the present disclosure.

After the second vacuum is applied to the container, and gas solenoid 56*d* is opened, it may remain energized to allow the gas to pressurize the container to the same level as the gas within the filling head 50. Then, fluid solenoid 56*b* is energized which opens the fluid valve portion 104 and allows fluid from the quantity of fluid 51*c* to enter the container. Once the container is filled with the appropriate quantity of fluid, both the gas solenoid 56*d* and the fluid solenoid 56*b* are closed. Then, a Snift process occurs using the snift/vent valve connection 98*b* on the nozzle 90 and the vacuum bank 53 to vent the container to an atmospheric pressure before the container is lowered off the nozzle 90. Additional descriptions of the functioning of the subject disclosure are also provided relative to FIGS. 19-32.

As is well-recognized in the container-filling industry, a number of different types of filling valves can be used with various filling machines. Most of these valves are purely mechanical devices that operate based on the principles of fluid dynamics. However, many of these filling valves have shortcomings and drawbacks, such as inaccuracies with filling, the inability to react to changed conditions such as broken containers, and the inability to function with different container types. To overcome these shortcomings, an electromechanical filling valve is disclosed. FIGS. 9-32 describe different designs of the electromechanical filling valve and the various details, components, functions, and intricacies that are related to it.

Figure 11A:
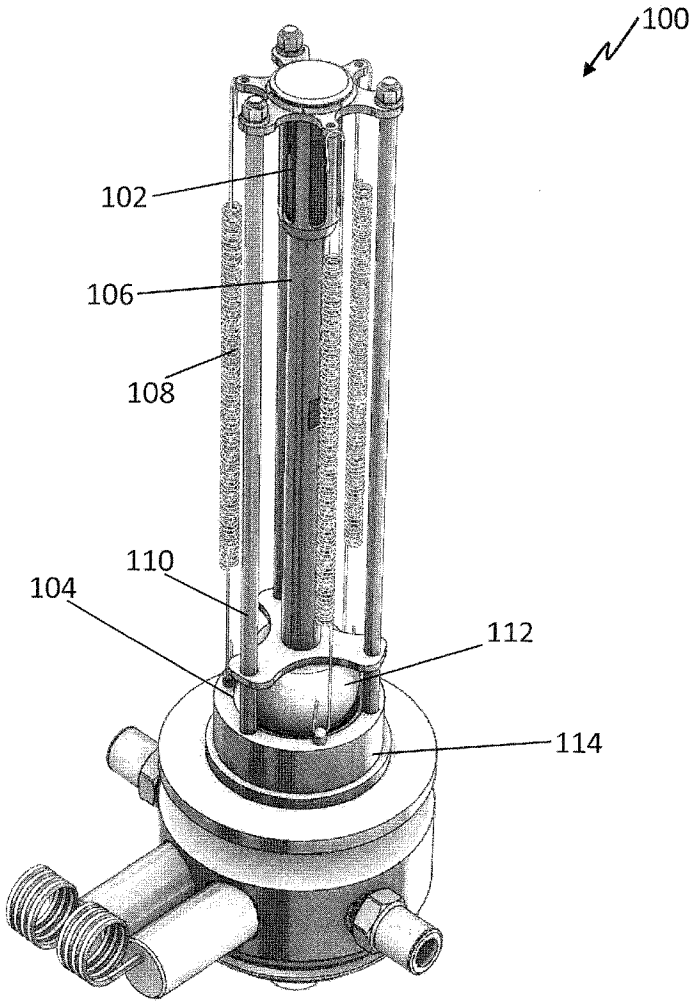
FIG. 11A is a detailed illustration of the electromechanical valve, in accordance with the first exemplary embodiment of the present disclosure.

A first type of valve 100 is illustrated in FIG. 11A, which is a detailed illustration of the electromechanical valve 100, in accordance with the first exemplary embodiment of the present disclosure. The valve 100 is designed to connect or mate to the top of a container to fill that container with liquid. The valve 100 may be used for not only filling the container with liquid, but also filling the container with gas or emptying the container of gas during the filling process. For example, the valve 100 may be used for a filling process that includes a gassing step, an evacuation step, a liquid filling step, and then a venting step. In detail, the valve 100 includes a central valve stem 106 which is connected to a gas valve portion 102 and a fluid valve portion 104. When the valve 100 is in use, the gas valve portion 102 may be positioned above a fluid level within a fluid holding area of the filling head, whereas the fluid valve portion 104 is positioned below the fluid level. The valve stem 102 may be centered between tension springs 108 and push rods 110, such as three of each, as shown. The tension springs 108 operate to keep the gas and fluid valve portions 102, 104 closed, whereas the push rods 110 are used to activate the gas and fluid valve portions 102, 104. The push rods 110 may be centered with a filling valve centering guide plate which is positioned above a filling ball valve 112. The filling ball valve 112 may contact the lower valve body 114 to prevent liquid from moving past the filling ball valve 112 and through the center orifice of the lower valve body 114. Positioned on the lower valve body 114 may be an E-vacuum connection port, a snift connection port, and E-vacuum and snift valve solenoids. These components may be used to control the valve 100 during a gassing step, an evacuation step, a liquid filling step, and then a venting step.

Figure 11C:
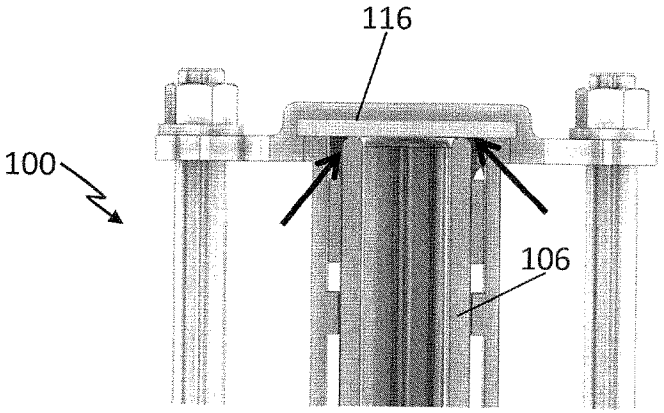
FIGS. 11B-11D are cross-sectional illustrations of the gas valve portion of the electromechanical valve, in accordance with the first exemplary embodiment of the present disclosure.
Figure 11D:
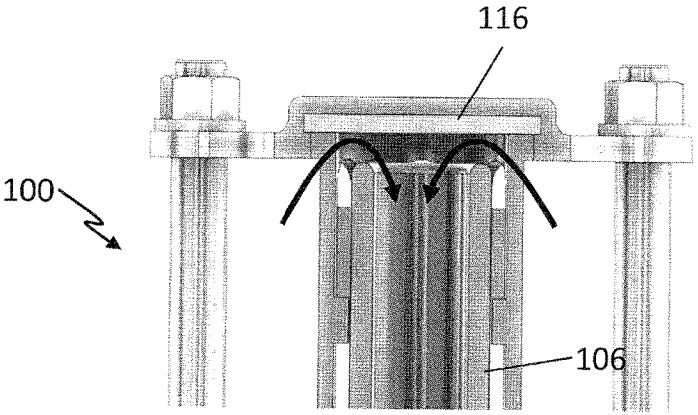
Figure 11B:
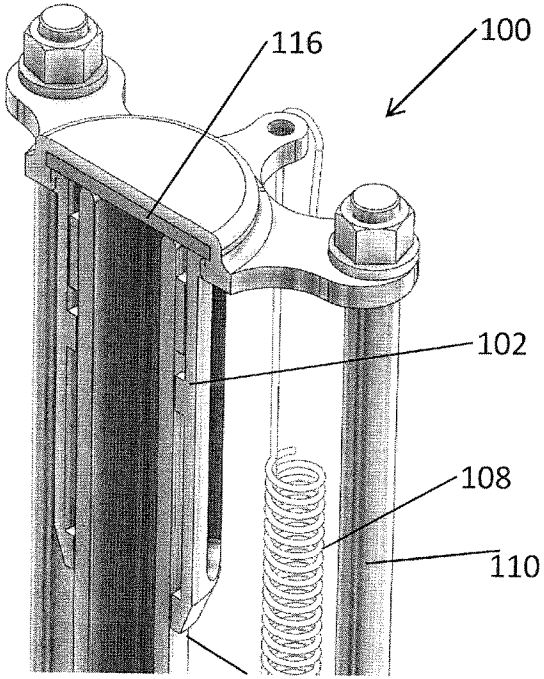

FIGS. 11B-11D are cross-sectional illustrations of the gas valve portion 102 of the electromechanical valve 100, in accordance with the first exemplary embodiment of the present disclosure. As shown, the gas valve portion 102 may utilize a rubber seal 116 which is engagable with a top of the valve stem 106. When the push rods 110 are moved upwards, the top of the valve 100 is raised to move the rubber seal 116 away from the top of the valve stem 106, thereby allowing the passage of gas into the interior of the valve stem 106 and ultimately into the container. This positioning is shown in FIG. 11D. In contrast, when the push rods 110 are moved downwards, the top of the valve 100 is lowered to contact the rubber seal 116 and prevent the flow of gas, as is shown in FIGS. 11B-11C.

Figure 12B:
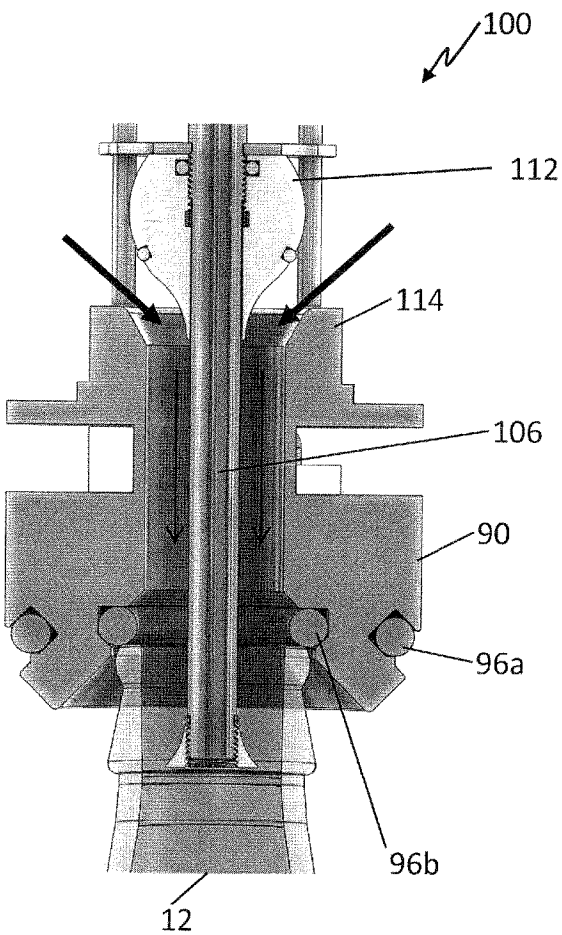
FIGS. 12A-12B are cross-sectional detailed illustrations of the fluid valve portion of the electromechanical valve, in accordance with the first exemplary embodiment of the present disclosure.
Figure 12A:
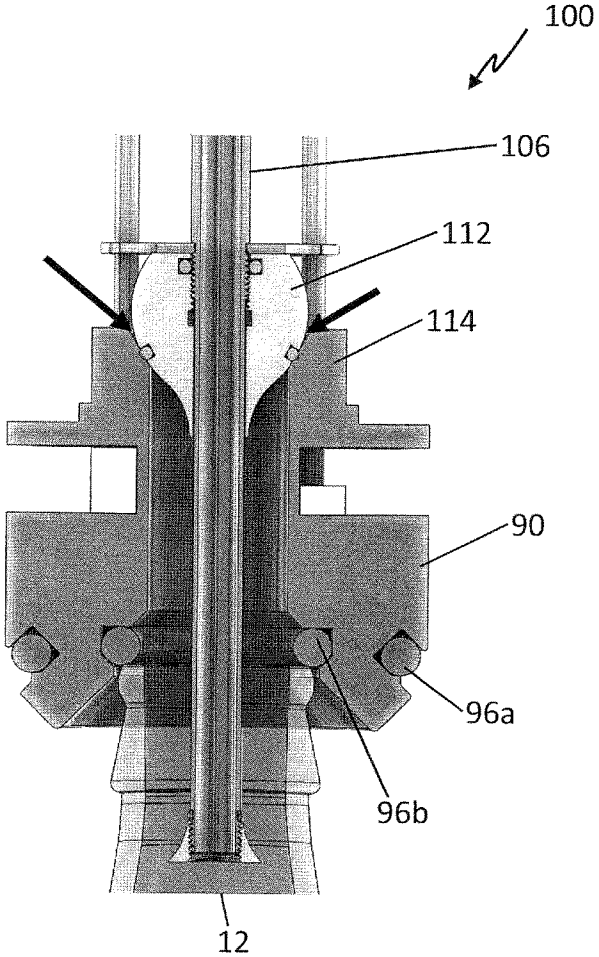

FIGS. 12A-12B are cross-sectional detailed illustrations of the fluid valve portion 104 of the electromechanical valve 100, in accordance with the first exemplary embodiment of the present disclosure. The fluid valve portion 104 may operate based on the eventual equilibrium of gas pressure between the interior of the container and the fluid atmosphere in which the fluid valve portion 104 resides. For example, after the container has been filled with gas to purge out atmospheric gas having oxygen, the pressure within the container may act to raise the ball valve 112 from the lower valve body 114. FIG. 12A depicts the ball valve 112 in the closed position, whereas the FIG. 12B depicts the ball valve 112 in the open position after gas equilibrium has been reached. When this occurs, fluid within the fluid tank (in which the fluid valve portion 104 is located) is moved between the ball valve 112 and the lower valve body 114, and is allowed to move through the multi-container filling nozzle 90 and into the container 12. The gaskets 96*a*, 96*b* are used to create a seal between the valve 100 and the container 12.

Figure 13:
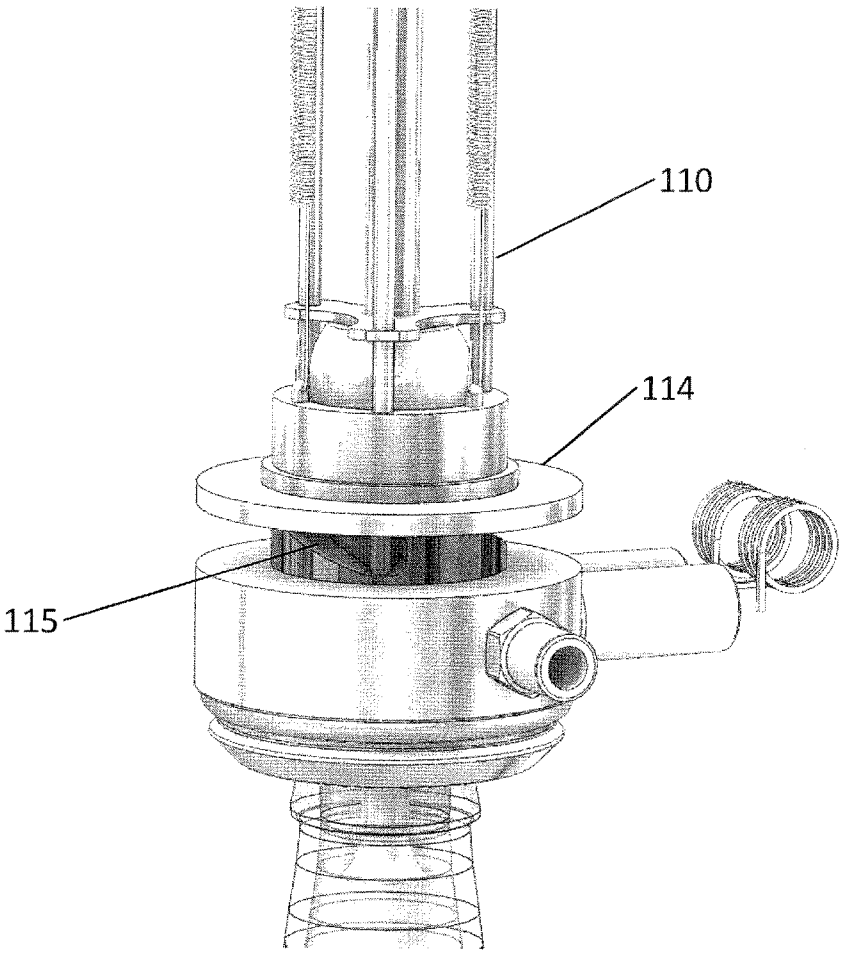
FIG. 13 is an illustration of a rotating cam plate in use with the electromechanical valve, in accordance with the first exemplary embodiment of the present disclosure.
Figure 14:
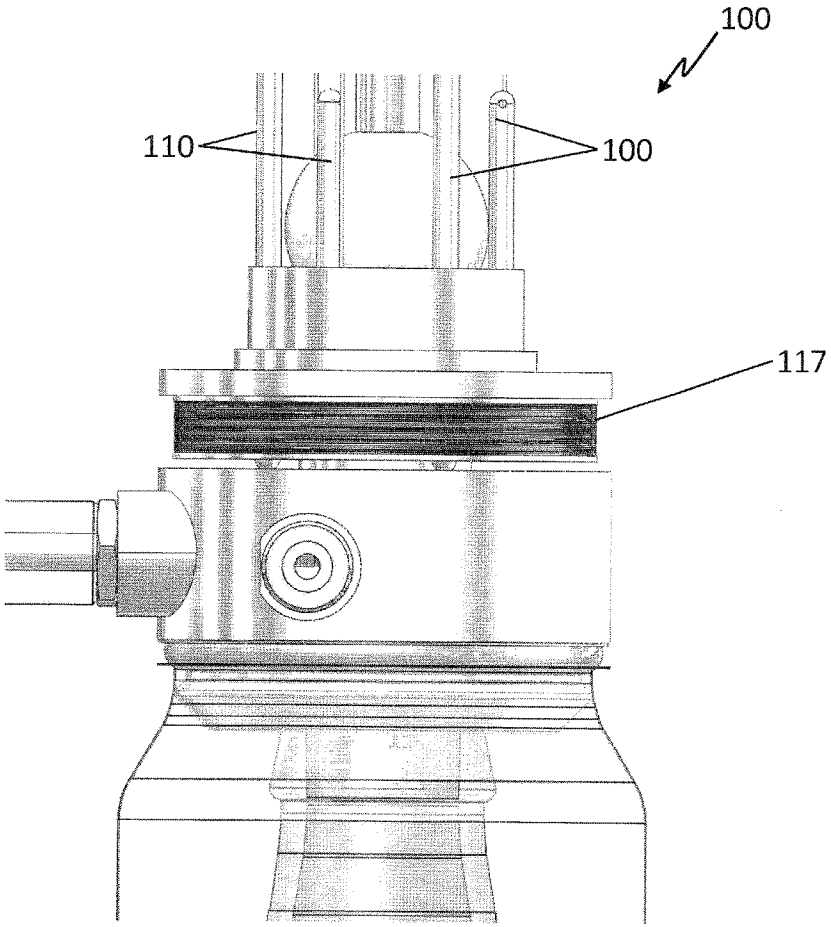
FIG. 14 is a detailed image of a linear voice coil motor in use with the electromechanical valve, in accordance with the first exemplary embodiment of the present disclosure.

The movement to activate the gas portion 102 of the valve 100 may be controlled in a variety of different ways. For example, FIG. 13 is an illustration of a rotating cam plate 115 in use with the electromechanical valve 100, in accordance with the first exemplary embodiment of the present disclosure. The rotating cam plate 115 may operate to raise the lower valve body 114, thereby moving the push rods 110. This movement is initiated by rotational movement within the multi-container filling nozzle 90 using a cam plate 115, where rotational movement of the cam plate translates into vertical movement, the movement of which may be electromagnetically controlled. In another example, FIG. 14 is a detailed image of a linear voice coil motor in use with the electromechanical valve 100, in accordance with the first exemplary embodiment of the present disclosure. The linear voice coil motor may operate to push the rods 110 upwards, thereby activating the gas valve portion and the fluid valve portion 104. Again, the linear voice coil motor may create vertical movement using electromagnetics.

Figure 15:
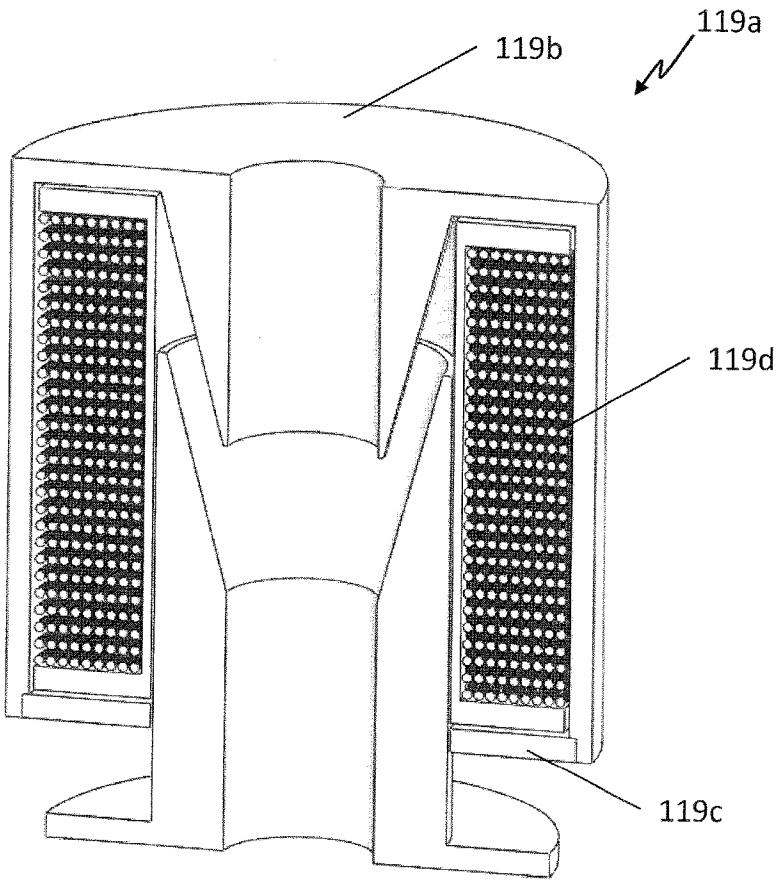
FIG. 15 is a cross-sectional image of a linear solenoid which can be used with the electromechanical valve, in accordance with the first exemplary embodiment of the present disclosure.

FIG. 15 is a cross-sectional image of a linear solenoid 119*a* which can be used with the electromechanical valve 100, in accordance with the first exemplary embodiment of the present disclosure. The linear solenoid 119*a* may be housed within a steel can 119*b* that has a bottom plate 119*c* that presses into the steel can 119*b*. When the coil 119*d* is activated with a current, a pathway through the solenoid may be created to allow for the flow of fluid. The conical face of the solenoid may allow for higher forces and longer strokes between energized and de-energized states of the linear solenoid.

Figure 16:
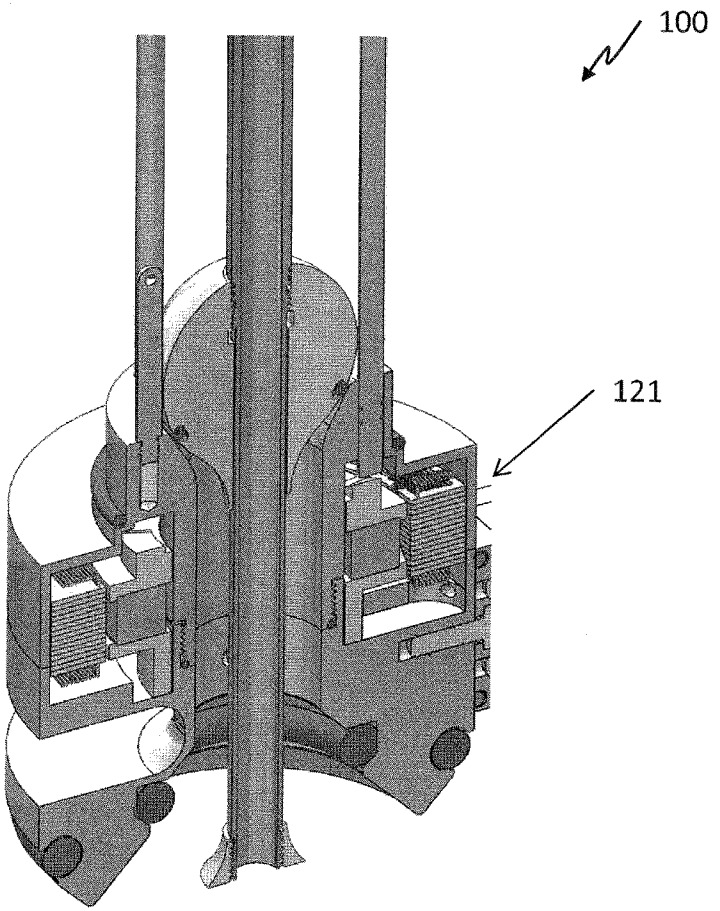
FIG. 16 is a cross-sectional image of a rotary motor actuator in use with a valve, in accordance with the first exemplary embodiment of the present disclosure.
Figure 17B:
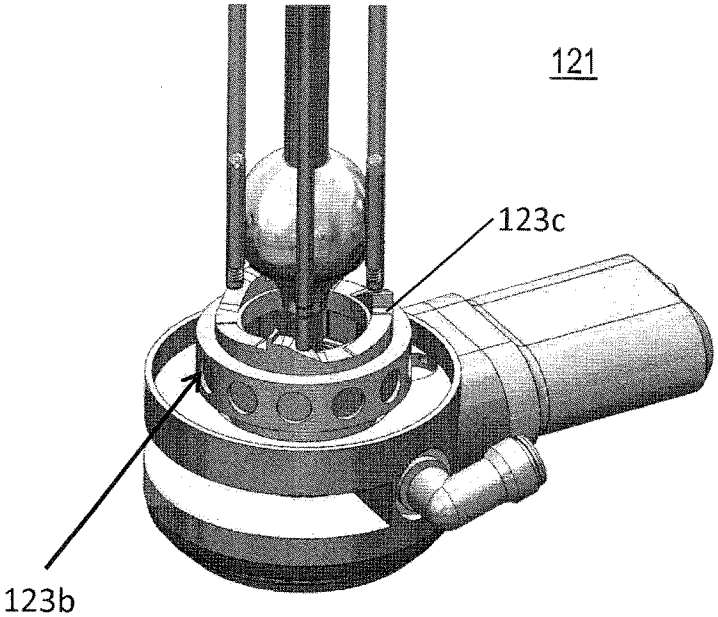
FIGS. 17A-17D are various images of the rotary motor actuator, in accordance with the first exemplary embodiment of the present disclosure.
Figure 17A:
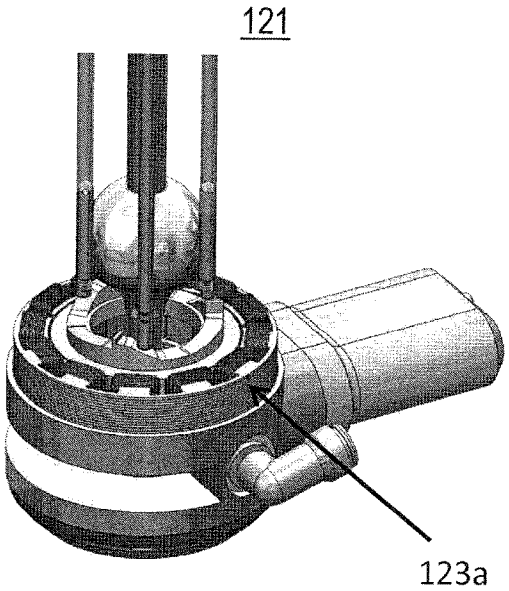
Figure 17D:
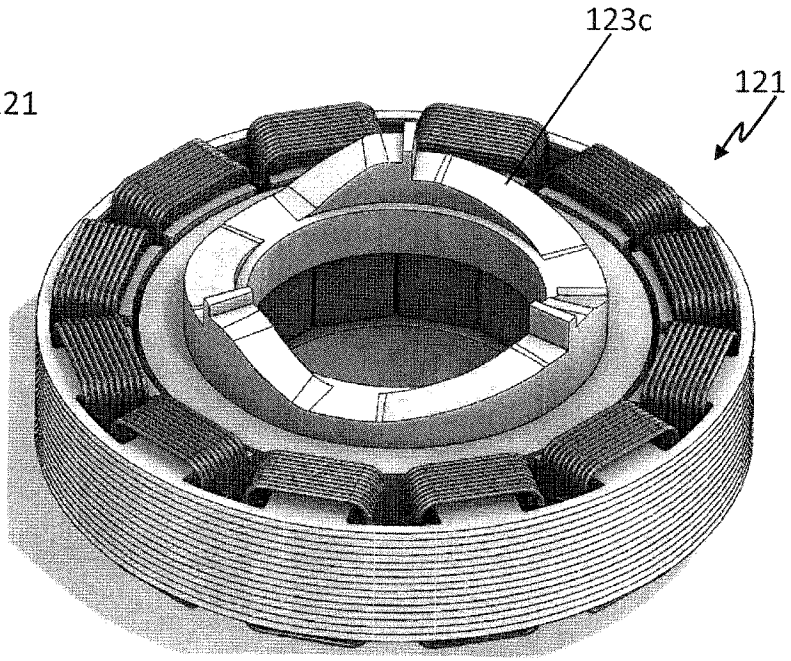
Figure 17C:
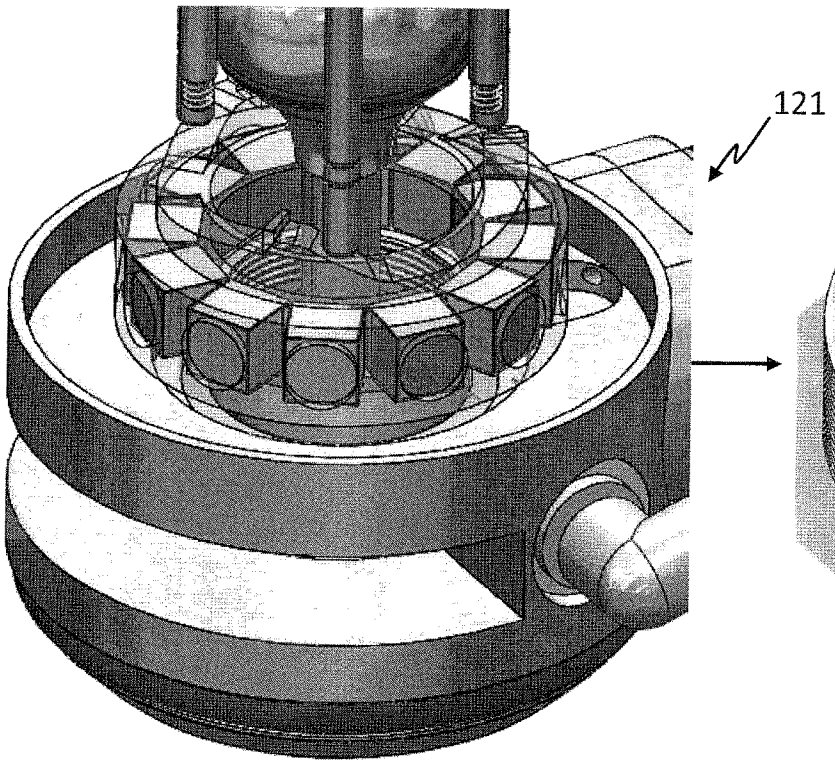
Figure 18B:
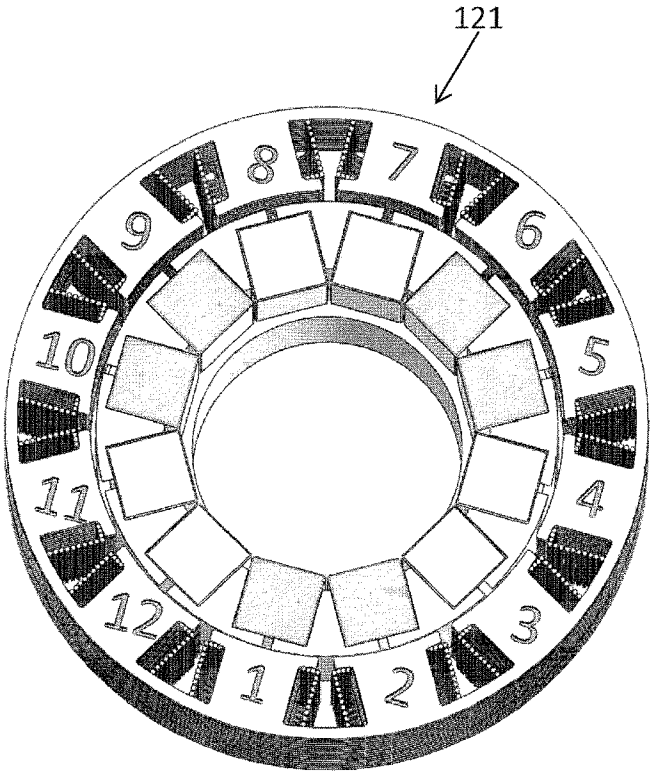
FIGS. 18A-18B are images switching concepts of the rotary motor actuator, in accordance with the first exemplary embodiment of the present disclosure.
Figure 18A:
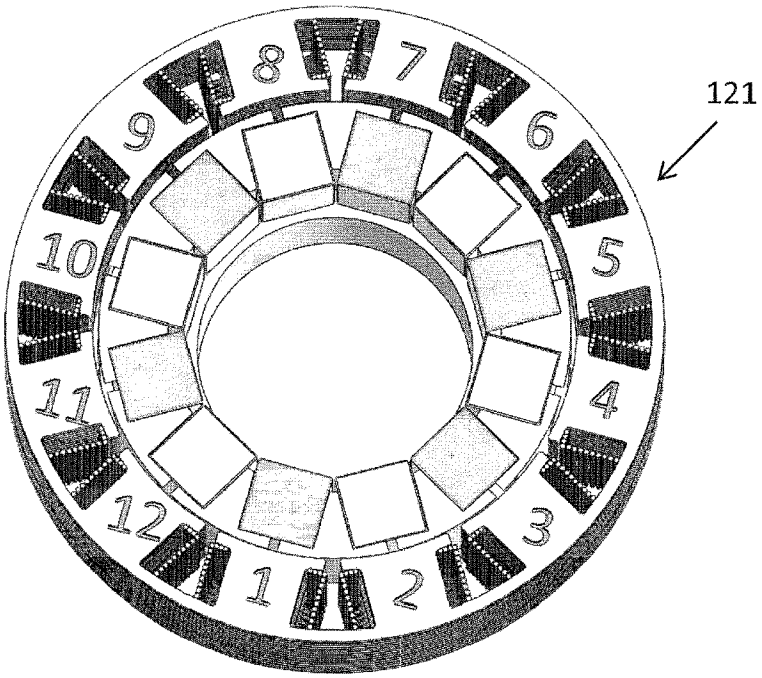

FIG. 16 is a cross-sectional image of a rotary motor actuator 121 in use with a valve 100, in accordance with the first exemplary embodiment of the present disclosure. FIGS. 17A-17D are various images of the rotary motor actuator 121, in accordance with the first exemplary embodiment of the present disclosure. As shown, the rotary motor actuator 121 may be used to operate the valve 100. The rotary motor actuator 121 may include a fixed stator 123*a* and a rotating magnetic rotor 123*b* positioned interior of the fixed stator 123*a*. The rotating magnetic rotor 121 may include a plurality of holes spaced radially about a center axis, each of which having a nickel plated magnetized plug positioned therein. A vertical movement guide 123*c* is positioned connected to the rotating magnetic rotor and has a plurality of ramps on which the lower ends of the push rods are in contact with. In operation, when a the fixed stator 123*a* is energized with a current, the rotating magnetic rotor 121 is forced to rotate which causes the lower ends of the push rods to move up the ramps in the vertical movement guide 123*c*. This action causes the push rods to raise and lower, depending on the current within the fixed stator 123*a*. Accordingly, that raising and lowering of the push rods can be used to control the valve 100. FIGS. 18A-18B are images switching concepts of the rotary motor actuator 121, in accordance with the first exemplary embodiment of the present disclosure. For example, as shown in FIG. 18A, switching may occur at a 30° step angle, whereas in FIG. 18B, switching may occur at a 60° step angle.

FIGS. 19-32 are images of various electromechanical valves and valve components, in accordance with the first exemplary embodiment of the subject disclosure. As discussed previously, the electromechanical valve may include different devices for actuation, including various rotary or vertical motors, cams, solenoids, and other devices. It is possible that the electromechanical valve can be controlled from different locations relative to a fluid tank. While each of the various electromechanical valves are described relative to different figures, it is noted that the components, features, and functions of the different valves can be used in different combinations with each other to achieve efficient and successful filling of containers with fluids.

Figure 19:
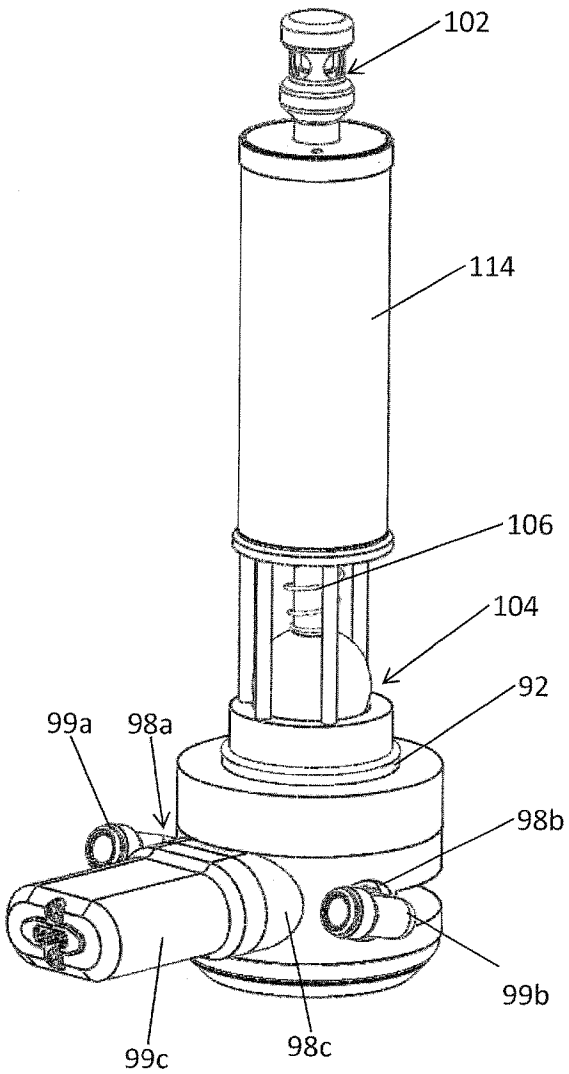
FIG. 19 is an illustration of an electromechanical volumetric filling valve, in accordance with the first exemplary embodiment of the present disclosure.
Figure 20:
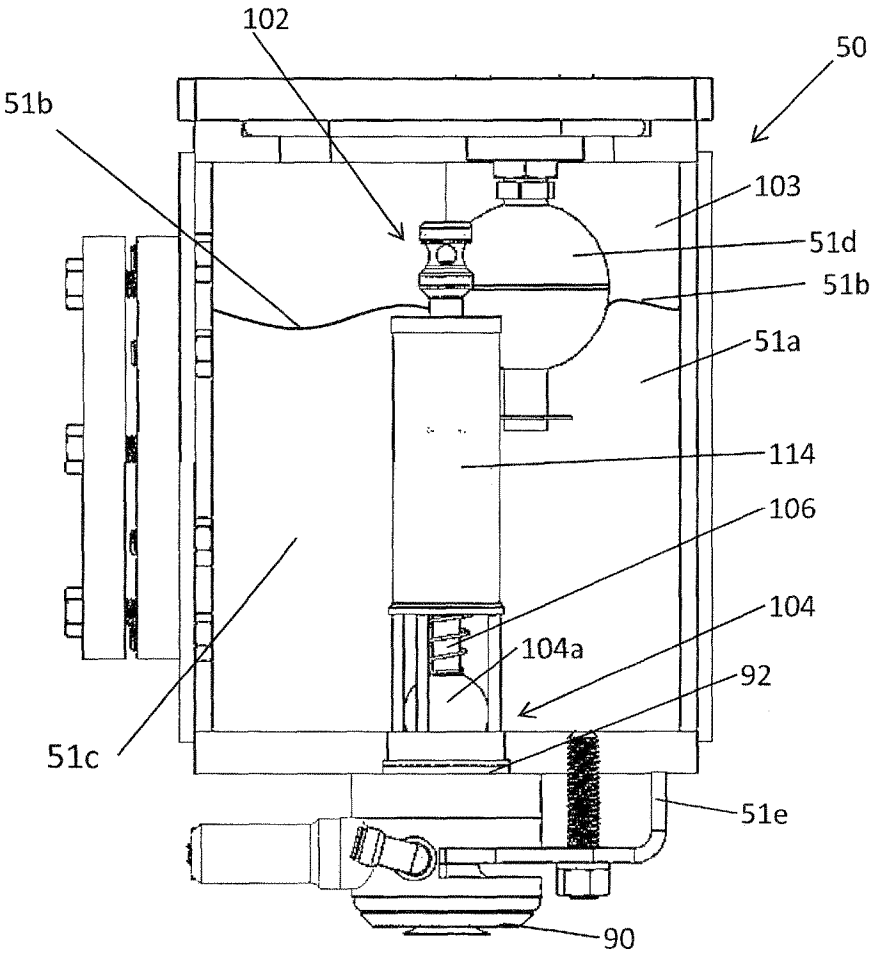
FIG. 20 is an illustration of an electromechanical volumetric filling valve within a filling head, in accordance with the first exemplary embodiment of the present disclosure.

FIG. 19 is an illustration of an electromechanical volumetric filling valve 100, in accordance with the first exemplary embodiment of the present disclosure. FIG. 20 is an illustration of an electromechanical volumetric filling valve 100 within a filling head 50, in accordance with the first exemplary embodiment of the present disclosure. FIGS. 21A-21E are cross-sectional illustrations of an electromechanical volumetric filling valve 100, in accordance with the first exemplary embodiment of the present disclosure. As shown relative to FIGS. 19-20, the valve 100 includes a one piece electromechanical valve body 114 which is sealed from the elements, which allows the valve body 114 to remain submerged in a quantity of fluid 51*c* within a fluid holding area 51*a* of the filling head 50. The sealed valve body 114 prevents exposure of the electromechanical components to the fluid 51*c*.

While the valve body 114 remains in the fluid 51*c*, the gas valve portion 102 positioned above the valve body 114 may be positioned above a fluid surface level 51*b*, such that it is in contact with a quantity of gas 103 located above the fluid 51*c*. A fluid level switch 51*d* of the filling head 50 may control the level of fluid 51*c* within the fluid holding are 51*a*, thereby keeping the level of the fluid 51*b* at the appropriate height relative to the valve 100. Below the valve body 114 is a fluid valve portion 104 which controls the release of the fluid 51*c* through the valve 100, through the multi-container filling nozzle 90, and eventually into a container positioned below the nozzle 90. As previously discussed, the valve 100 may be connected to the nozzle 90 and the bottom of the filling head 50 with a gasket 92 to prevent the fluid 51*c* from leaking out of the fluid holding area 51*a*. A valve mounting bracket 51*e* may be used to retain the valve 100 and/or the nozzle 90 to the filling head 50. FIG. 19 also illustrates the positioning of a vacuum valve outlet 99*a* positioned on the vacuum valve connection 98*a*, a snift/vent valve outlet 99*b* positioned on the snift/vent valve connection 98*b*, and gas and fluid valve activation solenoids 99*c* positioned on the gas and fluid valve activation solenoid connection 98*c*. It is noted that the gas and fluid valve activation solenoids 99*c* are depicted behind a solenoid cover, but are shown without the solenoid cover in FIG. 28.

It is noted that the valve 100 described relative to FIGS. 19-20 may have many beneficial qualities and uses. For example, the valve 100 hardware and structure may be made from 100% stainless steel construction. It may also offer superior filling level control by use of the built in evacuation control, where single or double evacuation is programmable. The valve 100 also has built in snift control, separate gas pure control, and separate fluid fill control. Fluid levels may be PLC driven through touch screen displays and a HMI interface. Additionally, the fluid levels may be changeable while the apparatus is filling a container. The valve 100 in combination with the nozzle 90 may accept any size can or bottle with no changeover or adjustment of the nozzle 90 itself, since the nozzle 90 may accommodate two or more container sizes at once. However, if the nozzle 90 needs to be changed for a non-standard size container, it may be easily done by disengaging the lower body from the upper body. The valve 100 may also be used to retrofit on existing filling machines, such as older Meyer filling machines.

Figure 21A:
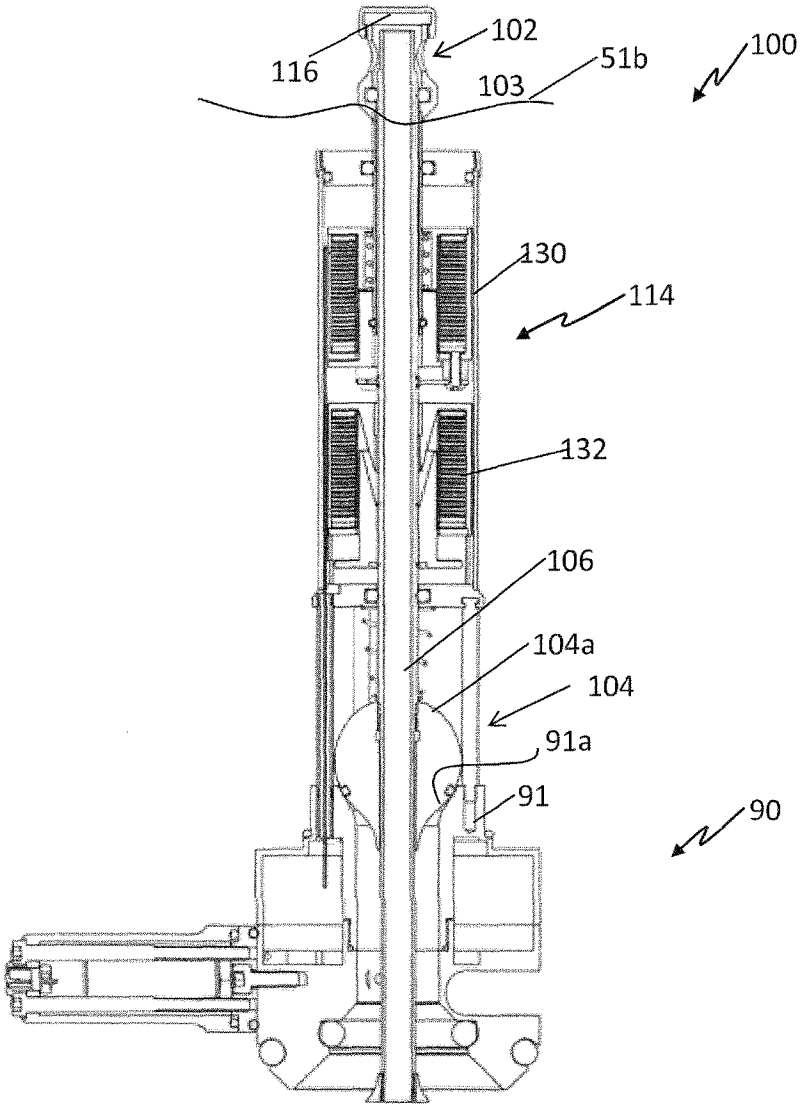
FIGS. 21A-21E are cross-sectional illustrations of an electromechanical volumetric filling valve, in accordance with the first exemplary embodiment of the present disclosure.
Figure 21C:
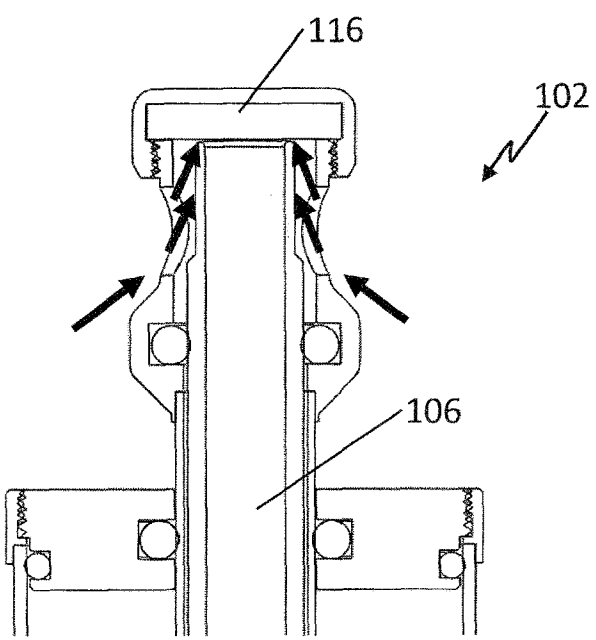
Figure 21B:
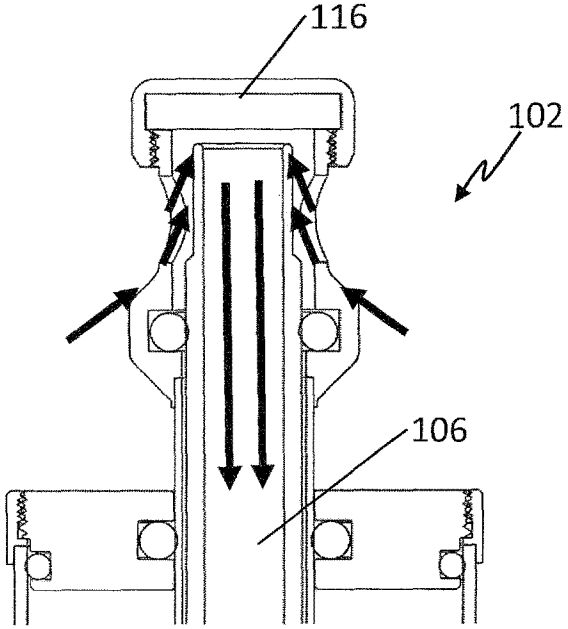
Figure 21E:
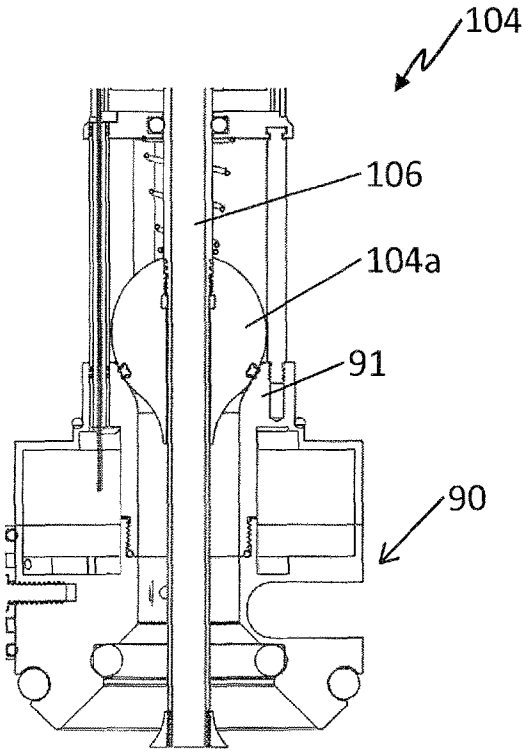
Figure 21D:
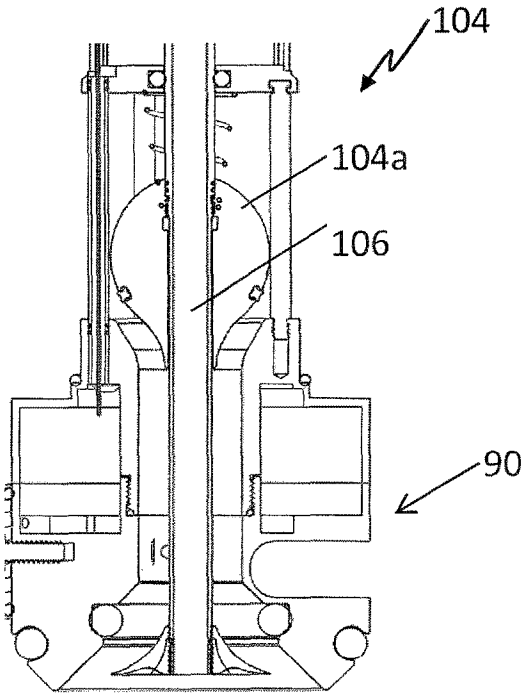

The operation of the valve 100 may be understood relative to FIGS. 19-21E generally, and specifically to FIGS. 21A-21E. As shown in FIG. 21A, the gas valve portion 102 is positioned within a gas area 103 located above a fluid level 51*b*. Gas from the gas area 103, which may be Co2 or another type of gas used in the beverage filling industry, is allowed to enter the gas valve portion 102 or denied entry into the gas valve portion 102 by sealing and unsealing the gas valve portion 102, as is shown in FIGS. 21B-21C. Specifically, gas valve portion 102 may be controlled by raising and lowering the rubber seal 116 relative to the top of the valve stem 106 which is positioned through the valve body 114. Movement of the valve stem 106 may be controlled by a gas valve function solenoid 130 positioned within the valve body 114 and connected to an activation tube positioned around the valve stem 106. The gas valve function solenoid 103 may have effect a short stroke, high pulling force through an entire stroke upon activation of the gas valve function solenoid 103, which causes movement of the rubber seal 116 on the activation tube relative to the valve stem 106. When the gas valve portion 102 is opened, as is shown in FIG. 21B, the valve stem 106 is positioned away from the rubber seal 116 to allow gas to enter the gas valve portion 102 and move down the valve stem 106, as indicated by the arrows in FIG. 21B. When the valve portion 102 is closed, the valve stem 106 is positioned in contact with the rubber seal 116 which prevents the entry of gas into the valve stem 106, as indicated by the arrows in FIG. 21C.

The valve 100 also operates to control the fluid valve portion 104. Relative to FIGS. 21A, 21D, and 21E, a fluid valve function solenoid 132 may control raising and lowering of a fluid valve 104*a* positioned within the fluid valve portion 104 and proximate to the connector 91 of the nozzle 90. Specifically, the fluid valve 104*a* may be positioned in contact with a sealing edge 91*a* of the connector 91 to prevent fluid from gaining entry into the nozzle 90, or it may be withdrawn from contact with the sealing edge 91*a* to allow fluid to move past the fluid valve 104*a* and descend into the nozzle 90 and eventually into a container positioned below the nozzle 90. Both the gas valve function solenoid 130 and the fluid valve function solenoid 132 may be connected to the lower body of the valve 100 or the upper body of the nozzle 90, where a battery or other power source may be stored.

Figure 22B:
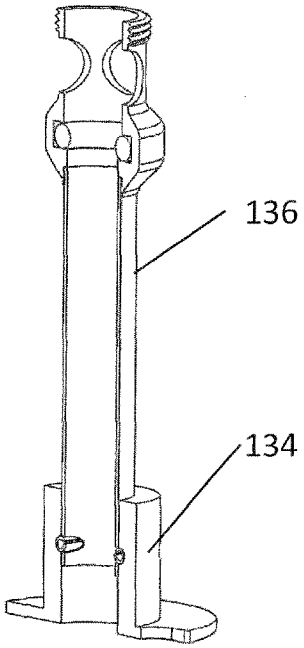
FIGS. 22A-22B are cross-sectional illustrations of the gas valve portion of the electromechanical volumetric filling valve, in accordance with the first exemplary embodiment of the present disclosure.
Figure 22A:
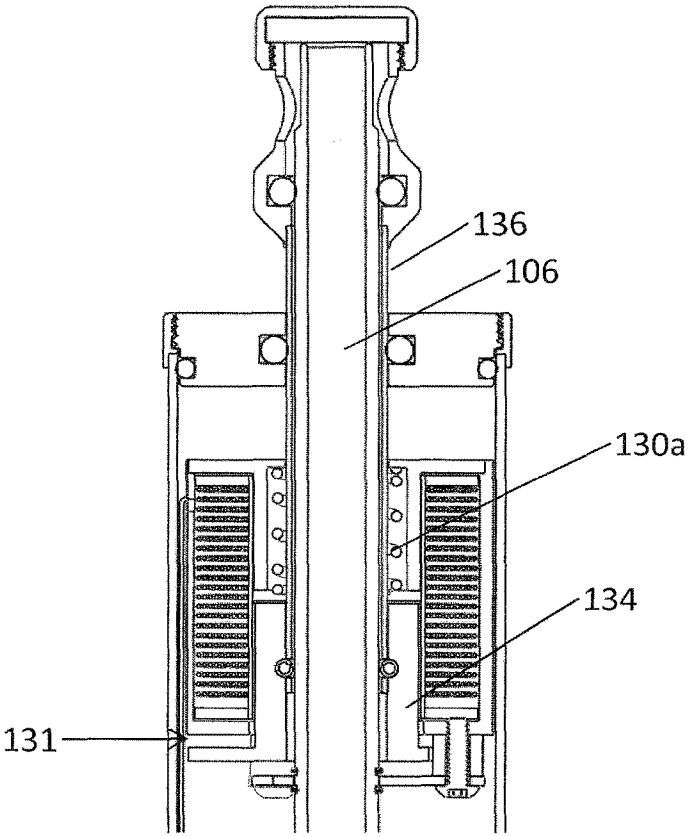

FIGS. 22A-22B are cross-sectional illustrations of the gas valve portion 102 of the electromechanical volumetric filling valve 100, in accordance with the first exemplary embodiment of the present disclosure. Specifically, FIG. 22A illustrates the gas valve function solenoid 130 which has a gas valve solenoid plunger 134 connected to the activation tube 136 which is the component of the valve stem 106 and is raised and lowered relative to the valve stem 106. As the gas valve function solenoid 130 moves, it causes the plunger 134 to move, thereby moving the activation tube 136. A spring 130*a* may be used to return the gas valve portion 104 to the closed position. The activation tube 136 and the plunger 134 are shown in detail in FIG. 22B. As shown in FIG. 22A, when the gas valve portion 102 is in the closed position, there may be a gap 131 between the rim of the plunger 134 and the bottom of the gas valve function solenoid 130.

Figure 23:
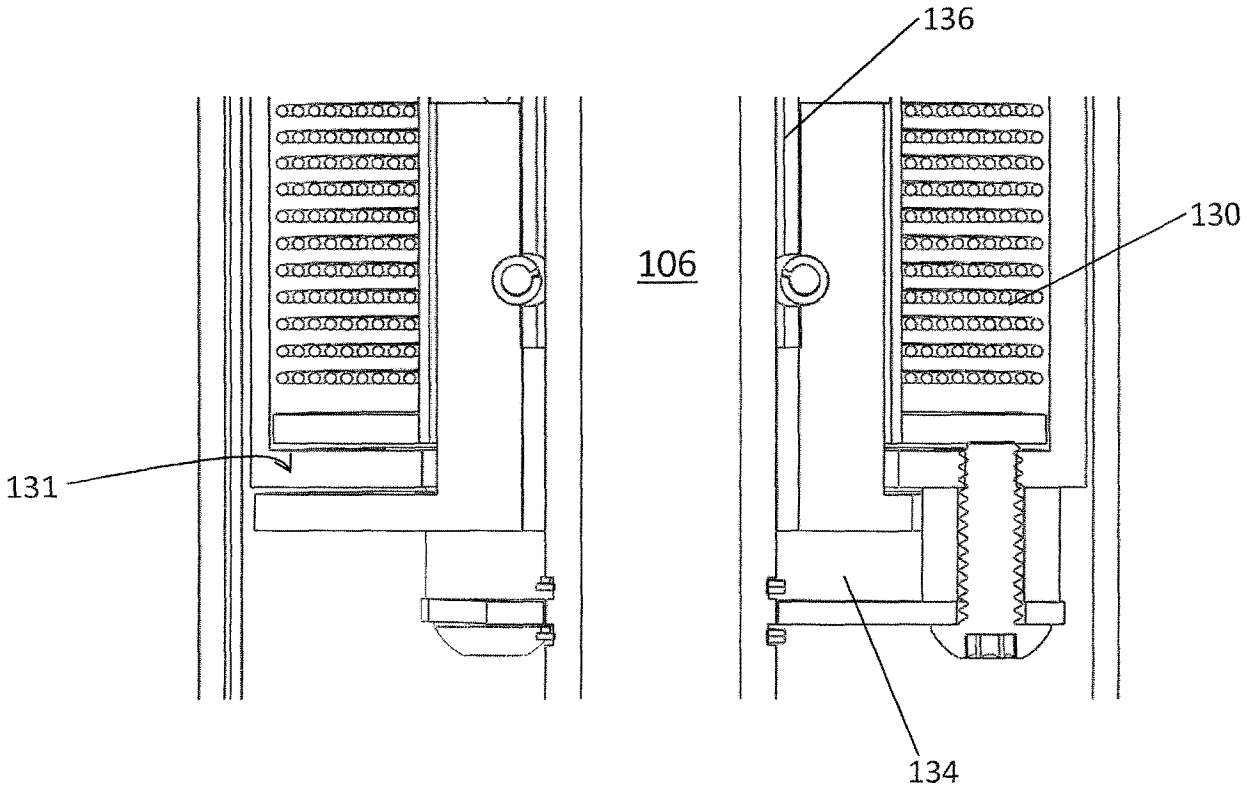
FIG. 23 is a cross-sectional illustration of the gas valve function solenoid of the electromechanical volumetric filling valve, in accordance with the first exemplary embodiment of the present disclosure.

FIG. 23 is a cross-sectional illustration of the gas valve function solenoid 130 of the electromechanical volumetric filling valve 100, in accordance with the first exemplary embodiment of the present disclosure. The gas valve function solenoid 130 may be mounted to the valve stem 106 using one or more fasteners or brackets, such that the movement of the gas valve function solenoid 130 may also open and close the fluid valve portion 104. In this example, the gas valve function solenoid 130 may move up and down along with the components for the fluid valve portion 104.

Figure 24:
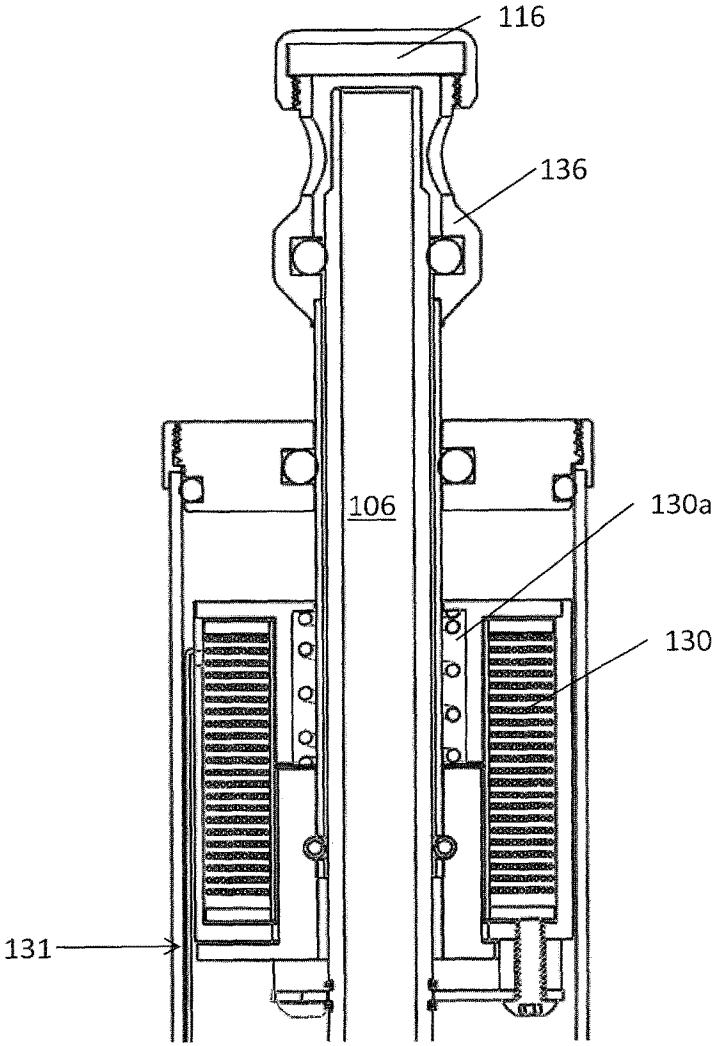
FIG. 24 is a cross-sectional illustration of the electromechanical volumetric filling valve, in accordance with the first exemplary embodiment of the present disclosure.

FIG. 24 is a cross-sectional illustration of the electromechanical volumetric filling valve 100, in accordance with the first exemplary embodiment of the present disclosure. In contrast to FIG. 22A which shows the gas valve portion 102 in a closed position and a gap 131 between the plunger 134 and the gas valve function solenoid 130, FIG. 24 illustrates the gas valve portion 102 in the open position. As can be seen, the activation tube 136 is removed from contact with the rubber gasket 116. In this example, it can be seen that the gap 131 has been closed, thereby showing the movement distance of the activation tube 136.

Figure 25C:
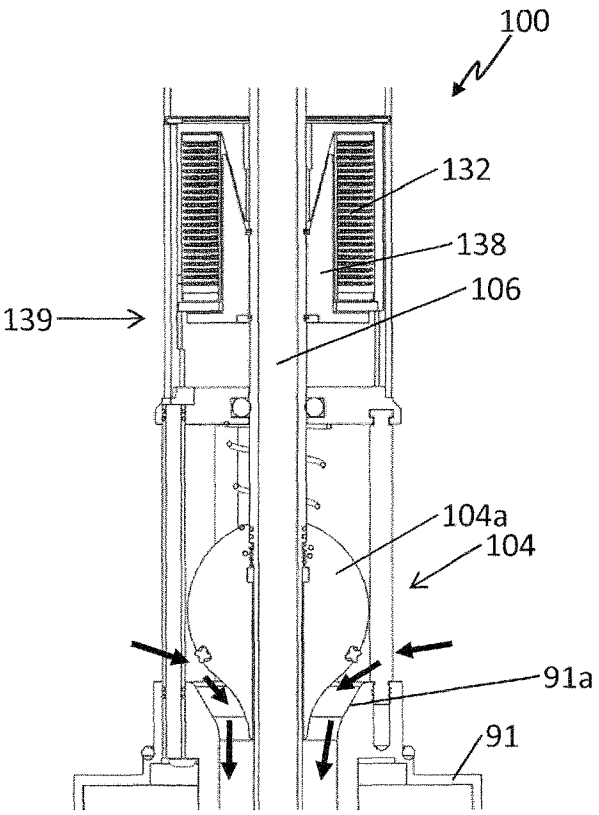
FIGS. 25A-25C are cross-sectional illustrations of the fluid valve function solenoid of the electromechanical volumetric filling valve, in accordance with the first exemplary embodiment of the present disclosure.
Figure 25B:
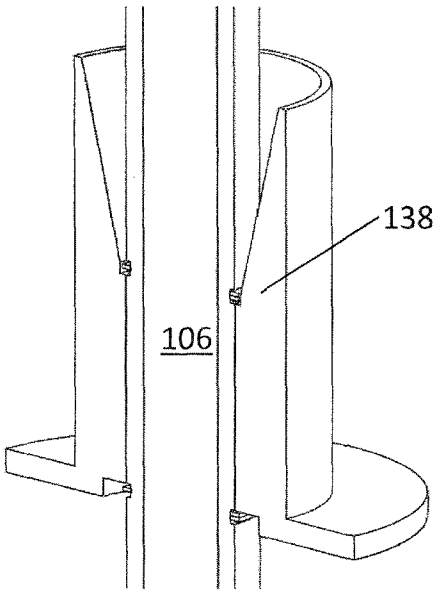
Figure 25A:
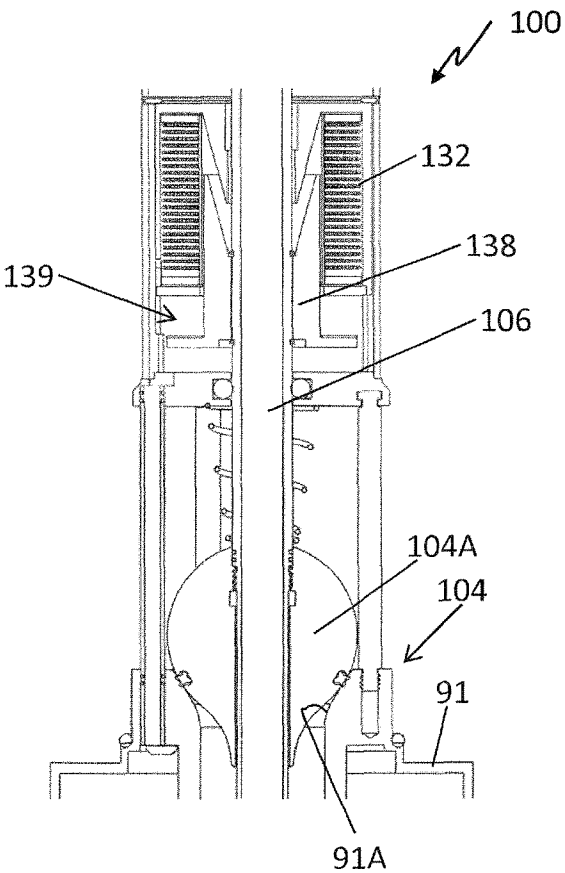

FIGS. 25A-25C are cross-sectional illustrations of the fluid valve function solenoid 132 of the electromechanical volumetric filling valve 100, in accordance with the first exemplary embodiment of the present disclosure. The fluid valve function solenoid 132 may control the movement of the fluid valve portion 104, namely the fluid valve 104*a* (fluid valve ball) relative to the sealing edge 91*a* of the connector 91. The fluid valve function solenoid 132 may include a plunger 138 which is movable based on the activation of the fluid valve function solenoid 132. The plunger 138 may be moved away from and towards the fluid valve function solenoid 132, such that a gap 139 can be opened between the two structures. In FIG. 25A, the gap 139 is present due to the fluid valve portion 104 being in the closed position, as the fluid valve 104*a* is positioned in contact with the sealing edge 91*a*. The fluid valve 104*a* may be connected to the plunger 138 through the valve stem 106, as shown in FIG. 25A. FIG. 25B illustrates one method of connecting the plunger 138 to the valve stem 106, although other connections are also possible. In FIG. 25C, the fluid valve portion 104 is shown in the open position, wherein the fluid valve 104*a* is removed from contact with the sealing edge 91*a* and the plunger 138 is positioned without a gap 139 to the fluid valve function solenoid 132.

Figure 26:
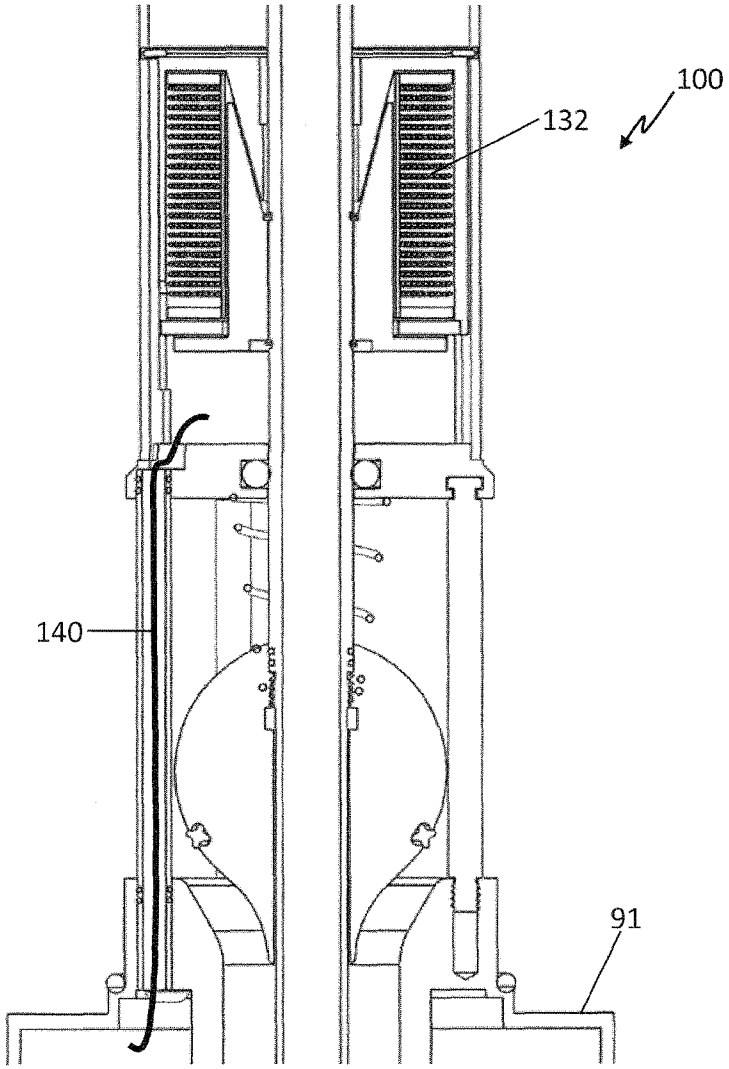
FIG. 26 is a cross-sectional illustration of the electromechanical volumetric filling valve, in accordance with the first exemplary embodiment of the present disclosure.

FIG. 26 is a cross-sectional illustration of the electromechanical volumetric filling valve 100, in accordance with the first exemplary embodiment of the present disclosure. As shown in FIG. 26, a wire 140 may be connected between the fluid valve function solenoid 132, the gas function valve solenoid 130 (not shown), and the connector 91 at the base of the valve 100. The connector 91 may store a power source such as a battery, which may provide electrical power to the gas and fluid valve function solenoids 130, 132. The wire 140 may be positioned within a sealed conduit tube to prevent exposure to fluids or adverse contaminants.

Figure 27:
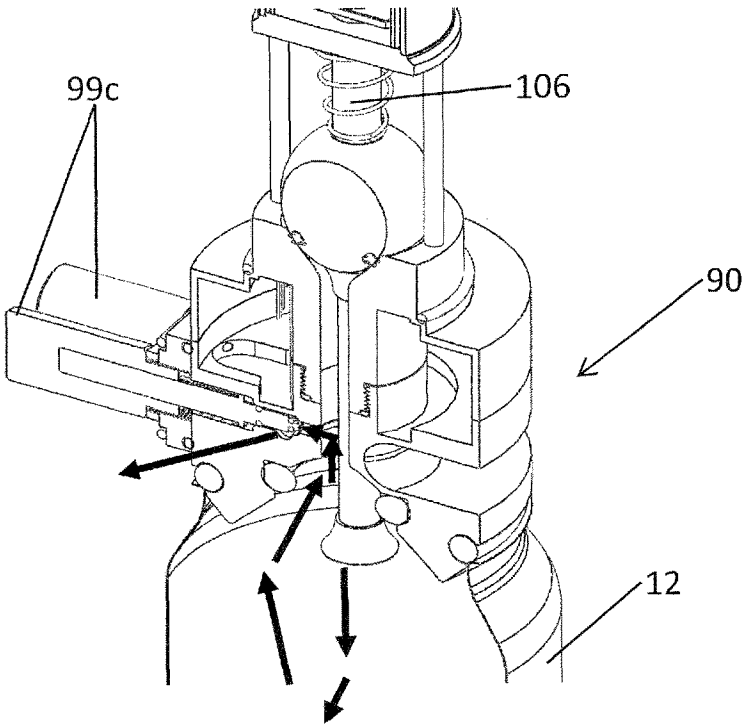
FIG. 27 is a cross-sectional illustration of multi-container filling nozzle, in accordance with the first exemplary embodiment of the present disclosure.
Figure 28:
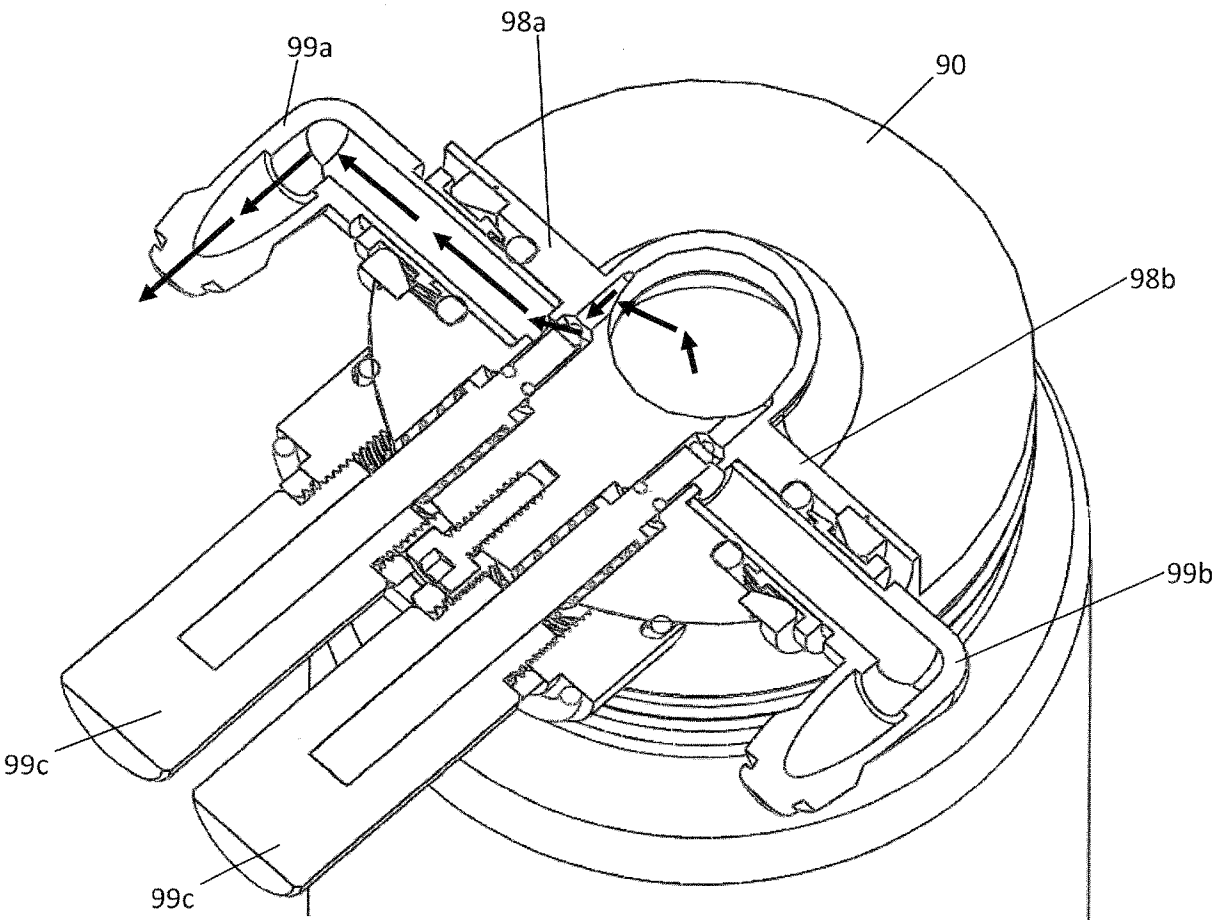
FIG. 28 is a cross-sectional illustration of multi-container filling nozzle, in accordance with the first exemplary embodiment of the present disclosure.

FIG. 27 is a cross-sectional illustration of multi-container filling nozzle 90, in accordance with the first exemplary embodiment of the present disclosure. Specifically, FIG. 27 illustrates how the gas supplied to the container 12 from the gas valve portion 102 (not shown) is released through the nozzle 90. As shown, the gas is supplied through the valve stem 106 into the container 12. The gas may then be evacuated through one of the gas and fluid valve activation solenoids 99*c* during a filling process, to control the pressure of the can as it is being filled with fluid. The other gas and fluid valve activation solenoid 99*c* may be used to let the tank pressure out of the container that is being vented/snifted. FIG. 28 is a cross-sectional illustration of multi-container filling nozzle 90, in accordance with the first exemplary embodiment of the present disclosure. Specifically, FIG. 28 illustrates the path of the gas being evacuated from the container through the nozzle, as indicated by the arrows. As can be seen, the gas may pass through the controller of the solenoid and into the vacuum valve outlet 99*a* positioned on the vacuum valve connection 98*a*, as shown, or a snift/vent valve outlet 99*b* positioned on the snift/vent valve connection 98*b*.

Figure 29B:
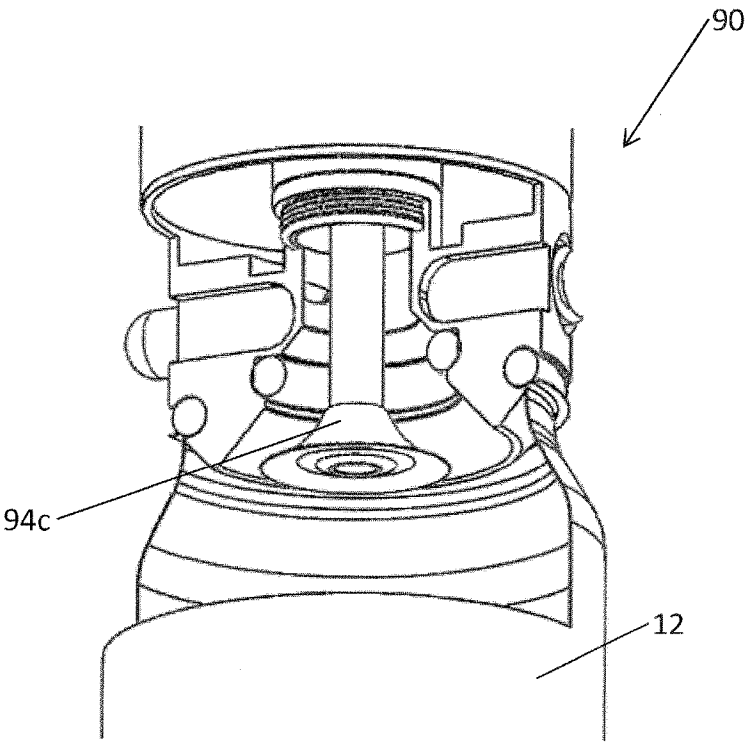
FIGS. 29A-29B are cross-sectional illustrations of laminar flow nozzles, in accordance with the first exemplary embodiment of the present disclosure.
Figure 29A:
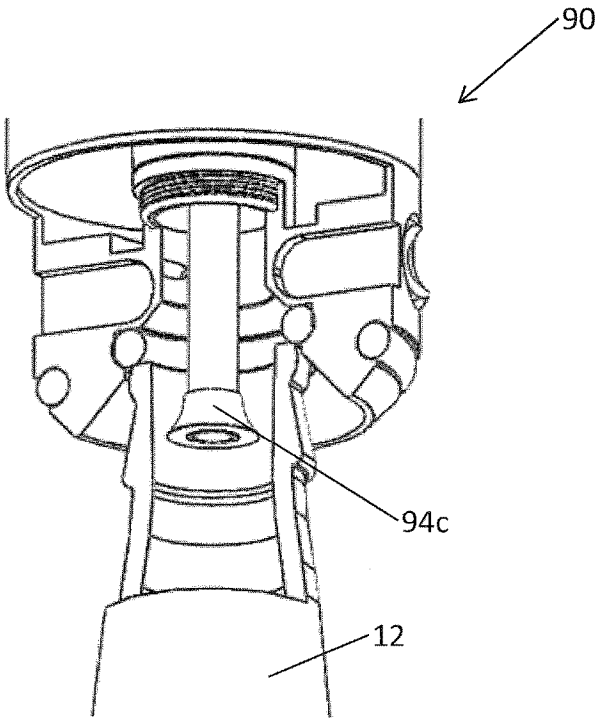

FIGS. 29A-29B are cross-sectional illustrations of laminar flow nozzles 94*c*, in accordance with the first exemplary embodiment of the present disclosure. The laminar flow nozzle 94*c* used with each multi-container filling nozzle 90 may be interchangeable depending on the type of container 12 that is being filled to ensure the lowest turbulence possible with the fluid being input into the container 12. For example, a bottle container 12, as shown in FIG. 29A, may be used with a laminar flow nozzle 94*c* that has a smaller size, namely due to the smaller neck size of the bottle container 12. The smaller size laminar flow nozzle 94*c* may allow the fluid to be conveyed from a downward path to an angular path against the inner wall of the neck of the bottle container 12, thereby directing the fluid along a low-turbulence path to the bottom of the container 12. A laminar flow nozzle 94*c* with a wider end may be used with a can container 12, as shown in FIG. 29B.

Figure 30C:
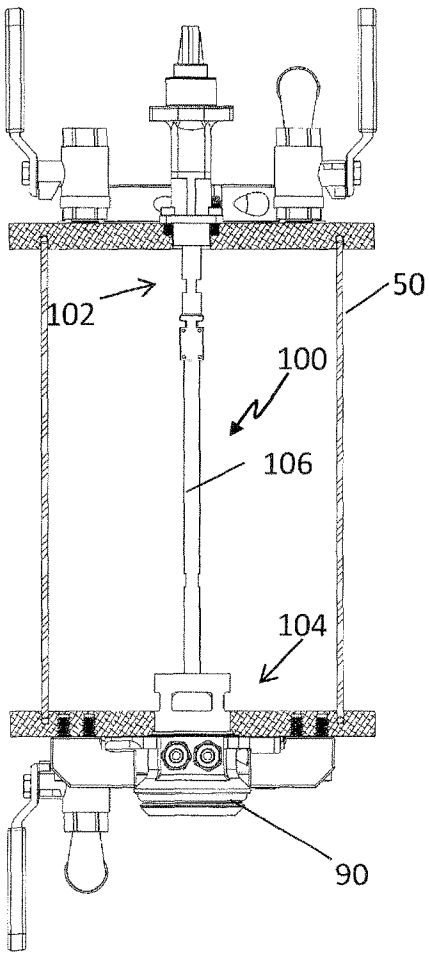
FIGS. 30A-30C are cross-sectional illustrations of an electromechanical volumetric filling valve with a stepper motor design, in accordance with the first exemplary embodiment of the present disclosure.
Figure 30B:
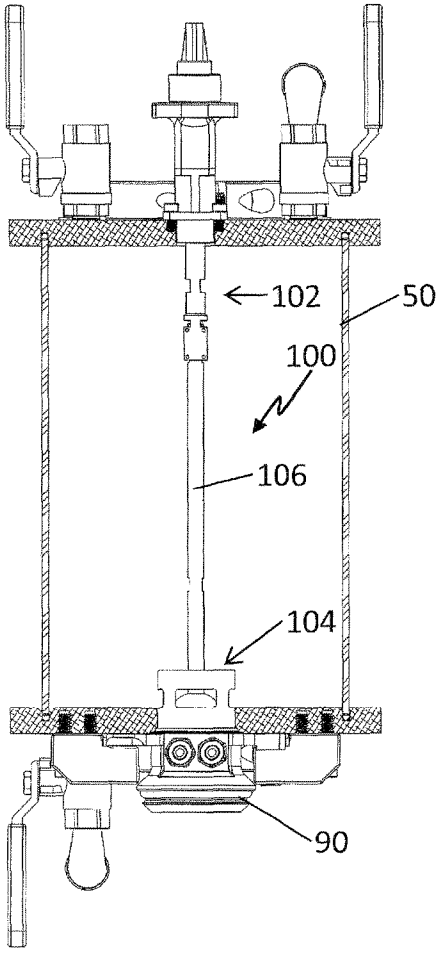
Figure 30A:
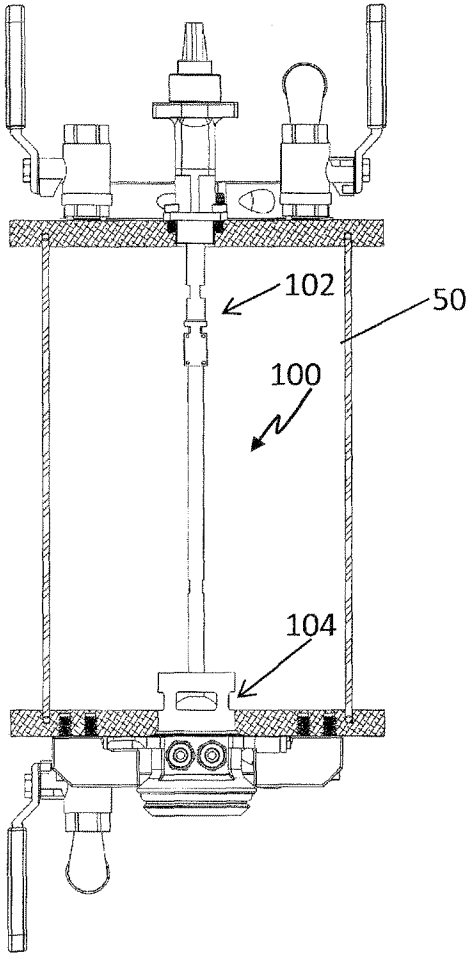

FIGS. 30A-30C are cross-sectional illustrations of an electromechanical volumetric filling valve 100 with a stepper motor design, in accordance with the first exemplary embodiment of the present disclosure. As shown, the stepper motor design of the valve 100 may allow for control of the gas and fluid portions 102, 104 from a position outside of the filling head, i.e., outside of where the fluid to be filled in the containers is stored. In FIG. 30A, the fluid valve potion 104 and the gas valve portion 102 are both shown in the closed position. In FIG. 30B, the fluid valve portion 104 is still shown closed, but the gas valve portion 102 is shown in the open position, such that gas residing in the top of the filling head 50 can enter the valve stem 106 and move to the nozzle 90. In FIG. 30C, both the gas valve portion 102 and the fluid valve portion 104 are shown in the open position, such that both the gas and fluid within the filling head 50 can move to the nozzle 90.

Figure 31A:
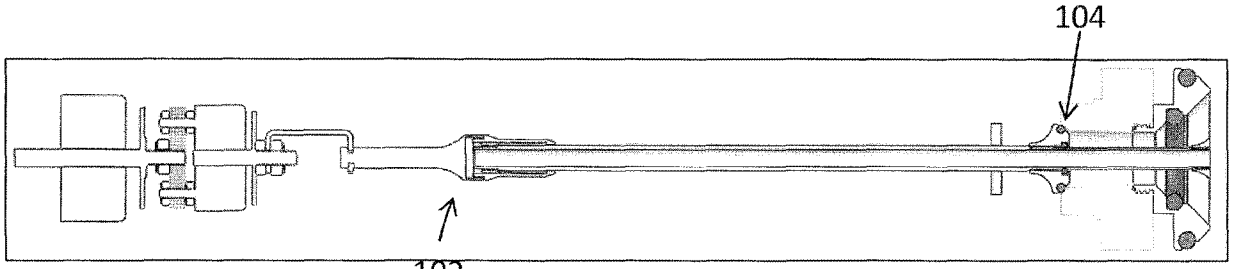
FIGS. 31A-31C are cross-sectional illustrations of an electromechanical volumetric filling valve with another stepper motor design, in accordance with the first exemplary embodiment of the present disclosure.
Figure 31B:
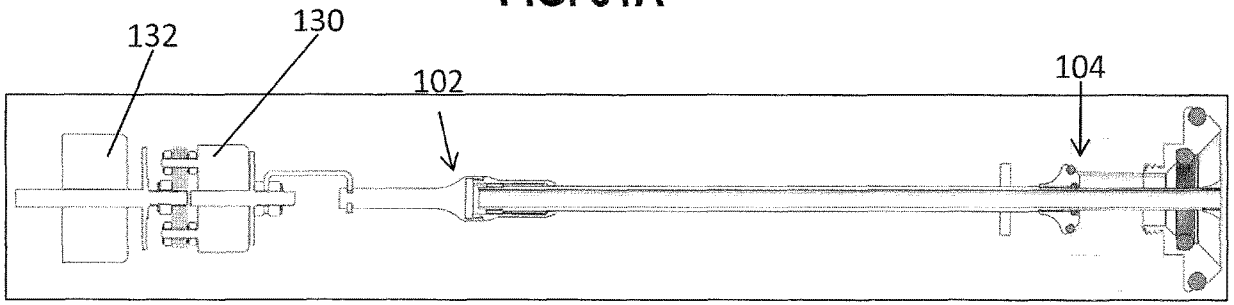
Figure 31C:
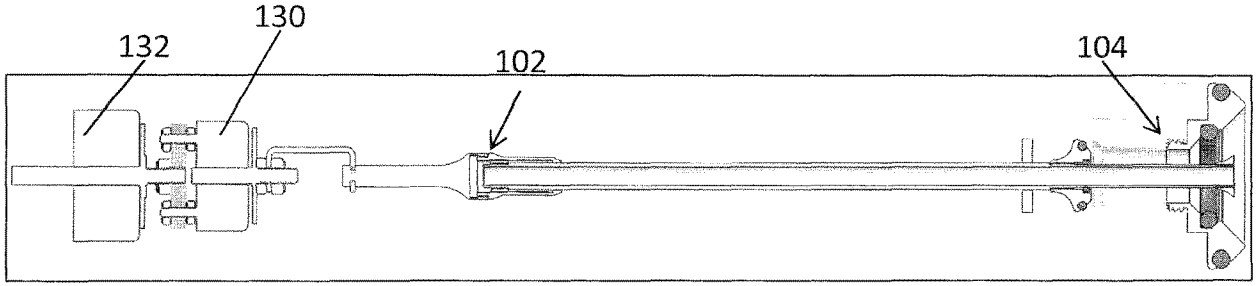

FIGS. 31A-31C are cross-sectional illustrations of an electromechanical volumetric filling valve 100 with another stepper motor design, in accordance with the first exemplary embodiment of the present disclosure. As shown, the valve 100 of FIGS. 31A-31C may combine some of the features of the valve 100 of FIGS. 30A-30C and features of other valves disclosed herein. The valves of FIGS. 31A-31C may function and operate in accordance with the disclosure relative to FIG. 10. To this end, FIG. 31A illustrates the valve 100 with the gas and fluid valve portions 102, 104 closed; FIG. 31B illustrates the valve 100 with the gas valve portion 102 opened, e.g., when the gas valve function solenoid 130 is energized; and FIG. 31C illustrates the valve 100 with both the gas and fluid valve portions 102, 104 opened, i.e., when the gas and fluid valve function solenoids 130, 132 are both energized.

Figure 32:
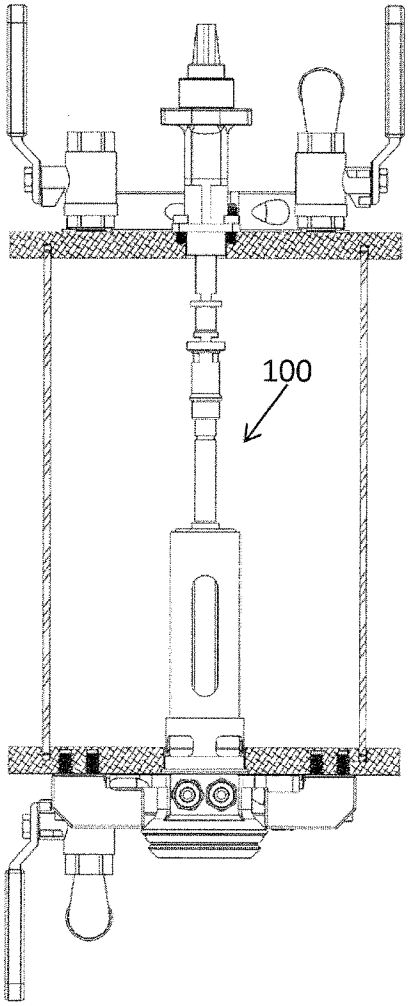
FIG. 32 is a cross-sectional illustration of an electromechanical volumetric filling valve with a Meyer valve design, in accordance with the first exemplary embodiment of the present disclosure.

FIG. 32 is a cross-sectional illustration of an electromechanical volumetric filling valve 100 with a Meyer valve design, in accordance with the first exemplary embodiment of the present disclosure. The Meyer valve design of the valve 100 may be similar to the previous designs discussed, but includes a valve 100 installed as a retrofit on an existing Meyer brand filling machine.

Figure 33:
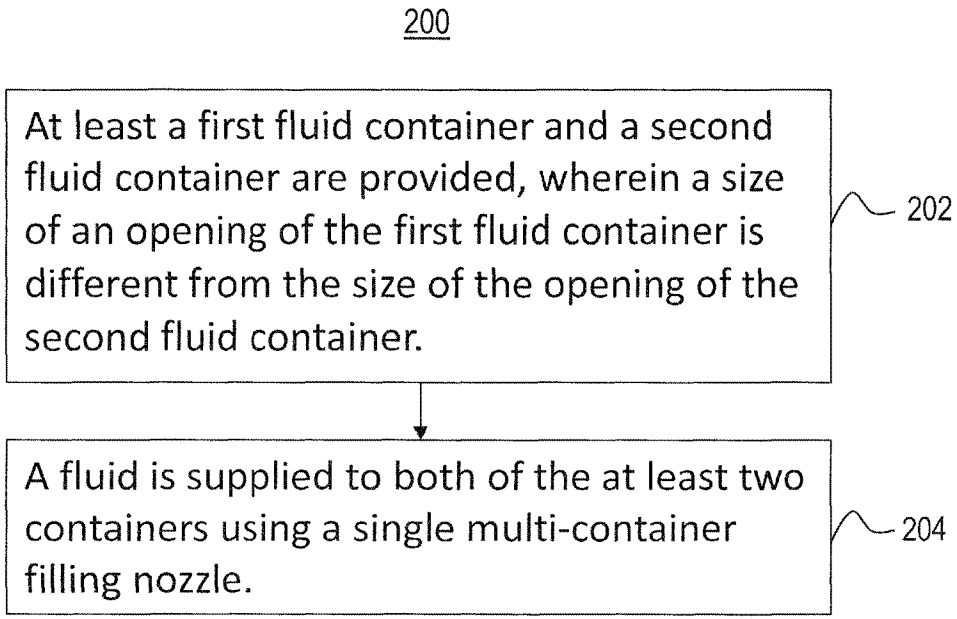
FIG. 33 is a flowchart illustrating a method of filling containers with fluid, in accordance with the first exemplary embodiment of the disclosure.

FIG. 33 is a flowchart 200 illustrating a method of filling containers with fluid, in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, at least a first fluid container and a second fluid container are provided, wherein a size of an opening of the first fluid container is different from the size of the opening of the second fluid container. A fluid is supplied to both of the at least two containers using a single multi-container filling nozzle (block 204). The method may further include a number of additional steps, processes, and functions, including any disclosed relative to any other part of this disclosure. For example, the first fluid container may be a metal can and the second fluid container may be a glass bottle. Additionally, a rim of the opening of the first fluid container may be contacted with a first gasket on the multi-container filling nozzle and the rim of the opening of the second fluid container may be contacted with a second gasket on the multi-container filling nozzle. The fluid may be supplied to both of the at least two containers using the single multi-container filling nozzle without changing the single multi-container filling nozzle and without adjusting the single multi-container filling nozzle.

Figure 34:
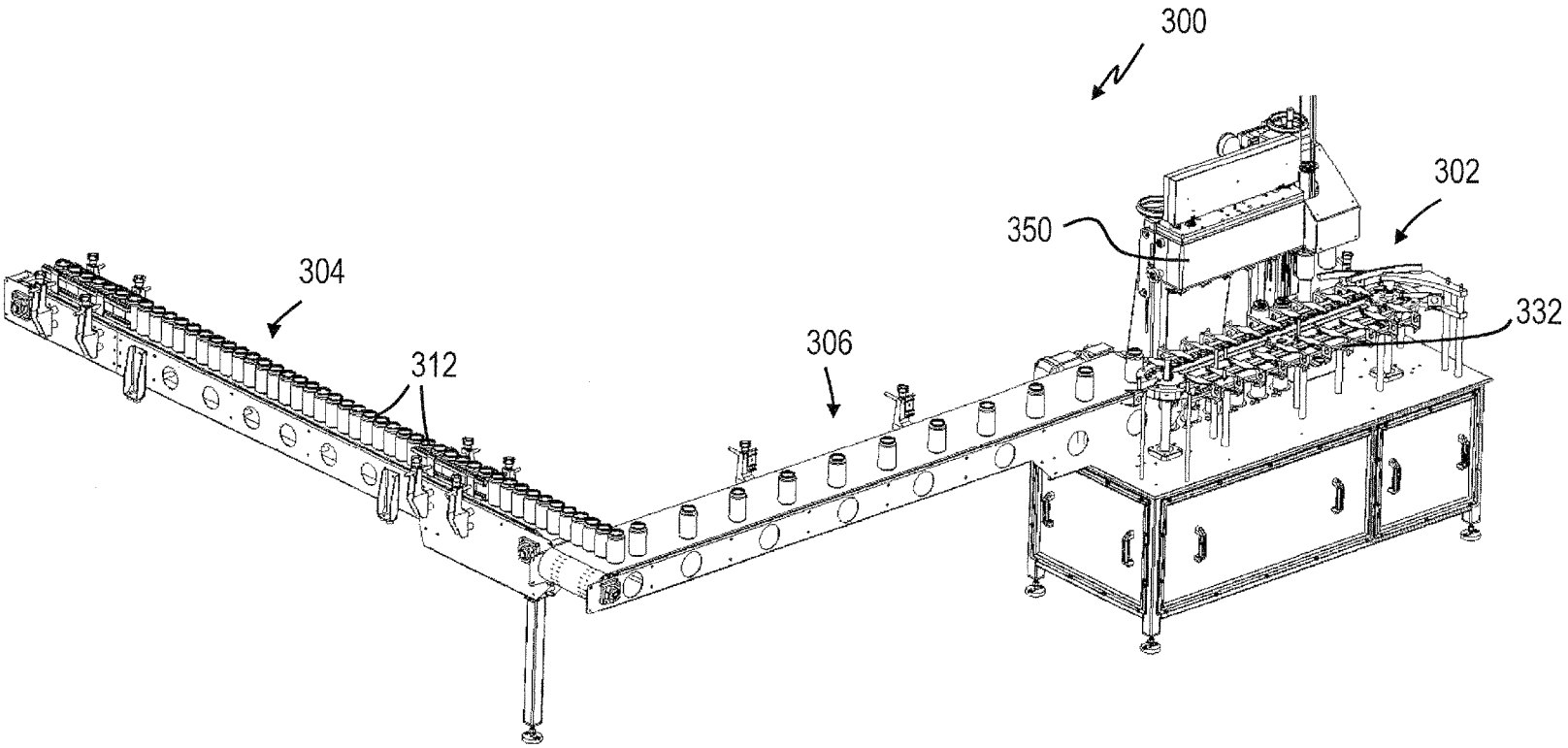
FIG. 34 is an isometric view illustration of a container-filling machine, in accordance with the first exemplary embodiment of the present disclosure.
Figure 35:
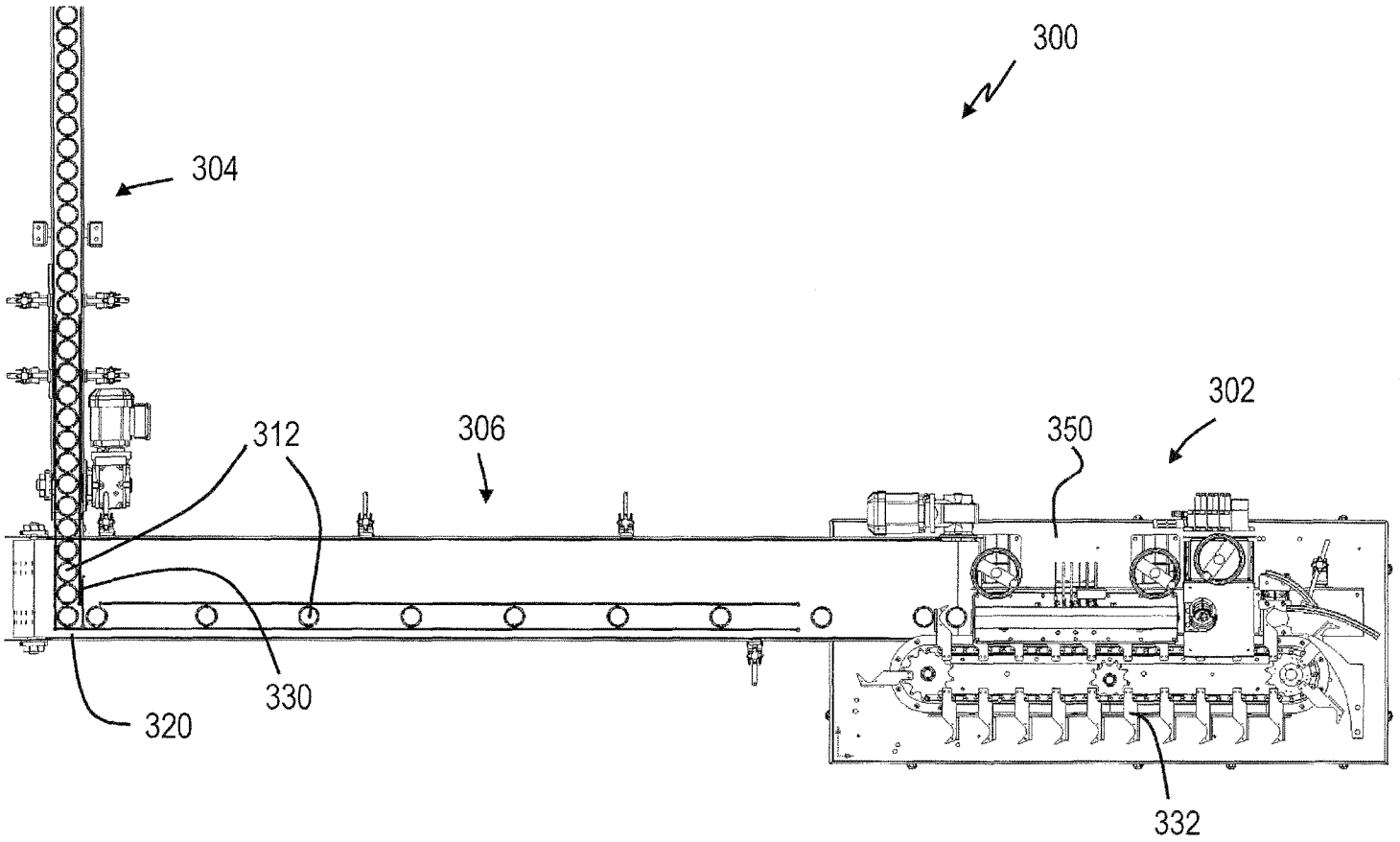
FIG. 35 is a top view illustration of a container-filling machine, in accordance with the first exemplary embodiment of the present disclosure.

FIG. 34 is an isometric view illustration of a container-filling machine 300, in accordance with the first exemplary embodiment of the present disclosure. FIG. 35 is a top view illustration of a container-filling machine 300, in accordance with the first exemplary embodiment of the present disclosure. The container-filling machine 300 includes a filler 302 which may operate substantially similar to the similar fillers previously described. The containers 312 may be supplied to the filler 302 on a first conveyer 304 which is positioned substantially 90° relative to direction of the processing line of the filler 302 and a second conveyer 306 which leads to the filler 302. The second conveyer 306 may receive the containers 312 from the first conveyer 304. The second conveyer 306 may lead to the lug chain 332 which positions the containers 312 under the filling head 350. As is shown in FIG. 35, the containers at the end of the first conveyer 304 will meet a hard stop 320 or a dead-head stop (not shown in FIG. 34) before the containers start to move along the length of the second conveyer 306. The first conveyer 304 may continue to run even through the containers 312 are positioned against the hard stop 320. When the containers 312 contact the hard stop 320, at the junction between the first and second conveyers 304, 306, they may be positioned sitting on the second conveyer 306 such that the containers 312 are biased towards the filling head 350. A guillotine gate 330 may be positioned adjacent to the hard stop 320 to control movement of the containers 312 along the second conveyer 306 and to the filling head 350.

FIGS. 36A-36E are top view schematic diagrams of the guillotine gate 330 of the container-filling machine 300, in accordance with the first exemplary embodiment of the present disclosure. The containers 312 may enter the first conveyer 304 along the direction of the arrow in FIG. 36A. The first of the containers 312 on the first conveyer 304 contacts the hard stop 320 and now is positioned on the second conveyer 306. However, the guillotine gate 330 prevents the container 312 from moving down the second conveyer 306. In FIG. 36B, the guillotine gate 330 is moved, such as by being raised, lowered, or moved laterally, and the container 312 is allowed to move along the second conveyer 306, as shown in FIG. 36C. After a specified number of containers 312 have moved, i.e., such as one container 312 as shown in FIG. 36D, the guillotine gate 330 may close and the containers 312 on the first conveyer 304 are moved towards the hard stop 320.

Figure 37:
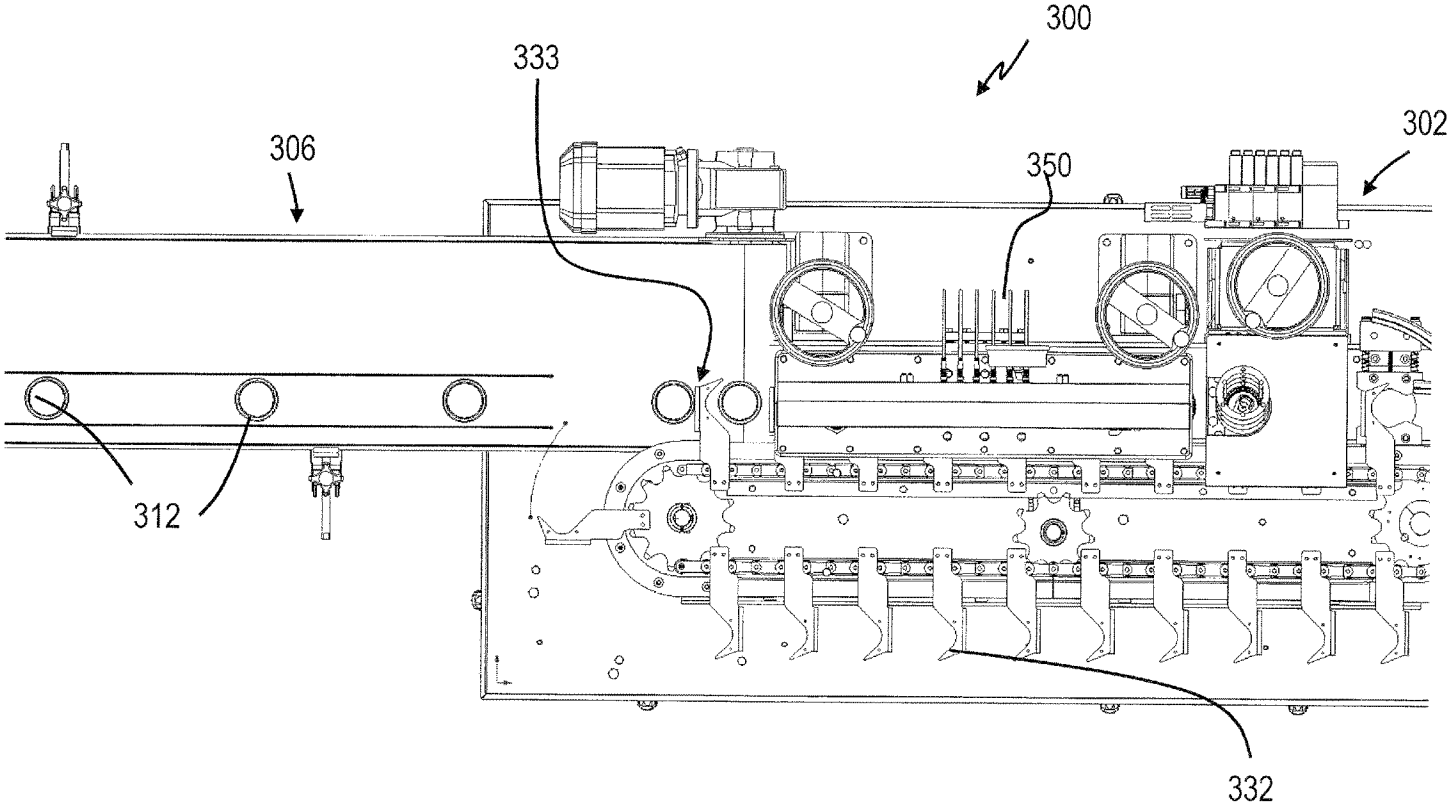
FIG. 37 is a top view schematic diagram of the container-filling machine, in accordance with the first exemplary embodiment of the present disclosure.

FIG. 37 is a top view schematic diagram of the container-filling machine 300, in accordance with the first exemplary embodiment of the present disclosure. Specifically, FIG. 37 depicts the containers 312 traveling down the second conveyer 306 (feed lane indexing conveyer) and to stop on the back side 333 of a lug of the lug chain 332. The container 312 will then stop when it makes contact with the back side 333 of the lug chain 332. Then, the lug chain 332 indexes around the corner and a lug contacts the container 312 and moves it to the appropriate position under the filling head 350. The use of the second conveyer 306 with the lug chain 332 allows the containers 312 to enter the filling area in substantially a straight path, which may provide improvements over devices which rotate the containers 312 around a corner. The platform that the container 312 sits on while advancing to the filling head 350 may have a self-centering V-groove, or similar feature, to center the container 312 appropriately.

Figure 38B:
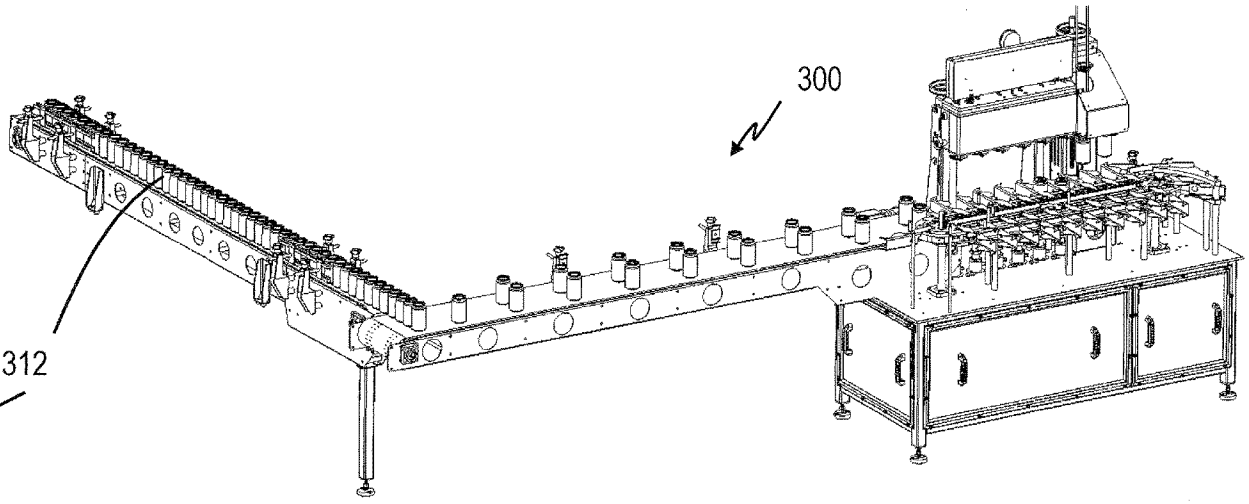
FIGS. 38A-38B are isometric and top view schematic diagram of the container-filling machine, in accordance with the first exemplary embodiment of the present disclosure.
Figure 38A:
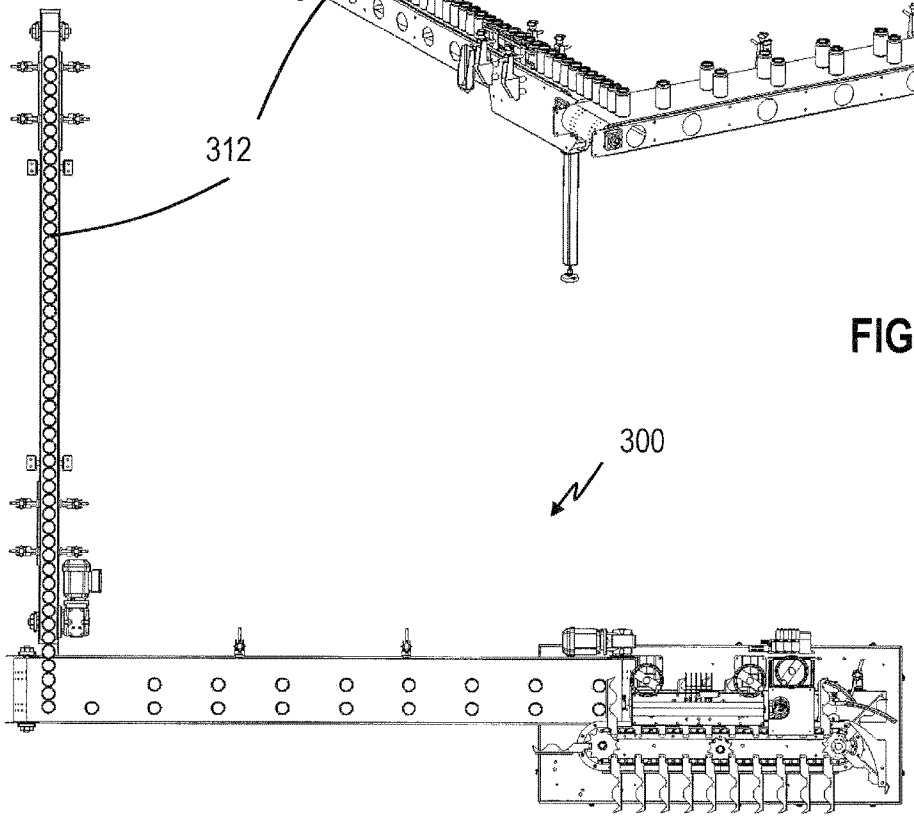

FIGS. 38A-38B are isometric and top view schematic diagram of the container-filling machine 300, in accordance with the first exemplary embodiment of the present disclosure. As shown, the container-filling machine 300 may have a dual-lane filling design, or a lane filling design which accommodates any number of containers 312. In some designs, a four-lane conveyer and filling capability may be included. In this design, a guillotine gate may open up enough to allow two or more containers 312 to enter the feed conveyer.

Figure 39B:
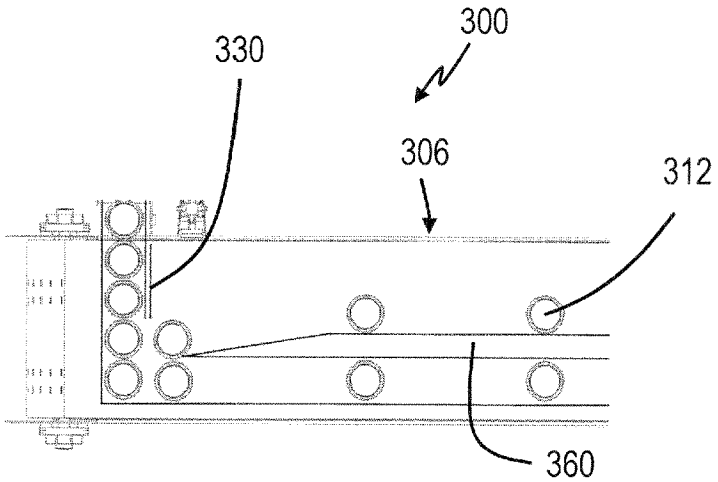
FIGS. 39A-39C are top view schematic diagrams of diverter ramps used with the container-filling machine, in accordance with the first exemplary embodiment of the present disclosure.
Figure 39A:
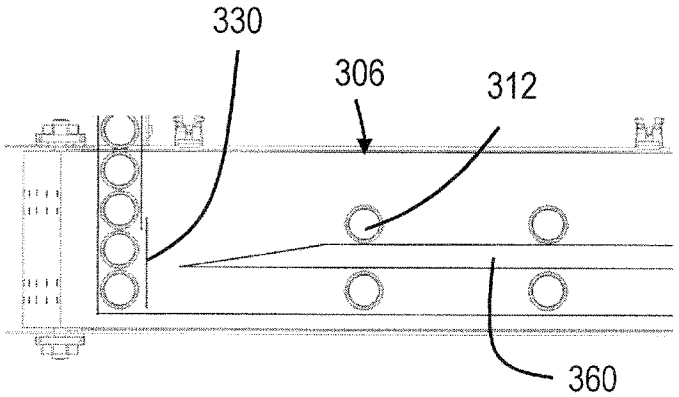
Figure 39C:
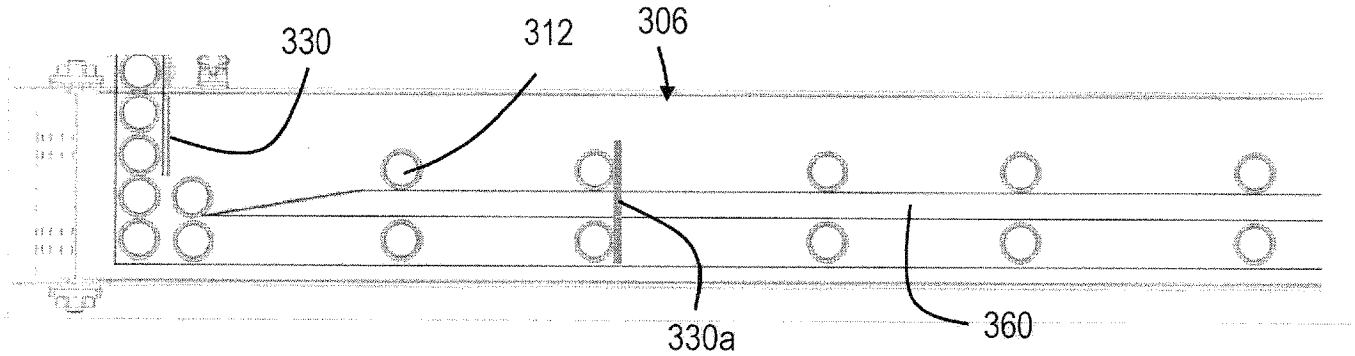

FIGS. 39A-39C are top view schematic diagrams of diverter ramps 360 used with the container-filling machine 300, in accordance with the first exemplary embodiment of the present disclosure. As shown, a diverter ramp 360 may be positioned near the guillotine gate 330 such that when two containers 312 pass the guillotine gate 330, the two containers 312 are separated or otherwise diverted from one another. The diverter ramps 360 may separate containers 312 to a proper distance pitch to enter the filler. This will allow for multiple lanes of more than one or two containers to flow into the filling machine to achieve a greater filling throughput. As is shown in FIG. 39C, additional guillotine gates 330*a* may be used to align the containers 312 for better line control into the filler.

Figure 40:
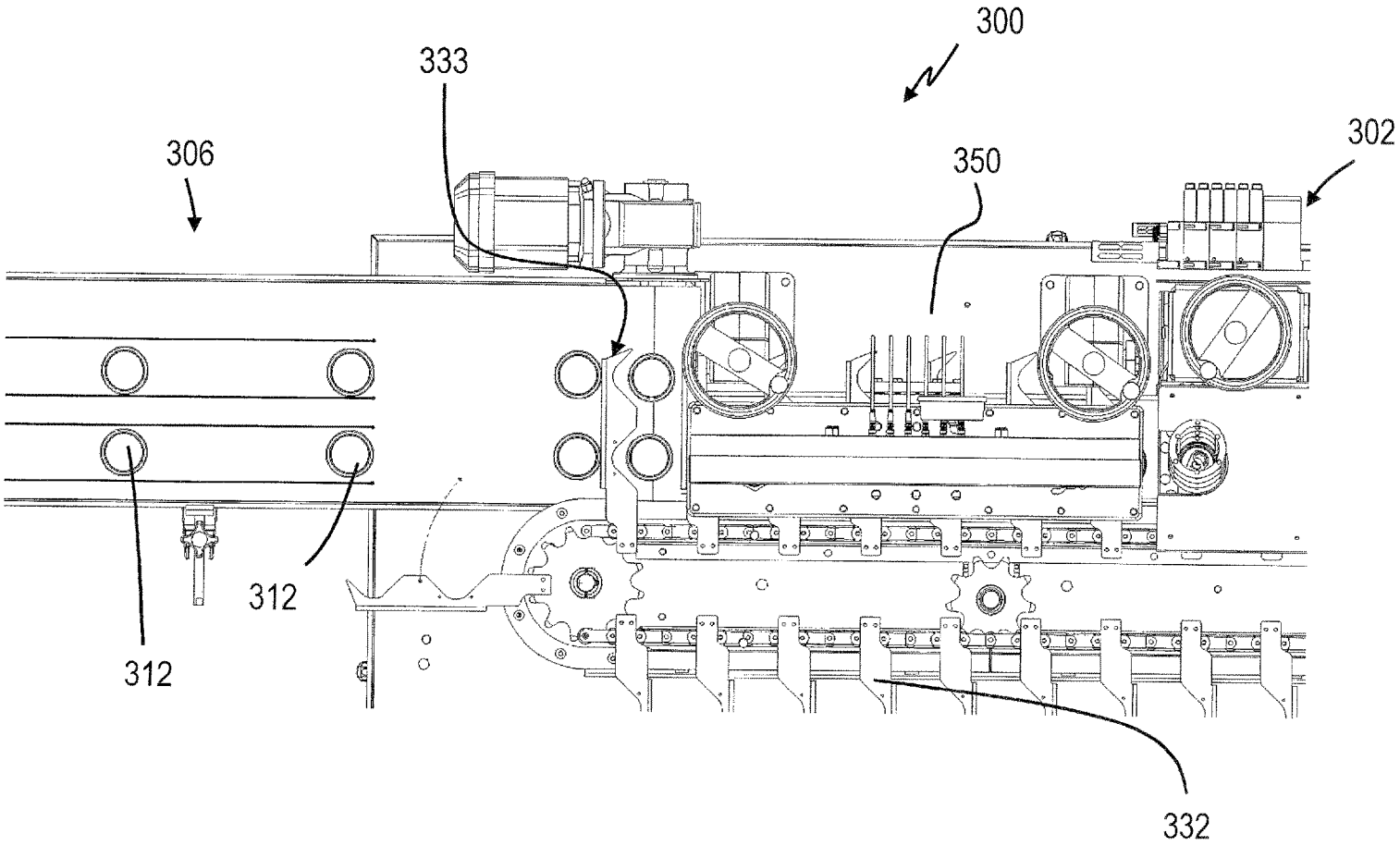
FIG. 40 is a top view schematic diagram of the container-filling machine, in accordance with the first exemplary embodiment of the present disclosure.

FIG. 40 is a top view schematic diagram of the container-filling machine 300, in accordance with the first exemplary embodiment of the present disclosure. Specifically, FIG. 40 depicts the containers 312 traveling down the second conveyer 306 (feed lane indexing conveyer) and to stop on the back side 333 of a lug of the lug chain 332. The container 312 will then stop when it makes contact with the back side 333 of the lug chain 332. Then, the lug chain 332 indexes around the corner and a lug contacts the containers 312 and moves it to the appropriate position under the filling head 350. The use of the second conveyer 306 with the lug chain 332 allows the containers 312 to enter the filling area in substantially a straight path, which may provide improvements over devices which rotate the containers 312 around a corner. The platform that the containers 312 sit on while advancing to the filling head 350 may have a self-centering V-groove, or similar feature, to center the container 312 appropriately.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An apparatus for filling containers with fluid, the apparatus comprising:

a filling head having a fluid holding area;

at least one multi-container filling nozzle connected to the filling head, wherein at least two containers with differently-sized openings are fillable with a quantity of fluid from the fluid holding area without changing the at least one multi-container filling nozzle;

a valve located above the at least one multi-container filling nozzle, the valve having a valve stem, wherein the valve stem extends through the at least one multi-container filling nozzle and has a terminating end located above a lowermost point of the at least one multi-container filling nozzle; and a laminar flow nozzle located at the terminating end of the valve stem, wherein fluid flowing through the at least one multi-container filling nozzle contacts the laminar flow nozzle and is radially directed to a sidewall of the container at an immediate opening of the container.

2. The apparatus of claim 1, wherein the at least one multi-container filling nozzle further comprises at least two gaskets.

3. The apparatus of claim 2, wherein the at least two gaskets are positioned concentric with one another.

4. The apparatus of claim 2, wherein one of the at least two gaskets is positioned inward of the lowermost point of the at least one multi-container filling nozzle.

5. The apparatus of claim 1, wherein the at least one multi-container filling nozzle further comprises an upper head connected to the filling head and engaged with a lower head, wherein the lower head has at least two gaskets.

6. The apparatus of claim 5, wherein the upper head is engaged with the lower head with a threaded connection.

7. The apparatus of claim 5, wherein the upper head further comprises:

at least two valve connections; and a gas and fluid valve activation solenoid connection.

8. The apparatus of claim 7, further comprising at least two valve activation solenoids connected to the gas and fluid valve activation solenoid connection.

9. The apparatus of claim 8, wherein the at least two valve connections further comprise a vacuum valve connection and a snift/vent valve connection, wherein the at least two valve activation solenoids control a release of gas from an interior of a container in contact with the at least one multi-container filling nozzle to an outside atmosphere.

10. The apparatus of claim 1, further comprising a valve connected to the at least one multi-container filling nozzle, wherein the valve controls a quantity of fluid dispensed from the fluid holding area into a container.

11. The apparatus of claim 1, wherein the laminar flow nozzle is positioned on a lower end of a gas valve, wherein a quantity of gas is emitted into a container in contact with the multi-container filling nozzle from the gas valve.

12. The apparatus of claim 2, wherein one of the at least two gaskets is positioned outwards of the lowermost point of the at least one multi-container filling nozzle.

13. An apparatus for filling containers with fluid, the apparatus comprising:

a filling head having a fluid holding area; and at least one multi-container filling nozzle connected to the filling head and capable of filling at least two different containers with differently-sized openings with a quantity of fluid from the fluid holding area without changing the at least one multi-container filling nozzle, wherein the at least one multi-container filling nozzle has an annular container engagement portion for engaging with an opening rim of a container, wherein the annular container engagement portion has two opposing angular sides that converge to a lowermost point of the at least one multi-container filling nozzle, and wherein a first side of the two opposing angular sides is engageable with an opening rim of a first container and a second side of the two opposing angular sides is engageable with an opening rim of a second container, wherein the first container has a different-sized opening than the second container.

14. The apparatus of claim 13, further comprising a valve located above the at least one multi-container filling nozzle, the valve having a valve stem, wherein the valve stem extends through the at least one multi-container filling nozzle and has a terminating end at a location above the lowermost point of the at least one multi-container filling nozzle.

15. The apparatus of claim 14, further comprising a laminar flow nozzle located at the terminating end of the valve stem, wherein fluid flowing through the at least one multi-container filling nozzle contacts the laminar flow nozzle and is radially directed to a sidewall of the container at an immediate opening of the container.

16. The apparatus of claim 13, wherein the at least one multi-container filling nozzle further comprises an upper head and a lower head, wherein the upper head is connectable to the filling head and the upper head is threadedly engagable with the lower head.

17. The apparatus of claim 16, wherein substantially air-tight seals are formable between the rim openings of each of the first and second containers and the two opposing angular sides of the annular container engagement portion, respectively.

18. The apparatus of claim 13, wherein the upper head of the at least one multi-container filling nozzle comprises:

at least two valve connections; and a gas and fluid valve activation solenoid connection.

19. The apparatus of claim 18, further comprising at least two valve activation solenoids connected to the gas and fluid valve activation solenoid connection.

20. The apparatus of claim 18, wherein the at least two valve connections further comprise a vacuum valve connection and a sniff/vent valve connection, wherein the at least two valve activation solenoids control a release of gas from an interior of a container in contact with the at least one multi-container filling nozzle to an outside atmosphere.

* * * * *